US007477223B2

(12) United States Patent
Sekiguchi et al.

(10) Patent No.: US 7,477,223 B2
(45) Date of Patent: Jan. 13, 2009

(54) LIQUID-CRYSTAL DISPLAY DEVICE AND METHOD OF DRIVING LIQUID-CRYSTAL DISPLAY DEVICE

(75) Inventors: Yoshifumi Sekiguchi, Hitachi (JP); Shouichi Hirota, Hitachi (JP); Shinichi Komura, Hitachi (JP); Susumu Edo, Mito (JP)

(73) Assignee: Hitachi, Ltd., Tokyo (JP)

( * ) Notice: Subject to any disclaimer, the term of this patent is extended or adjusted under 35 U.S.C. 154(b) by 980 days.

(21) Appl. No.: 10/729,391

(22) Filed: Dec. 5, 2003

(65) Prior Publication Data

US 2004/0113879 A1 Jun. 17, 2004

(30) Foreign Application Priority Data

Dec. 10, 2002 (JP) ..... 2002-357828
Oct. 16, 2003 (JP) ..... 2003-355776

(51) Int. Cl.
*G09G 3/36* (2006.01)

(52) U.S. Cl. ..... 345/94

(58) Field of Classification Search ..... 345/94, 345/87

See application file for complete search history.

(56) References Cited

U.S. PATENT DOCUMENTS 4,571,585 A * 2/1986 Stein et al. ..... 345/96
5,561,441 A * 10/1996 Hamano ..... 345/91
5,724,057 A * 3/1998 Kimura et al. ..... 345/89
5,748,169 A * 5/1998 Okumura et al. ..... 345/100
5,892,494 A * 4/1999 Kimura et al. ..... 345/96
6,040,814 A * 3/2000 Murakami et al. ..... 345/94
6,636,206 B1 * 10/2003 Yatabe ..... 345/204
6,940,484 B2 * 9/2005 Yatabe ..... 345/99
7,034,790 B2 * 4/2006 Fukami et al. ..... 345/94
7,205,970 B2 * 4/2007 Kim et al. ..... 345/89
7,365,725 B2 * 4/2008 Nakayoshi et al. ..... 345/94

* cited by examiner

*Primary Examiner*—Sumati Lefkowitz
*Assistant Examiner*—Grant D Sitta
(74) *Attorney, Agent, or Firm*—Hogan & Hartson LLP

(57) ABSTRACT

A method of driving an active-matrix liquid-crystal display device includes a frame period of a picture displayed on a liquid-crystal panel divided into a scanning period and a hold period longer than the scanning period. In the scanning period, image data of an amount corresponding to a frame is written into the liquid-crystal panel. In the hold period following the scanning period, an off state is sustained. Each data line repeatedly experiences a positive-polarity frame period and a negative-polarity frame period, which are arranged alternately along the time axis. In a frame period, an electric potential appearing on a positive-polarity data line in the hold period is increased to a level higher than an electric potential appearing on an opposite electrode. The positive-polarity data line is defined as the data line, on which an electric potential appears at a level higher than an electric potential appearing on the opposite electrode.

32 Claims, 27 Drawing Sheets

LIQUID-CRYSTAL DISPLAY DEVICE AND METHOD OF DRIVING LIQUID-CRYSTAL DISPLAY DEVICE

BACKGROUND OF THE INVENTION

In general, the present invention relates to a method of driving a liquid-crystal display device and the liquid-crystal display device driven by the method. More particularly, the present invention relates to an active-matrix liquid-crystal display device having a driving frequency decreased to lower its power consumption and a method of driving the liquid-crystal display device.

Japanese Patent Laid-open No. 2002-182619 discloses a method of driving an active-matrix type liquid-crystal display device in order to reduce its power consumption. The method disclosed in this reference has a scanning period and a break period longer than the scanning period. The scanning period is a period during which a screen is scanned. The break period is a period in which all gate lines are put in an off state. In addition, in accordance with this method, by setting the electric potential of data lines at a predetermined signal-line break level during the break period, the frame frequency can be reduced from the present frequency of 60 Hz to decrease the power consumption.

In general, if the frame frequency is reduced, extremely small screen changes, which cannot be sensed at a frequency of 60 Hz so far, becomes noticeable by the sense of sight as the so-called flickers. The extremely small screen changes are caused by changes in transmittance for transmission and transflective types and changes in reflectance for reflection and transflective types. There exist flickers generated by a variety of causes according to various kinds of driving. Flickers generated by leakage currents synchronously with the frame frequency exist in the so-called driving method using an active device. The leakage currents include a leakage current flowing in an off state of the active device and a leakage current of a liquid-crystal layer. The leakage current flowing in an off state of the active device is referred to hereafter as an off-state leakage current. The more the frame frequency is reduced, the more easily the flickers are sensed. In addition, flickers caused by a dc element also exist. When the electric potential of a data line changes, the electric potential of the pixel electrode of a pixel connected to the data line in an off state changes due to capacitive coupling between the data line and the pixel electrode of the pixel. In turn, the changes in electric potential appearing on the pixel electrode cause such flickers.

The conventional driving method does not adequately cope with flickers caused by a leakage current of a liquid-crystal layer and an off-state leakage current of an active device. Flickers caused by a leakage current of a liquid-crystal layer and an off-state leakage current of an active device cannot be made unnoticeable by the sense of sight of a human being by making the transmittances or the reflectances of adjacent pixels cancel each other. That is to say, it is impossible to make the transmittances or the reflectances of adjacent pixels cancel each other by carrying out operations such as column inversion driving, row inversion driving or dot inversion driving as is the case with flickers caused by a dc element. Thus, flickers caused by a leakage current of a liquid-crystal layer and an off-state leakage current of an active device are flickers existing for all driving methods independently of the types of the driving methods as flickers generated synchronously with frame periods.

For the reasons described above, reduction of screen changes caused by transmittance and reflectance changes due to a leakage current of a liquid-crystal layer and an off-state leakage current of an active device can be considered to be a requirement indispensable to driving at a low frequency while sustaining a high picture quality. It is to be noted that the scope of the present invention is not limited to a liquid-crystal display device using a liquid-crystal panel of the so-called vertical electric-field type wherein a pair of substrates is used. On one of the substrates, gate lines, data lines and active devices are created whereas, on the other substrate, opposite electrodes are created. An example of the vertical electric-field type is a TN mode. For example, the present invention can also be applied in the same way to a liquid-crystal display device using a liquid-crystal panel of the so-called horizontal electric-field type (or an IPS mode) also using a pair of substrates and a liquid-crystal display device of another known active-matrix type. In the liquid-crystal display device using a liquid-crystal panel of the so-called horizontal electric-field type, opposite electrodes are created also on one of the substrates, which is used for creating gate lines, data lines and active devices. Thus, the phrase stating: "holding a liquid-crystal layer in a state of being sandwiched by pixel electrodes and opposite electrodes" in this specification means that a liquid-crystal layer exists between pixel and opposite electrodes on one of a pair of substrates for the IPS mode.

In addition, the present invention can also be applied to a liquid-crystal display device using a transmission-type liquid-crystal panel in which an illumination light beam incoming from a source outside one of a pair of substrates is radiated out from the other substrate. Furthermore, the present invention can also be applied to a liquid-crystal display device using a reflection-type liquid-crystal panel in which an illumination light beam incoming from a source outside one of a pair of substrates is radiated out from the same substrate. Moreover, the present invention can also be applied to a liquid-crystal display device using a transflective-type liquid-crystal panel in which both a reflection display unit and a transmission display unit are employed.

SUMMARY OF THE INVENTION

It is an object of the present invention to provide a method of driving a liquid-crystal display device as a method capable of reducing transmittance and reflectance changes caused by a liquid current of a liquid crystal and an off-state leakage current of an active device so as to provide a picture having a good picture quality and no flickers even at a driving frequency sufficiently lower than 60 Hz as well as capable of reducing a power consumption by decreasing the driving frequency, and to provide the liquid-crystal display device adopting the driving method.

In order to achieve the object described above, in accordance with an aspect of the present invention, there is provided a method of driving an active-matrix liquid-crystal display device wherein a frame period of a picture displayed on a liquid-crystal panel is divided into a scanning period and a hold period longer than the scanning period; in the scanning period, image data of an amount corresponding to a frame is written into the liquid-crystal panel; in the hold period following the scanning period, an off state is sustained; each data line repeatedly experiences a positive-polarity frame period and a negative-polarity frame period, which are arranged alternately along the time axis. In addition, in a frame period, an electric potential appearing on a positive-polarity data line in the hold period is increased to a level higher than an electric potential appearing on an opposite electrode where the positive-polarity data line is defined as the data line, on which an electric potential appears at a level higher than an electric potential appearing on the opposite electrode when an electric potential appearing on a gate line changes from an on-state level to an off-state level in the scanning period of the frame period; and an electric potential appearing on a negative-polarity data line in the hold period is decreased to a level lower than the electric potential appearing on the opposite electrode where the negative-polarity data line is defined as the data line provided on a row adjacent to the positive-polarity data line as the data line, on which an electric potential appears at a level lower than an electric potential appearing on the opposite electrode when an electric potential appearing on a gate line changes from an on-state level to an off-state level in the scanning period of the frame period.

In addition, in accordance with another aspect of the present invention, there is provided an active-matrix liquid-crystal display device including a liquid-crystal panel comprising:

a pair of substrates, at least one of which is a transparent substrate;

a plurality of data lines, which are each extended in a row direction on a specific one of the substrates and are arranged in a column direction perpendicularly intersecting the row direction;

a plurality of gate lines, which are each extended in the column direction and are arranged in the row direction;

an active device connected at an intersection of each of the data lines and each of the gate lines;

a pixel electrode driven by the active device;

an opposite electrode provided on the specific substrate or the other one of the substrates as an electrode sandwiching a liquid-crystal layer between the opposite electrode and the pixel electrode; and a storage capacitor connected in parallel to the liquid-crystal layer;

wherein:

a frame period of an image displayed on the liquid-crystal panel is divided into a scanning period and a hold period longer than the scanning period;

in the scanning period, image data of an amount corresponding to a frame is written into the liquid-crystal panel;

in the hold period following the scanning period, an off state is sustained; and the liquid-crystal display device includes a scanning-period electric-potential control means for controlling an electric potential in the hold period; and wherein:

the scanning-period electric-potential control means increases an electric potential appearing on a positive-polarity data line in the hold period to a level higher than an electric potential appearing on the opposite electrode where the positive-polarity data line is defined as the data line, on which an electric potential appears at a level higher than an electric potential appearing on the opposite electrode when an electric potential appearing on the gate line changes from an on-state level to an off-state level in the scanning period; and the scanning-period electric-potential control means decreases an electric potential appearing on a negative-polarity data line in the hold period to a level lower than the electric potential appearing on the opposite electrode where the negative-polarity data line is defined as the data line provided on a row adjacent to the positive-polarity data line as the data line, on which an electric potential appears at a level lower than an electric potential appearing on the opposite electrode when an electric potential appearing on the gate line changes from an on-state level to an off-state level in the scanning period.

Thus, it is possible to reduce the power consumption while sustaining a high picture quality by preventing flickers from being generated in an image displayed at a low driving frequency.

It is to be noted that the scope of the present invention is not limited to configurations described in claims appended to this specification and configurations disclosed in embodiments described later. Instead, it is needless to say that a variety of changes can be made without departing from technological concepts provided by the present invention.

As described above, in accordance with the present invention, it is possible to provide a liquid-crystal display device capable of reducing the power consumption while sustaining a high picture quality by preventing flickers from being generated in an image displayed at a low driving frequency.

BRIEF DESCRIPTION OF THE DRAWINGS

Other objects and advantages of the invention will become apparent from the following description of embodiments with reference to the accompanying drawings in which.

DETAILED DESCRIPTION OF THE PREFERRED EMBODIMENTS

Figure 1:
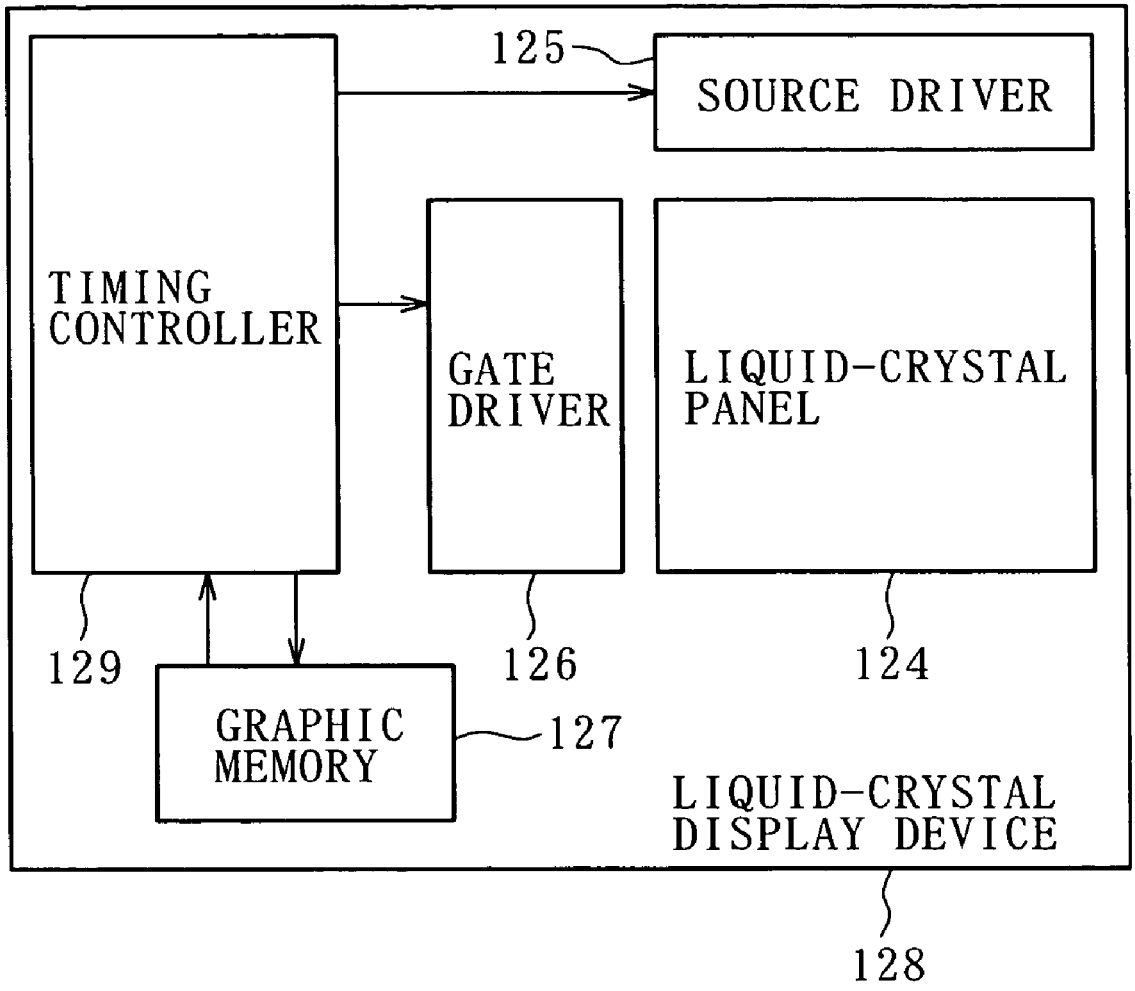
FIG. 1 is an explanatory block diagram referred to in describing the system configuration of a liquid-crystal display device according to the present invention.

Preferred embodiments of the present invention will below be described by referring to the drawings. The embodiments described below implement a typical active-matrix liquid-crystal display device adopting a reflection-type liquid-crystal display method as a display method requiring only a small power consumption. However, the scope of the present invention is not limited to such an active-matrix liquid-crystal display device. That is to say, the present invention can also be applied to other display devices such as transmission-type and reflection-type liquid-crystal display devices, which employ active devices, as well as organic EL or inorganic EL display devices. Active devices employed in the active-matrix liquid-crystal display device implemented by the embodiments described below are each a thin-film transistor (TFT). The number of pixels arranged to form a matrix in the active-matrix liquid-crystal display device is N×M where N and M are each an integer at least equal to 2. However, the scope of the present invention is not limited to such an active-matrix liquid-crystal display device. That is to say, the active devices can each be another field-effect transistor device such as an MIM. In addition, the shape of pixels arranged to form a matrix is not specially determined. Furthermore, in describing the configuration of a liquid-crystal panel, the liquid-crystal panel may be referred to as a liquid-crystal display device in some cases.

FIG. 1 is an explanatory block diagram showing the system configuration of a liquid-crystal display device 128 according to the present invention. The liquid-crystal display device 128 explained below is a reflection-type liquid-crystal display device. The liquid-crystal display device 128 comprises a liquid-crystal panel 124, a gate-line-driving circuit 126, a data-line-driving circuit 125, a timing controller 129 and a graphic memory 127. The liquid-crystal panel 124 is a panel on which pixels are arranged to form a matrix. Referred to hereafter simply as a gate driver, the gate-line-driving circuit 126 is a circuit for driving gate lines. Referred to hereafter simply as a source driver, the data-line-driving circuit 125 is a circuit for driving data lines. The timing controller 129 is a control means. The graphic memory 127 is a storage device for storing image data. An electrode serving as a counterpart of the electrode of each pixel is referred to as an opposite electrode. The electric potential of an opposite electrode is referred to as an electric potential appearing on the opposite electrode. A substrate on which devices such as thin-film transistors are created is referred to as a lower substrate or one of the substrates. On the other hand, a substrate having opposite electrodes created thereon is referred to as an upper substrate or the other substrate.

Figure 2:
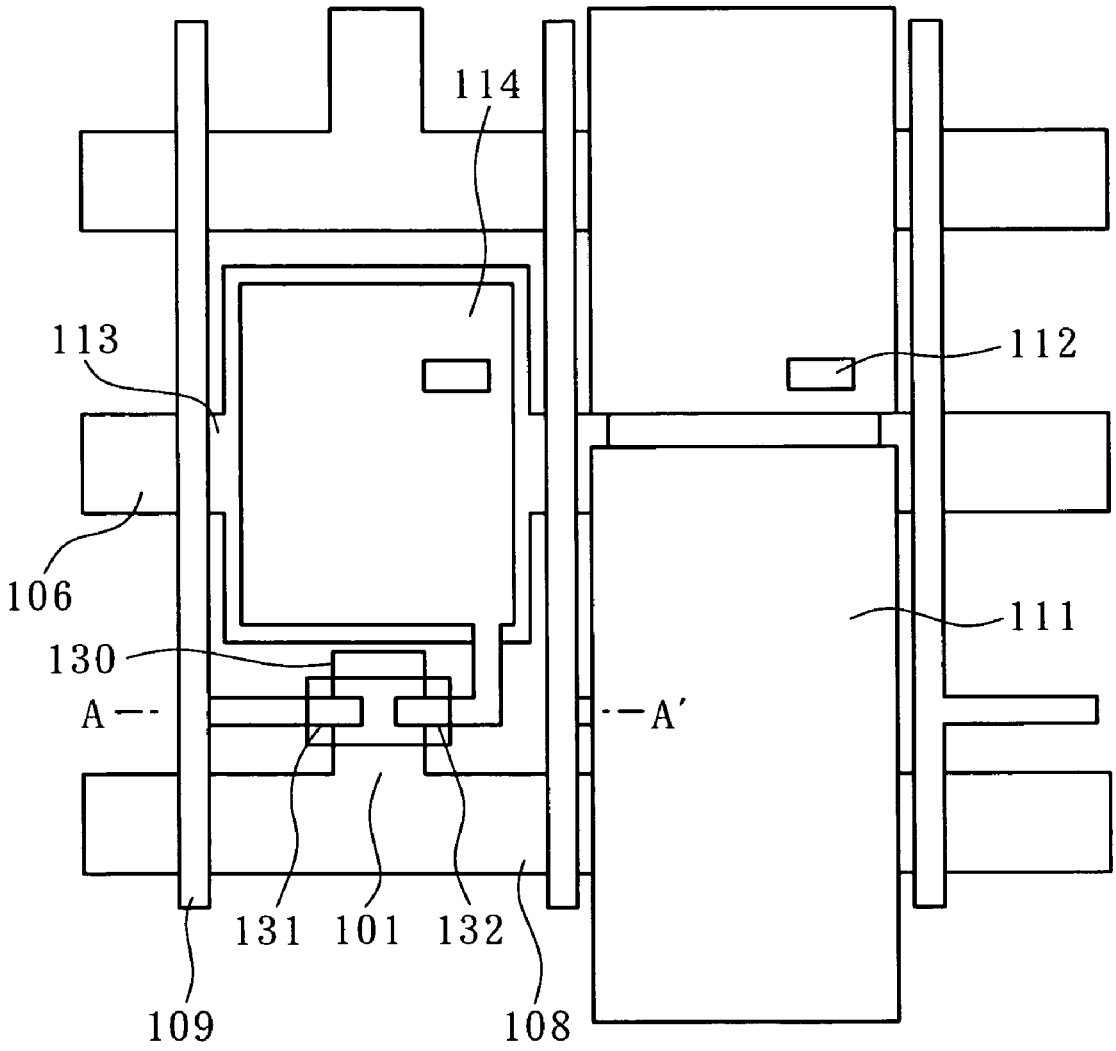
FIG. 2 is an explanatory diagram showing the top view of the structure of the vicinity of a pixel created on a lower substrate of a liquid-crystal panel.

FIG. 2 is an explanatory diagram showing the top view of the structure of the vicinity of a pixel created on the lower substrate of the liquid-crystal panel. As shown in FIG. 2, a thin-film transistor (TFT) 101 is provided at the intersection of a data line 109 and a gate line 108. The thin-film transistor 101 is connected to an upper-side capacitor pad 114. The upper-side capacitor pad 114 forms a storage capacitor in conjunction with a lower-side capacitor pad 113 connected to a storage line 106 having the same electric potential as the electric potential appearing on the opposite electrode. A pixel electrode 111 is connected to the upper-side capacitor pad 114 through a through hole 112. Also referred to hereafter as a reflective electrode, the pixel electrode 111 is made of a reflection member having typically A1 electro-conductivity. A liquid-crystal layer sandwiched by the pixel electrode 111 and an opposite electrode created as an electrode facing the pixel electrode 111. A voltage representing pixel data is applied to the liquid-crystal layer for each pixel to control the reflectance. In the system shown in the figure, the pixel electrode 111 overlaps on the upper-side capacitor pad 114 in a stretching direction of the data line 109. However, the liquid-crystal display device is not limited to this configuration. It is to be noted that, in order to make this configuration easy to understand, the pixel electrode 111 of the observed pixel is not shown in the figure.

The pixel electrode 111 is positioned at such a location that the thin-film transistor 101 is located exactly at the center of the pixel electrode 111. By positioning the pixel electrode 111 at such a location, a light beam incoming from a gap between pixel electrodes 111 is attenuated before the light beam reaches the thin-film transistor 101 so that generation of a leakage current due to a photocurrent can be avoided. In addition, as shown in FIG. 2, the thin-film transistor 101 provided for a pixel is positioned at the center between the data line 109 connected to a source 131 of the thin-film transistor 101 and another data line 109 on the pixel side opposite to the data line 109 connected to the source 131. That is to say, the thin-film transistor 101 is in a middle position between the data line 109 connected to the source 131 and the other data line 109, which sandwich the pixel. By positioning the thin-film transistor 101 in this way, it is possible to place the thin-film transistor 101 at the center of the pixel electrode 111 and, at the same time, prevent the pixel electrode 111 from overlapping the data line 109. It is thus possible to suppress the leakage current due to a photocurrent of the thin-film transistor 101 while getting rid of an effect of the data line 109 on the pixel electrode 111. Since this embodiment implements a reflection-type liquid-crystal display device, the pixel electrode is made of an electro-conductible reflection member. In the case of a transmission-type liquid-crystal display device, on the other hand, the pixel electrode is made of a member with transparent electro-conductivity. Since such a pixel electrode transmits a light beam, generation of a leakage current due to a photocurrent cannot be avoided even if the electrode made of a member with transparent electro-conductivity is provided at such a location that the thin-film transistor 101 is positioned at the center of the electrode made of a member with transparent electro-conductivity. In a liquid-crystal display device of the transflective type, the pixel electrode is made of a member with transparent electro-conductivity and a reflection member exhibiting electro-conductivity. In this case, by providing an electrode portion made of a reflection member exhibiting electro-conductivity at such a location that the thin-film transistor 101 is just positioned at the center of the electrode portion made of a reflection member exhibiting electro-conductivity, generation of a leakage current due to a photocurrent can be avoided as described above.

Figure 3:
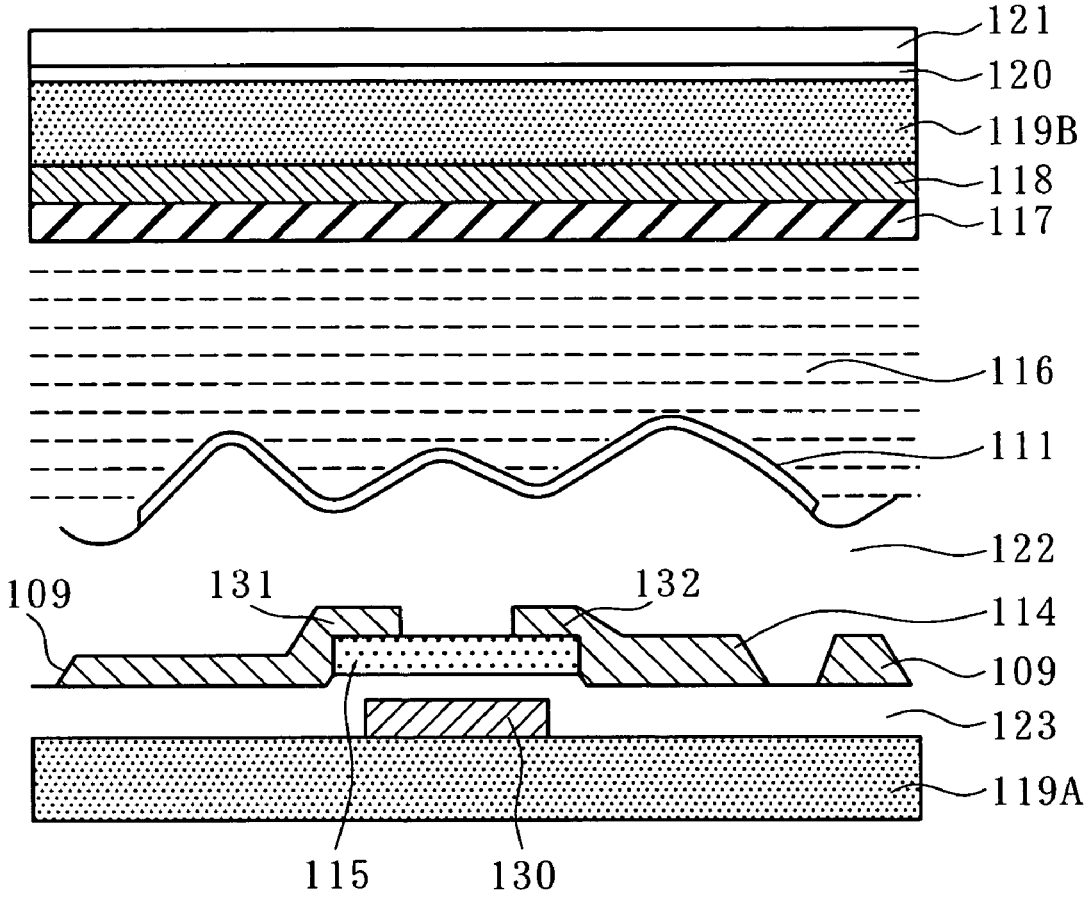
FIG. 3 is a diagram showing a cross section of the pixel taken along line A-A' shown in FIG. 2.

FIG. 3 is a diagram showing a cross section of the pixel along line A-A' shown in FIG. 2. As shown in FIG. 3, the lower substrate comprises a thin-film transistor 101, an inter-layer insulation film 122 and a pixel electrode 111. The thin-film transistor 101 has a gate 130, an a-Si semiconductor layer 115, a source 131, a drain 132 and a gate insulation film 123. The gate 130 is connected to the gate line 108 created on a transparent-glass substrate 119A, which is a substrate made of transparent glass. The source 131 is connected to the data line 109. The drain 132 is connected to the upper-side capacitor pad 114. The pixel electrode 111 serves as a reflective electrode created on the inter-layer insulation film 122, which is created on the thin-film transistor 101. The storage line 106 and the lower-side capacitor pad 113 are on the same layer as the gate 130 and created on the transparent-glass substrate 119. The upper-side capacitor pad 114 is on the same layer as the data line 109.

The surface on the side of the pixel electrode 111 created on the inter-layer insulation film 122 is an uneven surface for controlling a light beam reflected by the pixel electrode. The upper substrate comprises a color filter 118, a transparent electrode 117, a transparent-glass substrate 119B, a phase plate 120 and a polarizer 121. The color filter 118 is created on the surface of the transparent-glass substrate 119B. The surface of the transparent-glass substrate 119B on which the color filter 118 is created faces the transparent-glass substrate 119A having the thin-film transistor 101. The transparent electrode 117 is created on the color filter 118. On the other surface of the transparent-glass substrate 119B, the phase plate 120 and the polarizer 121 are created. The other surface is a surface on the opposite side of the surface of the transparent-glass substrate 119B on which the color filter 118 is created.

Figure 4:
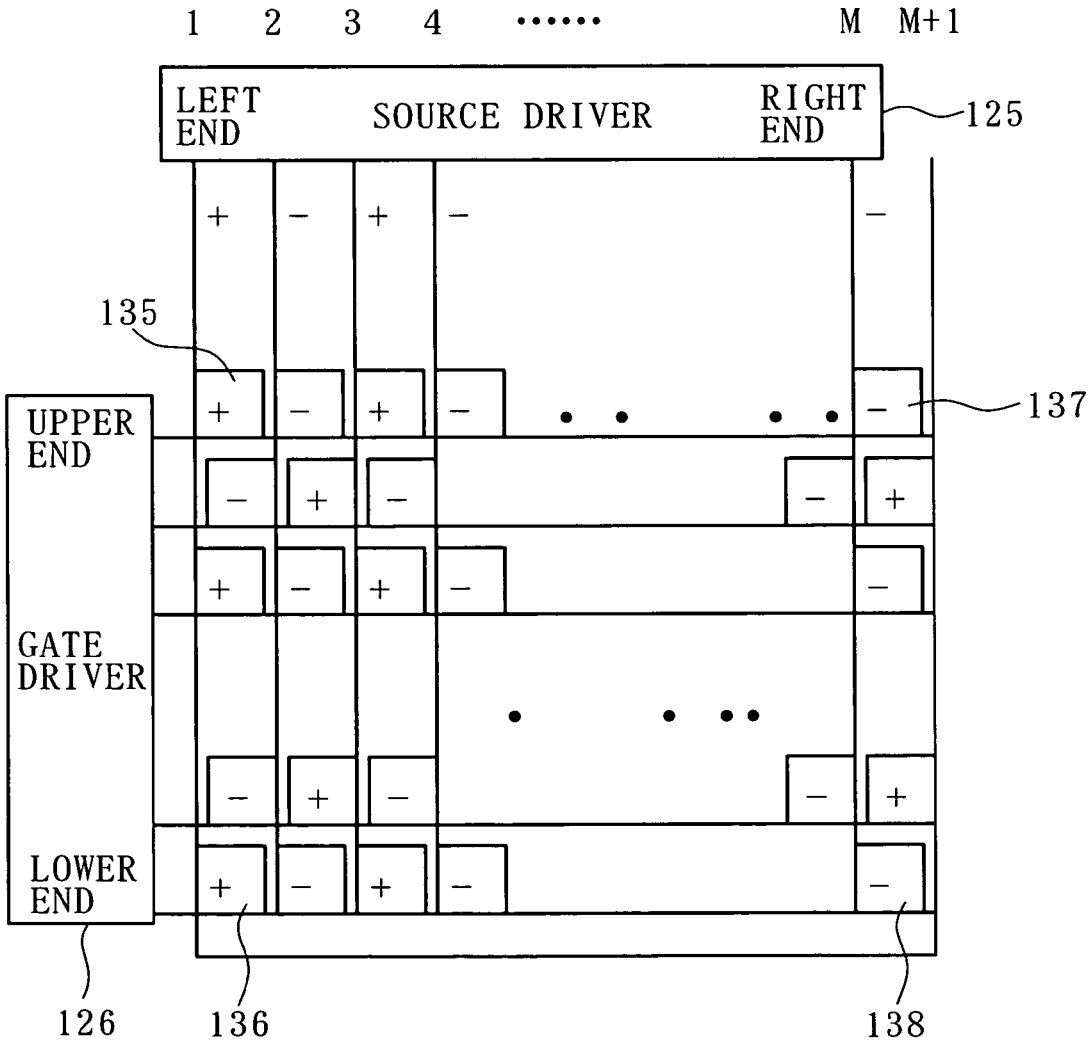
FIG. 4 is a diagram referred to in describing a model of typical wiring of the liquid-crystal panel composing the liquid-crystal display device implemented by the embodiment of the present invention.

FIG. 4 is a diagram showing a model of typical wiring of a liquid-crystal panel composing the liquid-crystal display device implemented by the embodiment. In the wiring model shown in FIG. 4, the top gate line of the gate driver 126 is referred to as the first gate line. A gate line below the first gate line is referred to as a second gate line, a gate line below the second gate line is referred to as a third gate line and so on. Similarly, a data line at the left end of the source driver 125 is referred to as a first data line. A data line on the right side of the first data line is referred to as a second data line, a data line on the right side of the second data line is referred to as a third data line and so on. Pixel (1, 1) is a pixel 135 having a pixel electrode connected to the drain of a thin-film transistor located at the intersection of the first gate line and the first data line. In general, pixel (n, m) is a pixel having a pixel electrode connected to the drain of a thin-film transistor located at the intersection of the nth gate line and the mth data line, which are provided on respectively the nth row and the mth column of the pixel matrix, where n is an integer in the range 1 to N whereas m is an integer in the range 1 to M. In this configuration, however, (M+1) data lines are provided. The first to Mth data lines are connected to the source driver 125 and the (M+1)th data line is connected to the first data line. On the other hand, the number of gate lines is N. All the gate lines are connected to the gate driver 126. The source of a thin-film transistor provided at pixel (n, m) where n is an odd integer is connected to all the first to Mth data lines. On the other hand, the source of a thin-film transistor provided at pixel (n, m) where n is an even integer is connected to all the second to (M+1)th data lines.

Some technical terms to be used in later descriptions are to be defined here.

One frame period comprises a scanning period to be defined later and a hold period following the scanning period. To put it in detail, one frame period of a picture displayed on a liquid-crystal panel comprises a scanning period, during which image data of one frame of a picture to be displayed on a liquid-crystal panel is written into the liquid-crystal panel, and a hold period defined as an off-state period following the scanning period. The hold period is longer than the scanning period.

That is to say, a scanning period is defined as a period, during which an electric potential representing desired image data is given to all pixel electrodes provided on the liquid-crystal panel. On the other hand, the hold period is a period immediately succeeding a scanning period as a period during which all gate lines provided in the liquid-crystal panel are put in an off state.

Observe one of the data lines provided in the liquid-crystal panel. For this observed data line, frame periods are repeated consecutively. In one of the frame periods, in a scanning period, an electric potential appearing on the pixel electrode of each pixel connected to the observed data line right after an on-state period is always higher than an electric potential appearing on the opposite electrode. Such frame period is referred to as a positive-polarity frame period. A positive-polarity frame period is also defined as a frame period comprising a scanning period and a hold period following the scanning period. During the scanning period, an electric potential appears on a data line at a level higher than an electric potential appearing on the opposite electrode when the electric potential of the gate line associated with the data line changes from an on-state electric potential to an off-state electric potential.

Observe one of the data lines provided in the liquid-crystal panel. Similarly, for this observed data line, frame periods are repeated consecutively. In one of the frame periods, in a scanning period, an electric potential appearing on the pixel electrode of each pixel connected to the observed data line right after an on-state period is always lower than an electric potential appearing on the opposite electrode. Such frame period is referred to as a negative-polarity frame period. A negative-polarity frame period is also defined as a frame period comprising a scanning period and a hold period following the scanning period. During the scanning period, an electric potential appears on a data line at a level lower than the electric potential appearing on the opposite electrode when the electric potential of the gate line associated with the data line changes from an on-state electric potential to an off-state electric potential.

A positive-polarity data line is defined as a data line experiencing driving in a positive-polarity frame period observed as one of frame periods repeated consecutively. On the other hand, a negative-polarity data line is defined as a data line experiencing driving in a negative-polarity frame period observed as one of frame periods repeated consecutively.

A voltage appearing on the liquid crystal is defined as a difference in electric potential between the ends of a liquid-crystal layer sandwiched by a pixel electrode and an opposite electrode in a pixel provided on a liquid-crystal panel. A positive-polarity liquid-crystal voltage is defined as a difference in electric potential between the ends of a liquid-crystal layer sandwiched by a pixel electrode and an opposite electrode for an electric potential appearing on the pixel electrode at a level higher than the electric potential appearing on the opposite electrode. A positive-polarity liquid-crystal voltage is also defined as a voltage appearing on the liquid crystal of a pixel in a frame for a case in which an electric potential appears on a data line connected to the pixel at a level higher than the electric potential appearing on the opposite electrode when the electric potential of a gate line connected to the pixel changes from an on-state electric potential to an off-state electric potential.

Similarly, a negative-polarity voltage appearing on the liquid crystal is defined as a difference in electric potential between the ends of a liquid-crystal layer sandwiched by a pixel electrode and an opposite electrode for an electric potential appearing on the pixel electrode lower than the electric potential appearing on the opposite electrode. A negative-polarity voltage appearing on the liquid crystal is also defined as a voltage appearing on the liquid crystal of a pixel in a frame for a case in which an electric potential appears on a data line connected to the pixel at a level lower than the electric potential appearing on the opposite electrode right before the electric potential of a gate line connected to the pixel changes from an on-state electric potential to an off-state electric potential.

In the wiring model shown in FIG. 4, a data line marked with a "+" symbol is a positive-polarity data line. On the other hand, a data line marked with a "−" symbol is a negative-polarity data line. A liquid-crystal voltage written into a pixel marked with a "+" symbol has a positive polarity. On the other hand, a liquid-crystal voltage written into a pixel marked with a "−" symbol has a negative polarity. If positive-polarity data lines and negative-polarity data lines are wired repeatedly in an alternate manner as data lines in the liquid-crystal panel 124 having a wiring model described above by referring to FIG. 4, the polarity of the liquid-crystal voltage written into pixels is inverted alternately for each of the pixels. Thus, by adopting the wiring and the driving, which are described above, the number of polarity inversions per scanning period of the voltage appearing on the liquid crystal remains the same as it is, being equal to that for a case of execution of frame inversion driving. Accordingly, dot inversion driving can be carried out in a pseudo manner. By execution of frame inversion driving in a pseudo manner in this way, flickers spatially distributed as flickers caused by a dc element can be made unnoticeable by the sense of sight.

Figure 5:
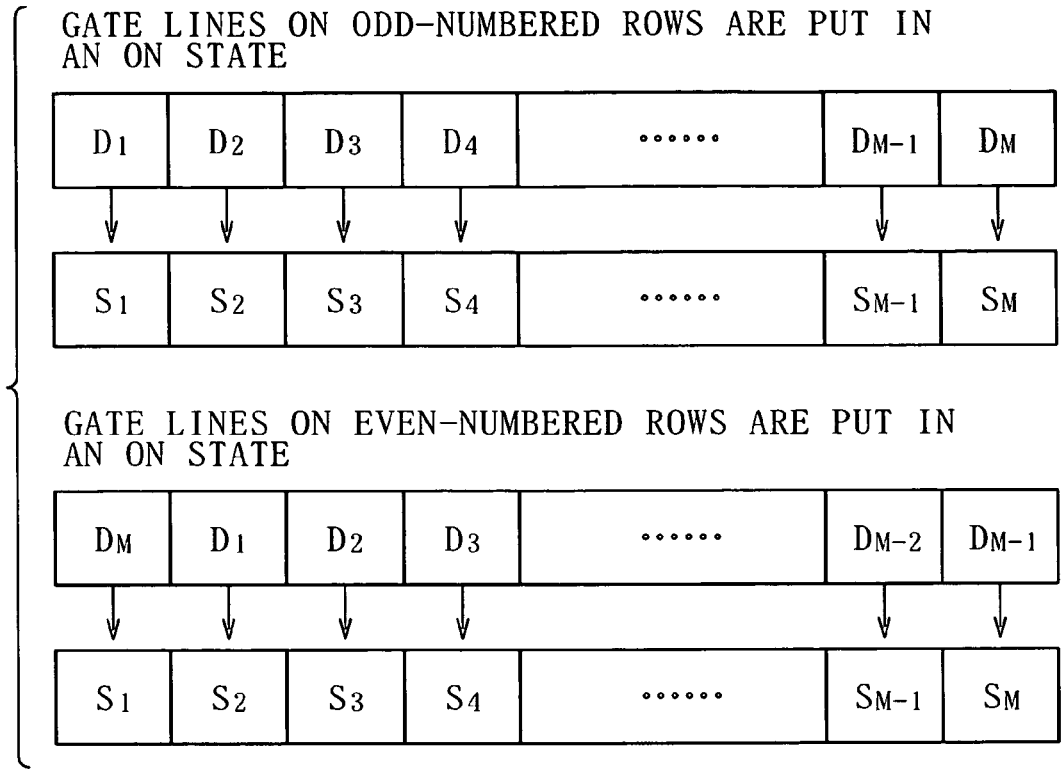
FIG. 5 is an explanatory diagram referred to in describing a method of transferring image data to each data line in a scanning period in the embodiment of the present invention.

FIG. 5 is an explanatory diagram showing a method of transferring image data to each data line in a scanning period in the embodiment of the present invention. Assume that pieces of image data are to be written into pixels on a row of the wiring described above from the first column to the Mth column. To be more specific, let symbols D1, D2, D3, - - - and Dm denote pieces of image data to be written sequentially into pixels on the first column to the Mth column respectively. Symbols S1, S2, S3, - - - and Sm denote M memory cells provided for the source driver 125. An electric potential representing image data stored in memory cell Sj is applied to a data line of the jth column where subscript j is an integer in the range 1 to M.

When a gate line of an odd-numbered row is selected, image data Dj is stored in memory cell Sj where subscript j is an integer in the range 1 to M. When a gate line of an even-numbered row is selected, on the other hand, image data DM is stored in memory cell S1. In this case, the timing controller 129 controls transfers of image data to store image data Dj-1 in memory cell Sj where subscript j is an integer in the range 2 to M.

In the typical wiring described earlier, the first to Mth data lines are connected to the source driver 125. In this typical wiring, on the other hand, the second to (M+1)th data lines are connected to the source driver 125 but, since the (M+1)th data line is connected to the first data line, dot inversion driving can be carried out in a pseudo manner if the timing controller 129 controls transfers of image data to the memory cells.

In addition, the source of the thin-film transistor provided at each pixel is connected to data lines as follows: The source of the thin-film transistor provided at each pixel on an even-numbered row is connected to all the first to Mth data lines. On the other hand, the source of the thin-film transistor provided at each pixel on an odd-numbered row is connected to all the second to (M+1)th data lines. Even with such wiring, if the (M+1)th data line is connected to the first data line, dot inversion driving can be carried out in a pseudo manner if the timing controller 129 controls transfers of image data to the memory cells.

Figure 6:
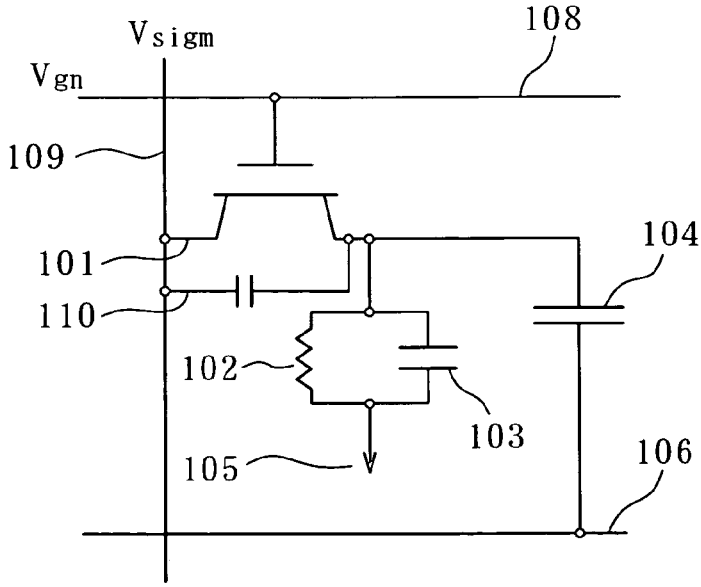
FIG. 6 is an explanatory diagram referred to in describing an equivalent circuit of a pixel located at the intersection of the nth row and the mth column of a pixel matrix of the liquid-crystal panel composing the liquid-crystal display device implemented by the embodiment of the present invention.
Figure 7:
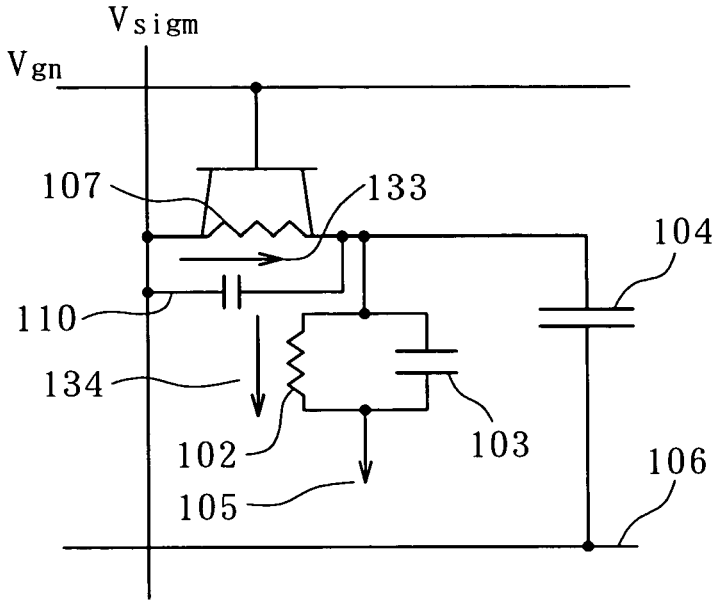
FIG. 7 is an explanatory diagram referred to in describing an equivalent circuit for an off-state period of a pixel on the liquid-crystal panel according to the embodiment of the present invention.

FIG. 6 is an explanatory diagram showing an equivalent circuit of a pixel located at the intersection of the nth row and the mth column of the pixel matrix of a liquid-crystal panel composing a liquid-crystal display device implemented by the embodiment of the present invention. That is to say, the figure shows the configuration of a pixel located at the intersection of the nth row and the mth column of the pixel matrix in the liquid-crystal panel 124 provided by the embodiment. In the equivalent circuit shown in FIG. 6, the thin-film transistor 101 is placed at the intersection of a gate line 108 and a data line 109, being connected to the gate line 108 and the data line 109. Composed of a liquid-crystal resistor 102 and a liquid-crystal capacitor 103 connected to each other in parallel, a parallel circuit represents a liquid crystal sandwiched by the opposite electrode 105 and a pixel electrode driven by the thin-film transistor 101. Reference numeral 104 denotes a storage capacitor, reference numeral 110 denotes a parasitic capacitor between the data line 109 and the pixel electrode, and reference numeral 106 denotes a capacitor line. FIG. 7 is an explanatory diagram showing an equivalent circuit valid during an off-state period of the pixel on the liquid-crystal panel provided by the embodiment of the present invention. The figure is also a diagram showing the circuit of a pixel located at the intersection of the nth row and the mth column of a pixel matrix in an off-state period as well as a diagram showing a leakage current 134 of the liquid crystal and a leakage current 133 of the thin-film transistor 101 in a simple manner.

The circuit shown in FIG. 7 is put in a state in which a gate-line electric potential Vgn on the nth row is turned off. In this state, a resistor having a resistance of about $1\times10^{13}$ Ω serves as an equivalent circuit of the thin-film transistor 101. This resistor is an off-state resistor 107 of the thin-film transistor 101. Right after a transition from an on-state period to an off-state period, a liquid-crystal voltage representing image data is applied to a liquid-crystal layer sandwiched by the pixel electrode of the pixel and the opposite electrode 105. A voltage equal to the voltage appearing on the liquid crystal is applied to the storage capacitor 104. The voltages applied to the liquid-crystal layer and the storage capacitor 104 change with the lapse of time in accordance with an electric potential Vcom appearing on the opposite electrode and an electric potential Vsigm appearing on the data line.

Concrete methods of driving the liquid-crystal display device described above will be explained in detail below. There are three concrete driving methods described below.

(1) FIRST TYPICAL EXAMPLE

Figure 8:
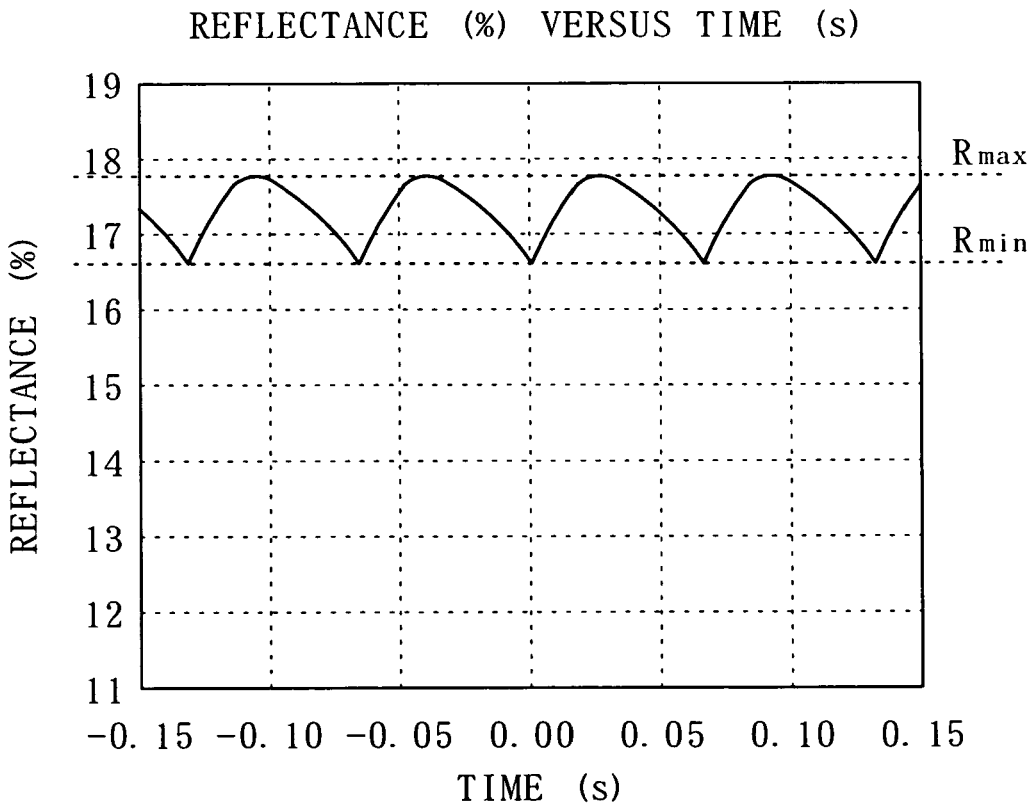
FIG. 8 shows an explanatory diagram showing changes in reflectance with the lapse of time as a diagram to be referred to in describing the definition of a flicker intensity.

In order to quantitatively represent the quantity of flickers mentioned in the following explanation of embodiments, a flicker intensity is defined. Used for explaining the definition of the flicker intensity, a diagram of FIG. 8 is an explanatory diagram showing changes in reflectance with the lapse of time. To be more specific, the figure shows changes in reflectance in driving at a frame frequency of 15 Hz for a still image display. In the diagram of FIG. 8, a horizontal axis represents the lapse of time (s) and a vertical axis represents the reflectance (%). As shown in FIG. 8, symbol Rmax denotes a maximum reflectance in 1 frame period of image data. On the other hand, symbol Rmin denotes a minimum reflectance in 1 frame period of image data. The flicker intensity ?I is defined as a quantity expressed in terms of Rmax and Rmin as follows:

$$\Delta I = \frac{R_{max} - R_{min}}{R_{max}} \times 100 \tag{6}$$

Table 1 shows frame frequencies and average values of flicker intensities. The frame frequencies and the average values of flicker intensities have been obtained as results of subjective evaluation. Each average value is an average of flicker intensities each serving as a detection threshold.

TABLE 1

| | Frame frequency | | | |
|---|---|---|---|---|
| | 45 Hz | 30 Hz | 15 Hz | 10 Hz |
| Average value of flicker intensities serving as detection thresholds | 83 | 17 | 3.5 | 2.8 |

Figure 9:
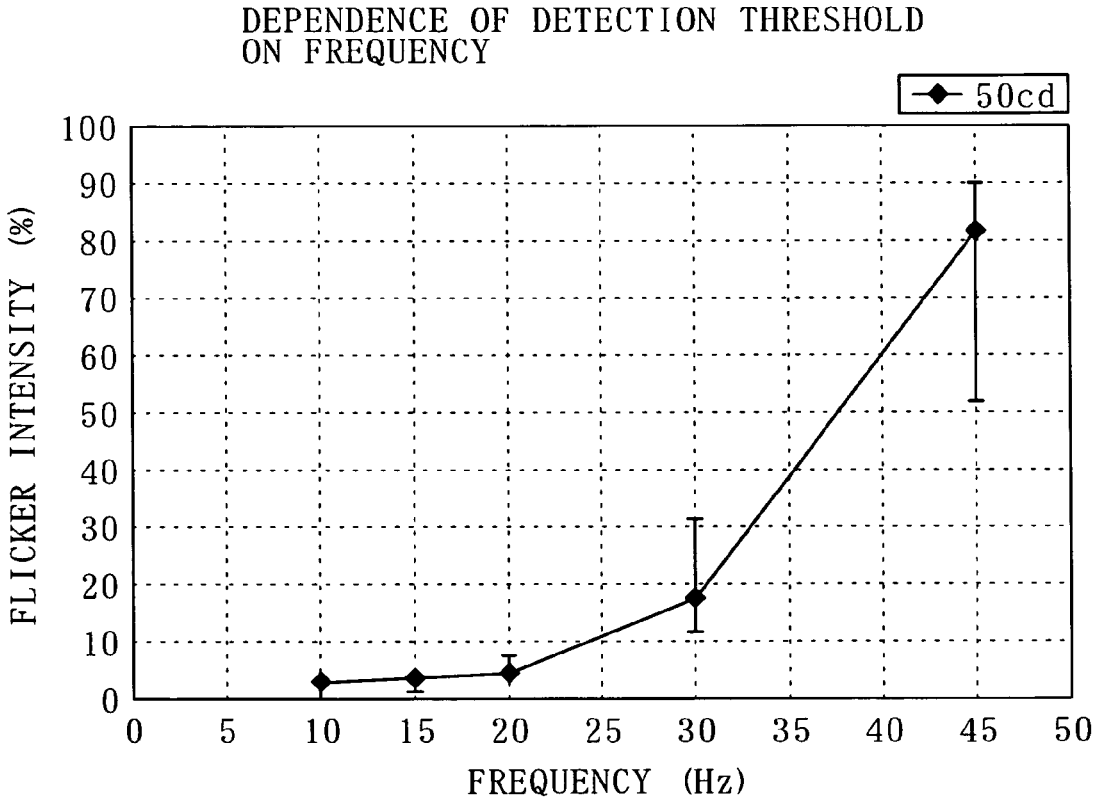
FIG. 9 is a diagram showing dependence of the flicker intensity serving as a detection threshold on the frequency.

FIG. 9 is a diagram showing dependence of the flicker intensity serving as the detection threshold on the frequency for an intensity per frame of 50 cd. In the diagram of FIG. 9, a horizontal axis represents the frequency (Hz) and a vertical frequency represents the flicker intensity (%). The subjective evaluation of the dependence was conducted on six persons of 24 to 55 years old. The flicker intensity serving as a detection threshold varies from person to person. Every black circle shown in FIG. 9 represents an average value of flicker intensities serving as detection thresholds of the 6 persons. The upper end of an error bar represented by a vertical line passing through each black circle is the upper limit of flicker intensities each serving as a detection threshold. On the other hand, the lower end of the error bar is the lower limit of flicker intensities each serving as a detection threshold. As is obvious from FIG. 9, the upper and lower limits all but coincide with each other for frame frequencies equal to or lower than 15 Hz. If changes in reflectance for a still image display on the liquid-crystal display device represent a flicker intensity at least equal to a detection threshold, the flickers are perceived (that is, noticed by the sense of sight) on the still image display of the liquid-crystal display device.

In addition, the relation between the frame frequency and the average value of flicker intensities each serving as a detection threshold indicates that the average value of flicker intensities each serving as a detection threshold is 3.5 for a frame frequency of 15 Hz and the average value of flicker intensities each serving as a detection threshold is 83 for a frame frequency of 45 Hz. Thus, the average value for a frame frequency of 15 MHz is much smaller than the average value for a frame frequency of 45 Hz. Accordingly, the lower the frame frequency, the greater the necessity to suppress reflectance changes of the pixel. However, there are more technological relative difficulties in comparison with the driving at the frame frequency of 60 Hz. In accordance with the driving method implemented by this embodiment, driving is carried out at a frame frequency lower than 60 Hz. For example, driving is carried out at frame frequencies of 30 Hz, 15 Hz and 10 Hz. In this case, the flicker intensity of a still image display on the liquid-crystal display device at each of the frame frequencies is smaller than the detection threshold for the frame frequency so that, even if the driving is carried out at a low frame frequency, it is possible to obtain a good display free of flickers.

Figure 10:
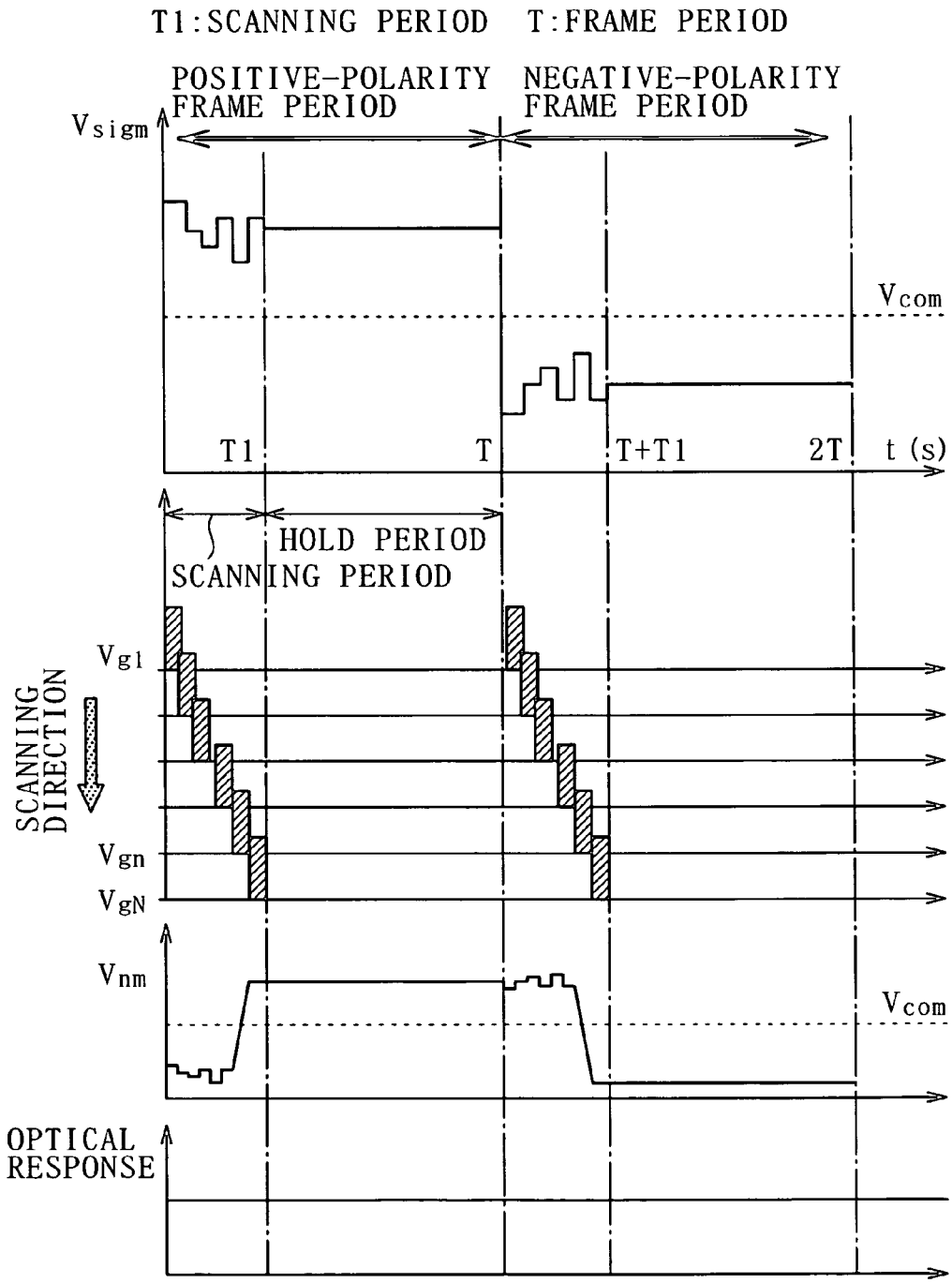
FIG. 10 shows timing charts referred to in explaining a concrete driving method adopted by the liquid-crystal display device as a method according to an embodiment of the present invention.

FIG. 10 shows timing charts used for explaining a concrete driving method adopted by a liquid-crystal display device as a method according to the embodiment of the present invention. To be more specific, the figure shows timings during consecutive positive-polarity and negative-polarity frame periods of an electric potential Vsigm appearing on a data line connected to a pixel located at the intersection of the nth row and the mth column. Moreover, the figure also shows timings of electric potentials Vgl, Vgn and VgN appearing on gate lines. The electric potential Vgl is an electric potential appearing on a first gate line. The first gate line is a gate line from which the scanning during frame periods of the liquid-crystal display device is started. A second gate line is a gate line to be scanned after the first gate line. Thereafter, the scanning is carried out from one gate line to the next gate line in this way, and the ith gate line is a gate line to be scanned in the ith scanning where subscript i is an integer in the range 1 to (N−1). The last gate line or the Nth gate line is a gate line to be scanned in the last scanning. The electric potential Vgn is an electric potential appearing on an nth gate line and the electric potential VgN is an electric potential appearing on the last gate line. In addition, the figure also shows timings of an electric potential Vnm appearing on the pixel electrode of a pixel located at the intersection of the nth row and the mth column. Furthermore, the figure also shows timings of the waveform of an optical response given by the pixel located at the intersection of the nth row and the mth column. It is to be noted that the electric potential Vcom appearing on the opposite electrode is fixed all the time.

In order to simplify the explanation, the gate line on the first row is the first gate line and the gate line on the nth row is the nth gate line in this embodiment. However, the gate line on the nth row is not necessarily the nth gate line.

In the driving method to invert the polarity in accordance with this embodiment, the number of polarity inversions per scanning period is minimized so that driving can be carried out at a low power consumption. In addition, since a data line is driven so that the voltage appearing on the liquid crystal of a pixel connected to the data line always has the same polarity during the scanning period, the changes of the voltage appearing on the liquid crystal of the pixel connected to the data line are small in comparison with those for the 1H inversion driving. Thus, since the changes of the voltage appearing on the liquid crystal of the pixel connected to the data line are small in comparison with those for the 1H inversion driving, column inversion driving, in which the voltage appearing on the liquid crystal of the pixel connected to the data line is inverted, is carried out for each column. The number of polarity inversions per scanning period for the column inversion driving is 1, which is equal to the number of polarity inversions per scanning period for frame inversion driving. However, the number of polarity inversions per scanning period for the column inversion driving is very small in comparison with the number of polarity inversions per scanning period for line inversion driving for inverting the polarity for each horizontal period. The number of polarity inversions per scanning period for the line inversion driving is N, which is the number of all gate lines. In the case of a liquid-crystal panel for the contemporary hand phone, N is at least 100. Since the column inversion driving is carried out, a difference (Vnm−Vcom) between the electric potential Vcom appearing on the opposite electrode and the electric potential Vnm appearing on the pixel electrode located at the intersection of the nth row and the mth column during the scanning period shown in FIG. 10 is positive after the on-state period of the nth gate line in a positive-polarity frame period, but negative after the on-state period of the nth gate line in a negative-polarity frame period.

In the scanning period shown in FIG. 10, gate lines are selected sequentially. In this period, the electric potential appearing on a data line changes for every horizontal period in accordance with image data of a selected pixel. Changes in data-line electric potential affect the pixel electrode connected to the data line. For this reason, changes of the electric potential Vsigm of the data line connected to the pixel located at the intersection of the nth row and the mth column affect the electric potential Vnm appearing on the pixel electrode located at the intersection of the nth row and the mth column, causing the electric potential Vnm to change even in an off-state period as shown in FIG. 10. If the scanning period is longer than 1/15 seconds, flickers are generated due to the aforementioned changes in electric potential appearing on the pixel electrode Vnm in some cases. However, effects of the changes in electric potential appearing on the pixel electrode Vnm in a specific state on the optical response are almost not observed during a short period of desirably shorter than 1/30 seconds. In the specific state, the changes in data-line electric potential affect the pixel electrode through the thin-film transistor 101 put in an off state and capacitive coupling between the data line and the pixel electrode.

Next, driving in a hold period shown in FIG. 10 is explained. In order to lower the power consumption without degrading the picture quality, it is desirable to prolong the frame period. In order to prolong the frame period, it is necessary to make the hold period longer than the scanning period during which the electric potential appearing on the data line must be changed. By considering that the current number of moving-picture frames per second is 15, let the frame frequency be set at, for example, 15 Hz. In this case, the scanning period is set at 1/60 seconds, being the same as the current frame period and the hold period is set at 3/60seconds. In this way, it is possible to reduce the power consumption while keeping a request for an operation to write image data into all pixels as it is. In this case, the length of the hold period is three times the length of the scanning period. Thus, the electric potential appearing on the pixel electrode in the hold period greatly changes due to a leakage current of the liquid crystal and an off-state leakage current of the thin-film transistor 101. As a result, the reflectance changes and the changes in reflectance are perceived as flickers in some cases. Accordingly, it is necessary to cope with the changes in electric potential appearing on the pixel electrode, which are caused by the leakage current of the liquid crystal and the off-state leakage current of the thin-film transistor.

Figure 11:
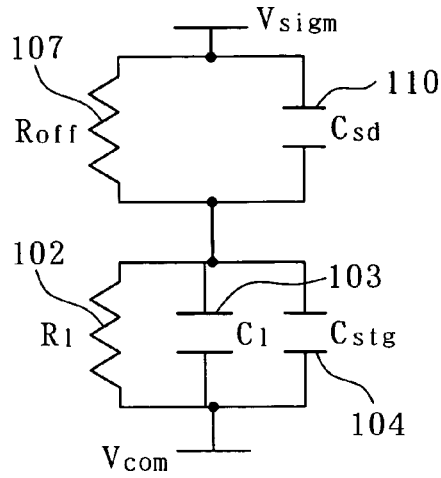
FIG. 11 is an explanatory diagram showing an equivalent circuit of a pixel located at the intersection of the nth row and the mth column in an off-state period.
Figure 12:
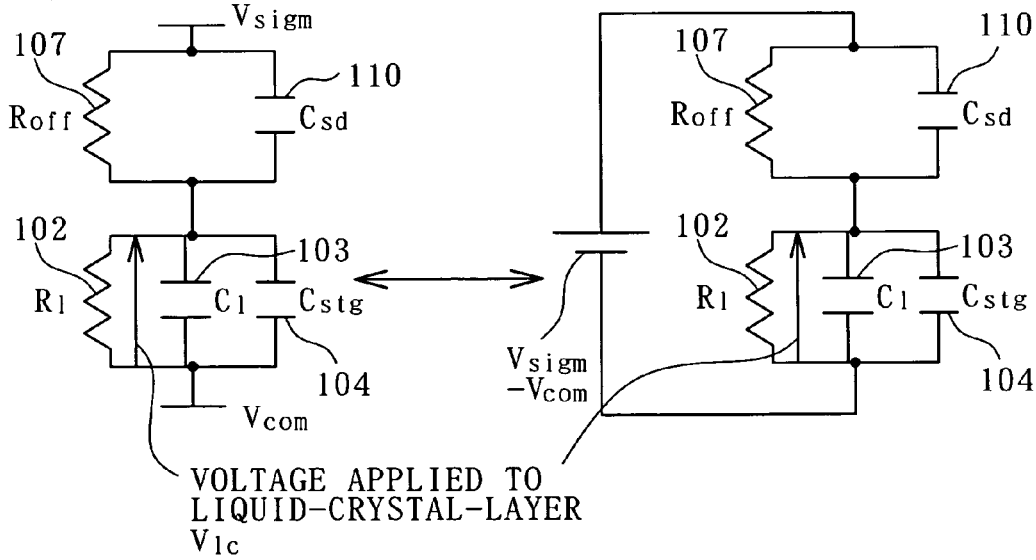
FIG. 12 is an explanatory diagram showing an equivalent circuit of a pixel located at the intersection of the nth row and the mth column for a case in which the electric potential appearing on a data line connected to the pixel does not change.
Figure 13:
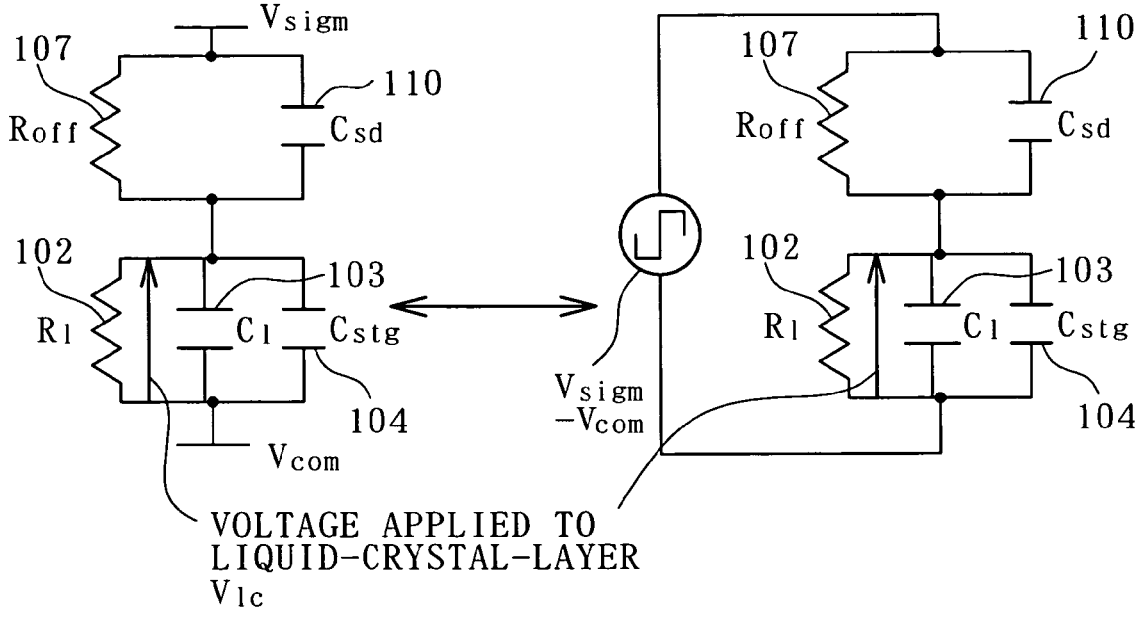
FIG. 13 is an explanatory diagram showing an equivalent circuit of a pixel located at the intersection of the nth row and the mth column for a case in which the electric potential appearing on a data line connected to the pixel changes.

By referring to FIGS. 11 to 13 showing circuits of a pixel located at the intersection of the nth row and the mth column in an off-state period, the following description explains changes of the electric potential appearing on a pixel electrode of the pixel located at the intersection of the nth row and the mth column in detail as changes caused by the leakage current of the liquid crystal and the off-state leakage current of the thin-film transistor.

FIG. 11 is an explanatory diagram showing an equivalent circuit of a pixel located at the intersection of the nth row and the mth column in an off-state period. The electric potential appearing at one terminal point of this equivalent circuit is the electric potential Vsigm appearing on a data line connected to the pixel located at the intersection of the nth row and the mth column. The electric potential appearing at the other terminal point of this equivalent circuit is the electric potential Vcom appearing at the opposite electrode.

FIG. 12 is an explanatory diagram showing an equivalent circuit of a pixel located at the intersection of the nth row and the mth column for a case in which the electric potential appearing on a data line connected to the pixel does not change. On the other hand, FIG. 13 is an explanatory diagram showing an equivalent circuit of a pixel located at the intersection of the nth row and the mth column for a case in which the electric potential appearing on a data line connected to the pixel changes.

The equivalent circuit shown in FIG. 11 includes a parallel circuit consisting of an off-state resistor Roff 107 of the thin-film transistor 101 and a parasitic capacitor Csd 110 between the data line and the pixel electrode. The resistor Roff 107 is connected in series to the data line connected to the pixel located at the intersection of the nth row and the mth column. The circuit consisting the resistor Roff 107 and the parasitic capacitor Csd 110, which are connected to each other in parallel, is connected in series to another parallel circuit. The other parallel circuit comprises a liquid crystal resistor Rl 102, a liquid crystal capacitor Cl 103 and a storage capacitor Cstg 104, which are connected to each other in parallel. The aforementioned other terminal point of this equivalent circuit is on a side of the other parallel circuit opposite to the parallel circuit consisting of the resistor Roff 107 and the parasitic capacitor Csd 110. As described above, the electric potential appearing at the other terminal point of this equivalent circuit is the electric potential Vcom appearing at the opposite electrode. A liquid-crystal voltage Vlc applied to a liquid-crystal layer sandwiched by the opposite electrode and the pixel located at the intersection of the nth row and the mth column is equal to a difference in electric potential between the two terminals of the liquid crystal capacitor Cl 103. Thus, if the difference in electric potential between the two terminals of the liquid crystal capacitor Cl 103 can be prevented from changing, the reflectance does not change too.

If the pixel is put in an off state, the equivalent circuit shown in FIG. 11 is generally equivalent to a circuit having a voltage source varying in the range of an electric potential difference (Vsigm−Vcom) as shown in FIG. 13. If the electric potential Vsigm appearing on a data line connected to the pixel located at the intersection of the nth row and the mth column is a fixed electric potential assumed to be higher than the electric potential Vcom appearing on the opposite electrode, the equivalent circuit shown in FIG. 11 is equivalent to a circuit having a dc voltage source generating a voltage equal to the electric potential difference (Vsigm−Vcom) as shown in FIG. 12. If the electric potential Vsigm appearing on the data line is lower than the electric potential Vcom appearing on the opposite electrode, on the other hand, the equivalent circuit shown in FIG. 11 is equivalent to a circuit having a dc voltage source generating a voltage equal to the negative electric potential difference (Vsigm−Vcom) as shown in FIG. 12.

As is obvious from the circuit diagrams of FIGS. 11 to 13, the liquid-crystal voltage Vlc varies in dependence on the off-state resistor Roff of the thin-film transistor 101, the liquid crystal resistor Rl, the liquid crystal capacitor Cl, the storage capacitor Cstg and the electric-potential difference (Vsigm−Vcom). Thus, even if the liquid crystal resistance of one of the components composing the circuit system described above is increased independently of other components, the liquid-crystal voltage Vlc does vary in dependence on the other components (particularly the off-state resistor Roff 107 of the thin-film transistor 101) and the electric-potential difference (Vsigm−Vcom). Thus, in order to suppress the changes in liquid-crystal voltage Vlc, it is necessary to take the entire circuit system into consideration.

The following description explains a result of an analysis of changes in liquid-crystal voltage Vlc, which accompany driving in a frame period of the pixel located at the intersection of the nth row and the mth column. First of all, an electric potential representing image data in the pixel located at the intersection of the nth row and the mth column is applied to the pixel electrode. At the same time, the pixel located at the intersection of the nth row and the mth column enters an off-state period. Right after that, the equivalent circuit shown in FIG. 11 can be used as a circuit model of the pixel. Let symbol Vlc0 denote the voltage appearing on the liquid crystal right after the on-state period. If the pixel located at the intersection of the nth row and the mth column is not connected to the last gate line, the data-line electric potential Vsigm varies to supply image data to the remaining pixels till the scanning of the all gate lines remaining even after the on-state period is completed. Thus, the equivalent circuit shown in FIG. 11 becomes equal to the equivalent circuit shown in FIG. 13. The changes in liquid-crystal voltage Vlc with the lapse of time are expressed by Eq. (7) as follows:

$$\frac{dV_{1c}}{dt} = -\frac{V_{1c}}{\tau} + \frac{V_{sigm} - V_{com}}{R_{off}(C_1 + C_{stg} + C_{sd})} + \frac{C_{sd}}{C_1 + C_{stg} + C_{sd}} \frac{d(V_{sigm} - V_{com})}{dt}, \quad \tau = \frac{R_1 \cdot R_{off}}{R_1 + R_{off}}(C_1 + C_{stg} + C_{sd}) \tag{7}$$

As is obvious from Eq. (7), in order to suppress the changes in liquid-crystal voltage Vlc with the lapse of time, it is necessary to have the first and second terms of the expression on the right-hand side of the equation cancel each other. In addition, the absolute value of the third term needs to be reduced. It is thus necessary to make the positive/negative polarity of the electric-potential difference (Vsigm−Vcom) between the data line and the opposite electrode after the on-state period the same as the polarity of the liquid-crystal voltage Vlc0 cited above. In order to reduce the absolute value of the third term on the right-hand side of the equation, it is necessary to decrease the amplitude of the electric-potential difference (Vsigm−Vcom) during the scanning period. Thus, Eq. (7) indicates that changes of the electric voltage of the liquid crystal in the pixel for the column inversion driving are smaller than changes of the electric voltage of the liquid crystal in the pixel for the line inversion driving. In the column inversion driving, throughout the entire scanning period, the data-line electric potential Vsigm is all but equal to the electric potential Vcom appearing on the opposite electrode for all tones and the maximum amplitude of the electric-potential difference (Vsigm−Vcom) is all but equal to the maximum of the absolute value of a liquid-crystal voltage used in a display. In the line inversion driving, the electric potential appearing on a data line connected to the pixel located at the intersection of the nth row and the mth column is the inverted value of the electric potential appearing on the opposite electrode for each line period.

In a scanning period, the liquid crystal electric voltage Vlc changes in accordance with Eq. (7). Thinking of the fact that the column inversion driving is carried out and the fact that the scanning period is a period shorter than 1/30 seconds, however, it is probable that there are no changes in liquid-crystal voltage Vlc, which are large enough for generating flickers in the scanning period.

Next, driving carried out in a hold period is explained. If the electric potential appearing on a data line varies arbitrarily, changes in liquid-crystal voltage Vlc with the lapse of time are expressed by Eq. (7). Thus, the polarity of the electric-potential difference (Vsigm−Vcom) for suppressing the changes in liquid-crystal voltage Vlc with the lapse of time is the same as the polarity of the liquid-crystal voltage Vlc0 right after the on-state period as described above. The electric-potential difference (Vsigm−Vcom) is a difference in electric potential between the data line and the opposite electrode during a hold period immediately following an on-state period. In addition, in order to suppress the changes in liquid-crystal voltage Vlc with the lapse of time, it is necessary to make the difference (Vsigm−Vcom) in electric potential between the data line and the opposite electrode fixed independently of time as is obvious from the third term of the expression on the right-hand side of Eq. (7). In this embodiment, since the electric potential appearing on the opposite electrode is fixed, by making the electric potential appearing on the data line constant during the hold period, it is possible to suppress the effect of the third term of the expression on the right-hand side of Eq. (7), that is, the effect exhibited by the data line as an effect caused by the capacitive coupling. Thus, the electric potential appearing on the data line needs to be made constant during the hold period.

With the electric potential appearing on the data line made constant during the hold period, the equivalent circuit shown in FIG. 12 can be used as a circuit model of the pixel located at the intersection of the nth row and the mth column. In this case, changes in liquid-crystal voltage Vlc with the lapse of time are expressed by Eq. (8) as follows:

$$\frac{dV_{1c}}{dt} = \left[\frac{R_1}{R_1 + R_{off}}(V_{sigm} - V_{com}) - V_{1cl}\right] \cdot \frac{e^{-t/\tau}}{\tau}, \quad \tau \frac{R_1 \cdot R_{off}}{R_1 + R_{off}}(C_1 + C_{stg} + C_{sd}) \tag{8}$$

Strictly speaking, symbol Vlc1 used in Eq. (8) denotes a value of the liquid-crystal voltage Vlc appearing on the liquid crystal in the pixel located at the intersection of the nth row and the mth column right after completion of the scanning period. It is probable, however, that the voltage appearing on the liquid crystal does not change greatly during the scanning period. Thus, the liquid-crystal voltage Vlc1 appearing right after completion of the scanning period is considered to be the same as the liquid-crystal voltage Vlc0 appearing during the scanning period or (Vlc1=Vlc0) in the following description.

In accordance with Eq. (8), by setting the electric potential Vsigm appearing on the data line connected to the pixel located at the intersection of the nth row and the mth column at a proper value, it is possible to completely nullify changes of the liquid-crystal voltage Vlc appearing in the pixel located at the intersection of the nth row and the mth column in the hold period. At that time, the value of the electric potential Vsigm appearing on the data line can be expressed by Eq. (9) as follows:

$$V_{sigm} = V_{com} + \left[1 + \frac{R_{off}}{R_1}\right] \times V_{1c0} \tag{9}$$

As is obvious from Eq. (9), during a hold period immediately following an on-state period, the polarity of the difference (Vsigm−Vcom) between the electric potential Vcom appearing on the opposite electrode and the data-line electric potential Vsigm completely nullifying changes of the liquid-crystal voltage Vlc appearing on the pixel located at the intersection of the nth row and the mth column in the hold period is the same as the polarity of the liquid-crystal voltage Vlc0 right after the on-state period.

The following description explains details of physical phenomena dealt with in this driving method. In accordance with the conventional driving method for reducing changes exhibited by the electric potential appearing on the pixel electrode as changes caused by a leakage current of the liquid crystal and an off-state leakage current of a thin-film transistor, assuming that there is no correlation between the leakage current of the liquid crystal and the off-state leakage current of a thin-film transistor, the leakage current of the liquid crystal and the off-state leakage current of a thin-film transistor are dealt with separately. In order to reduce the leakage current of the liquid crystal, for example, a liquid-crystal material having a higher resistivity is employed. By improving the liquid-crystal material in this way, the leakage current of the liquid crystal can be decreased.

As for a solution to the problem raised by the off-state leakage current of a thin-film transistor, there are adopted a driving method of optimizing the electric potential appearing on the gate line during the off-state period so as to maximize the off-state resistor of the thin-film transistor and a driving method of increasing the off-state resistor of the thin-film transistor by setting the electric potentials appearing on the data line and the pixel electrode at about the same level. By adoption of the methods described above, however, the problem raised by the leakage current of the liquid crystal and the problem raised by the off-state leakage current of the thin-film transistor are merely solved individually. These methods of solving the problems individually cannot be said to be a solution optimum for the system comprising the thin-film transistor and the liquid-crystal layer.

A driving method provided by the present invention is an optimum driving method of suppressing changes of the electric potential appearing on the pixel electrode by considering development of the liquid-crystal voltage with the lapse of time in a system comprising the thin-film transistor, the liquid-crystal layer and the storage capacitor. A root cause of changes in liquid-crystal voltage is changes of electric charges stored in the liquid-crystal capacitor and the storage capacitor. As shown in FIG. 12, the off-state resistor Roff 107 of the thin-film transistor 101 is connected in series to the liquid-crystal layer. Thus, if the absolute value of the off-state leakage current of the thin-film transistor 101 and the flowing direction of the off-state leakage current of the thin-film transistor 101 can be made the same as respectively the absolute value of the leakage current of the liquid-crystal and the flowing direction of the leakage current of the liquid-crystal, the amounts of electric charges stored in the liquid-crystal capacitor Cl 103 and the storage capacitor Cstg 104 can be kept constant, causing the voltage appearing on the liquid crystal to remain at a fixed level. As a matter of fact, for the pixel located at the intersection of the nth row and the mth column, if the electric potential Vsigm appearing on a data line connected to the pixel located at the intersection of the nth row and the mth column has a value expressed by Eq. (9), in accordance with the pixel circuit model shown in FIG. 12, the absolute value and direction of a current flowing through the off-state resistor Roff of the thin-film transistor 101 are the same as respectively the absolute value and direction of a current flowing through the liquid-crystal resistor Rl. Thus, the amount of electric charge stored in the liquid-crystal capacitor Cl 103 remains constant all the time.

The above description has explained the value of the electric potential appearing on a data line connected to a pixel located at the intersection of the nth row and the mth column during a hold period, in which the liquid-crystal voltage Vlc of the pixel is fixed, and a method of driving the data line for the pixel. As is obvious from Eq. (8), however, the value of the electric potential appearing on a data line connected to the pixel during a hold period, in which the liquid-crystal voltage Vlc of the pixel is fixed, is dependent on image data written into the pixel in a scanning period immediately preceding a transition to the hold period. It is thus impossible to set the voltage appearing on the liquid crystals of all pixels connected to a data line at constant levels during a hold period for holding the electric potential appearing on the data line except for the case in which the same image data is stored in all the pixels connected to the data line all the time. Considering the non-linear reflectance characteristic for the liquid-crystal voltage of the liquid-crystal panel, however, if the data line is driven to make the liquid-crystal voltage constant only for image data corresponding to a tone showing a transmittance approximately equal to half the maximum transmittance or a reflectance approximately equal to half the maximum reflectance, it is possible to suppress changes in liquid-crystal voltage for all pieces of image data and to obtain a good display characteristic free of flickers even for a hold period longer than 1/60 seconds.

The following description explains details of a reason why a liquid-crystal voltage Vlc corresponding to a tone showing a transmittance approximately equal to half the maximum transmittance or a reflectance approximately equal to half the maximum reflectance is selected as a liquid-crystal voltage Vlc subjected to driving to make the liquid crystal-voltage Vlc of the pixel constant. The description begins with an explanation of a method adopted by this embodiment to measure the dependence of the reflectance of the liquid-crystal panel on the voltage appearing on the liquid crystal. Gate lines connected to all pixels on the liquid-crystal panel or all pixels included in a reflectance measurement area are put in an on state throughout the entire measurement period. A signal having a square waveform with the center of its amplitude coinciding with the electric potential appearing on the opposite electrode is applied to the data lines. At that time, during a period in which the electric potential appearing on the data line is higher than the electric potential appearing on the pixel electrode, the difference between the electric potential appearing on the data line and the electric potential appearing on the pixel electrode is used as the positive-polarity liquid-crystal voltage of the pixel connected to the data line. Then, the dependence of the reflectance of the liquid-crystal panel on the voltage appearing on the liquid crystal is measured for the period in which the electric potential appearing on the data line is higher than the electric potential appearing on the pixel electrode. The measured dependence of the reflectance of the liquid-crystal panel on the voltage appearing on the liquid crystal is considered to be dependence of the reflectance on the voltage appearing on the liquid crystal for a positive-polarity frame period. During a period in which the electric potential appearing on the data line is lower than the electric potential appearing on the pixel electrode, the difference between the electric potential appearing on the data line and the electric potential appearing on the pixel electrode is used as the negative-polarity liquid-crystal voltage of the pixel connected to the data line. Then, the dependence of the reflectance of the liquid-crystal panel on the voltage appearing on the liquid crystal is measured for the period in which the electric potential appearing on the data line is lower than the electric potential appearing on the pixel electrode. The measured dependence of the reflectance of the liquid-crystal panel on the voltage appearing on the liquid crystal is considered to be dependence of the reflectance on the voltage appearing on the liquid crystal for a negative-polarity frame period.

Figure 14:
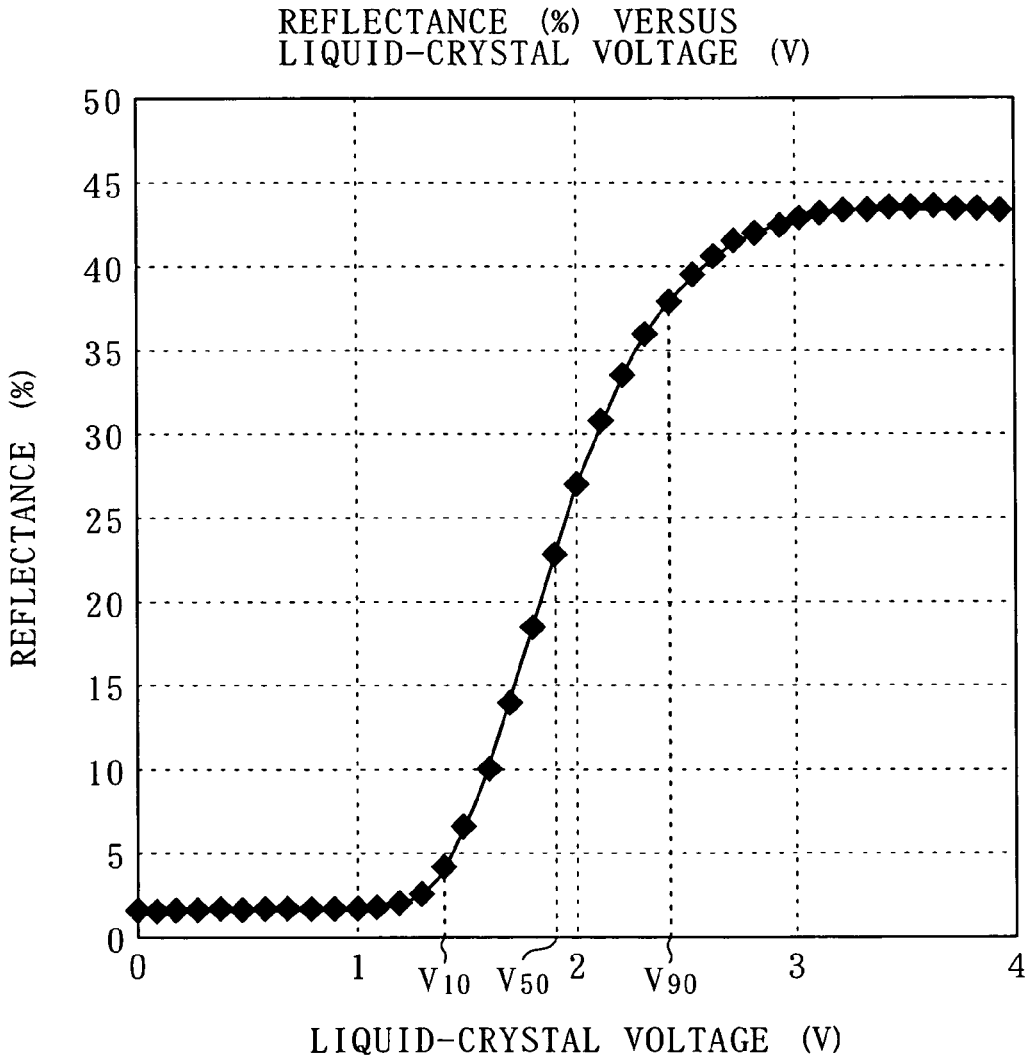
FIG. 14 is an explanatory diagram showing a graph representing the dependence of the reflectance of the liquid-crystal panel on the voltage appearing on a liquid crystal.

FIG. 14 is an explanatory diagram showing a graph representing the dependence of the reflectance of the liquid-crystal panel on the voltage appearing on the liquid crystal. The dependence is measured by adopting the method described above as dependence of the reflectance on the liquid-crystal voltage for a positive-polarity frame period. In FIG. 14, symbol V10 denotes a positive-polarity liquid-crystal voltage for a reflectance equal to about 10% of the maximum reflectance. Symbol V50 denotes a positive-polarity liquid-crystal voltage for a reflectance equal to about 50% of the maximum reflectance. Symbol Vb90 denotes a positive-polarity liquid-crystal voltage for a reflectance equal to about 90% of the maximum reflectance. Let symbol T (Vlcp) represent the reflectance as a function of positive-polarity liquid-crystal voltage Vlcp. In this case, symbol dT(Vlcp)/dVlcp represents the rate of change in reflectance with respect to the positive-polarity liquid-crystal voltage Vlcp.

As is obvious from FIG. 14, at the positive-polarity liquid-crystal voltage Vlcp equal to V10, dt(Vlcp)/dVlcp starts increasing abruptly. In the vicinity of V50, dt(Vlcp)/dVlcp approximately approaches a maximum. At V90, dt(Vlcp)/dVlcp starts decreasing abruptly. Thus, positive-polarity liquid-crystal voltages in the vicinity of V50 are positive-polarity liquid-crystal voltages at which changes in voltage most likely cause flickers. Similarly, it is possible to draw a graph representing the dependence measured by adopting the method described above as dependence of the reflectance of the liquid-crystal panel on the voltage appearing on the liquid crystal for a negative-polarity frame period. Such a graph will indicate that negative-polarity liquid-crystal voltages in the vicinity of a negative-polarity liquid-crystal voltage for a reflectance equal to about 50% of the maximum reflectance are negative-polarity liquid-crystal voltages at which changes in voltage most likely cause flickers. It is thus important to carry out most effective driving by suppressing flickers generated at tones in the vicinity of a tone showing a transmittance approximately equal to half the maximum transmittance or a reflectance approximately equal to half the maximum reflectance.

In the dependence of the reflectance on the voltage appearing on the liquid crystal in a positive-polarity frame period, a liquid-crystal voltage showing a reflectance equal to about 50% of the maximum reflectance in the positive-polarity frame period is a middle value between a liquid-crystal voltage showing a reflectance equal to about 10% of the maximum reflectance in the positive-polarity frame period and a liquid-crystal voltage showing a reflectance equal to about 90% of the maximum reflectance in the positive-polarity frame period. Similarly, in the dependence of the reflectance in a negative-polarity frame period on the voltage appearing on the liquid crystal, a liquid-crystal voltage showing a reflectance equal to about 50% of the maximum reflectance in the negative-polarity frame period is a middle value between a liquid-crystal voltage showing a reflectance equal to about 10% of the maximum reflectance in the negative-polarity frame period and a liquid-crystal voltage showing a reflectance equal to about 90% of the maximum reflectance in the negative-polarity frame period. Thus, for a pixel holding image data of a tone showing a reflectance equal to about half the maximum reflectance or a transmittance equal to about half the maximum transmittance, a data-line electric potential at which the voltage appearing on the liquid crystal of the pixel becomes constant is not much different from a data-line electric potential firmly sustaining the voltage appearing on the liquid crystal of a pixel holding image data showing a reflectance equal to about 10% of the maximum reflectance and not much different from a data-line electric potential firmly sustaining the voltage appearing on the liquid crystal of a pixel holding image data showing a reflectance equal to about 90% of the maximum reflectance. Thus, by carrying out driving to make the voltage appearing on the liquid crystal of the pixel constant for every pixel holding image data of a tone showing a reflectance equal to about half the maximum reflectance or a transmittance equal to about half the maximum transmittance, it is possible to reduce changes in liquid-crystal voltage in the hold period of all pixels on the liquid-crystal panel.

As shown in FIG. 10, the above descriptions indicate that, in a driving method to invert the polarity of a data line in a scanning period, the number of polarity inversions per scanning period is smallest, allowing driving to be carried out at a low power consumption. In addition, by carrying out column inversion driving entailing small changes of an electric potential appearing on the pixel electrode of a pixel connected to the data line in the scanning period, it is possible to give a desired electric potential to the pixel electrode of the pixel connected to the data line as a result of the driving. Next, the electric potential appearing on the data line in a hold period is fixed at a level making the voltage appearing on the liquid crystal of a pixel constant. In this case, the pixel is a pixel holding image data of a gray level. That is to say, in the case of a positive-polarity data line, an electric potential Vsp of the positive-polarity data line has a value expressed by Eq. (10) as follows:

$$V_{sp} = V_{com} + \left[1 + \frac{R_{off}}{R_1}\right] \times V_p \tag{10}$$

where symbol Vsp denotes an electric potential of a positive-polarity data line and symbol Vp denotes the absolute value of the positive-polarity liquid-crystal voltage for a reflectance equal to about 50% of the maximum reflectance of the liquid-crystal display device.

In the case of a negative-polarity data line, an electric potential Vsm of the negative-polarity data line has a value expressed by Eq. (11) as follows:

$$V_{sm} = V_{com} - \left[1 + \frac{R_{off}}{R_1}\right] \times V_m \tag{11}$$

where symbol Vsm denotes an electric potential of a negative-polarity data line and symbol Vm denotes the absolute value of the negative-polarity liquid-crystal voltage for a reflectance equal to about 50% of the maximum reflectance of the liquid-crystal display device.

The operation to set the electric potentials appearing on positive-polarity and negative-polarity data lines in a hold line as described above can be carried out for each data line or each portion of the liquid-crystal panel. Alternatively, the operation can be carried out at the same time for all data lines. By carrying out the driving described above, it is possible to obtain an optical response waveform like the one shown in FIG. 10 and obtain a high-quality display free of flickers.

Figure 15:
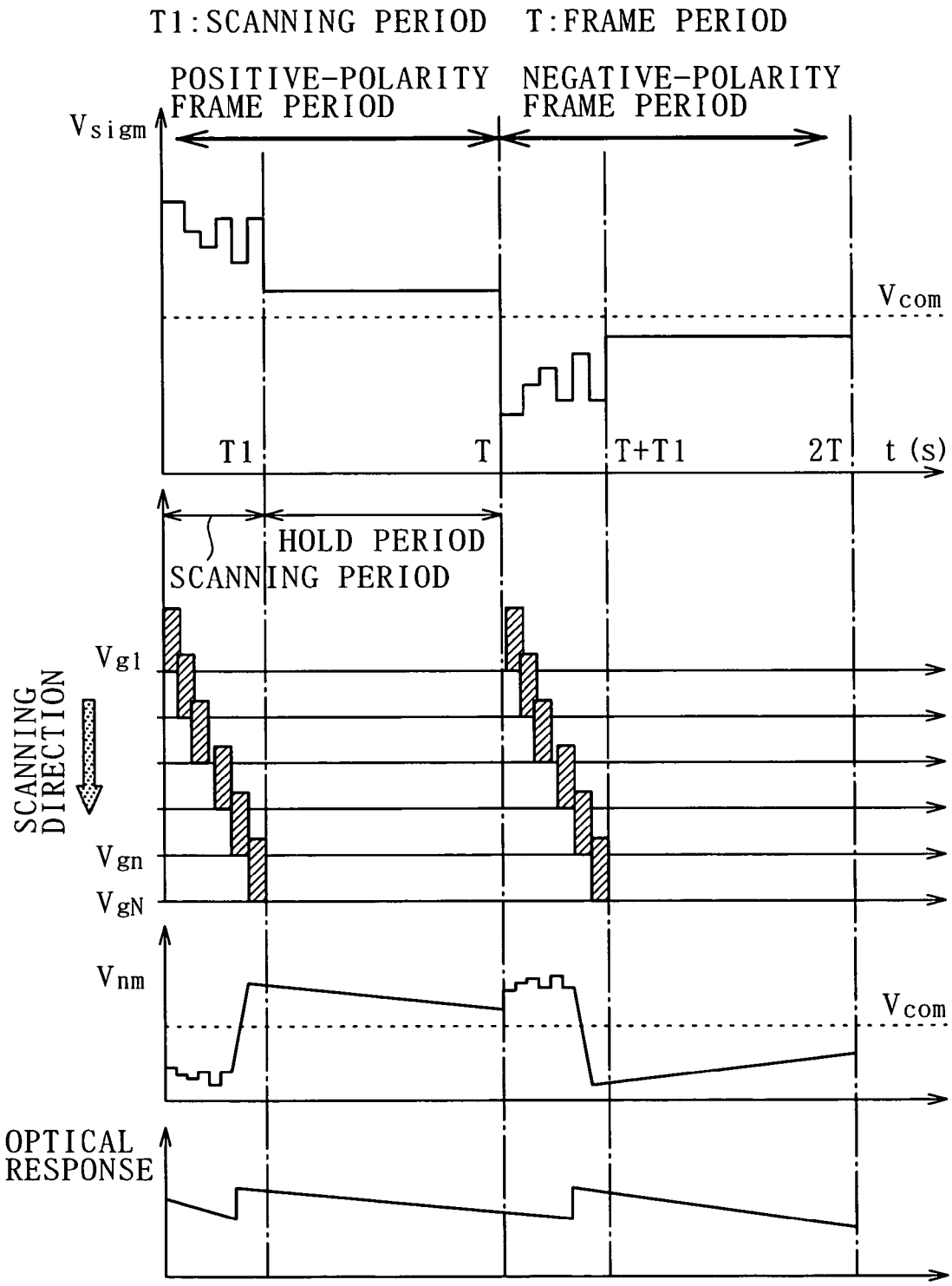
FIG. 15 shows timing charts referred to in explaining a concrete driving method adopted by the liquid-crystal display device implemented by the embodiment of the present invention.

FIG. 15 shows timing charts used for explaining a concrete driving method adopted by the liquid-crystal display device implemented by an embodiment of the present invention. To be more specific, FIG. 15 shows timings of the electric potential appearing on a pixel electrode located at the intersection of the nth row and the mth column, an optical response waveform of a pixel having the pixel electrode and a variety of driving signals, in a positive-polarity frame period and a negative-polarity frame period. By the way, in the hold period described above, if the electric potential appearing on a data line is greatly different from the optimum value Vsp or Vsm described earlier, the optical response waveform of a pixel connected to the data line exhibits changes in reflectance, which are synchronous with frame periods as shown in FIG. 15. In FIG. 15, the same symbol as any particular symbol shown in FIG. 10 represents the waveform of the same timings denoted by the particular symbol shown in FIG. 10.

The following description explains a method of setting the electric potential on a data line during a hold period in the liquid-crystal display device more concretely. Let symbol ΔV(f) denote the absolute value of an electric-potential change observed on a pixel electrode in a frame period corresponding to a frame frequency of fHz where symbol f denotes the frame frequency. Let symbol Vfst denote an electric potential appearing on the pixel electrode right after a specific on-state period for a pixel with the frame frequency f and symbol Vlst denote an electric potential appearing on the pixel electrode right before the next on-state period following the specific on-state period for the same pixel. In this case, the equation ΔV(f)=|Vfst−Vlst| holds true. If ΔV(f) exceeds a predetermined value in a still-image display, changes in reflectance show a flicker intensity at least equal to a detection threshold. Let symbol ΔVc(f) denote a critical electric-potential change quantity, which is ΔV(f) directly before the indication of the flicker intensity at least equal to a detection threshold.

In accordance with a method of determining ΔVc(f), first of all, the dependence of the reflectance of the liquid-crystal panel on the voltage appearing on the liquid crystal is measured. Then, from the flicker intensity ΔIc(f) serving as a detection threshold for the frame frequency fHz, a reflectance change ΔTc(f) corresponding to the flicker intensity ΔIc(f) is found. ΔTc(f) at the reflectance Rmax is given as follows:

$$\Delta Tc(f)=(Rmax-Rmin)=\Delta Ic(f)\times Rmax/100$$

From a result obtained from the measurement of the dependence of the reflectance of the liquid-crystal panel on the voltage appearing on the liquid crystal, a slope ΔVlc/ΔT of the reflectance with respect to the voltage appearing on the liquid crystal at the reflectance Rmax is found. From the slope ΔVlc/ΔT, the change ΔVcl(f) in liquid-crystal voltage with respect to the change ΔTc(f) in reflectance at the reflectance Rmax is found as follows:

$$\Delta Vcl(f)=(\Delta Vlc/\Delta T)\times\Delta Tc(f)$$

The method described above is a method of determining the change ΔVcl(f) in liquid-crystal voltage as a critical electric-potential change ΔVc(f).

The value of the change ΔVcl(f) in liquid-crystal voltage found from the dependence of the reflectance of the liquid-crystal panel on the voltage appearing on the liquid crystal as shown in FIG. 14 and from a reflectance of 23% is 15 mV. The reflectance of 23% is found from the flicker intensity of 3.5 serving as the detection threshold at a frame frequency of 15 Hz as shown in Table 1.

In a scanning period, the data line is almost not changed and, during an entire off-state period in a frame period, the electric potential appearing on the data line is fixed. Let symbol Vsig denote an electric potential appearing on the data line. In this case, the change in liquid-crystal voltage Vlc with the lapse of time is expressed by Eq. (12) as follows:

$$V_{1c}(t) = \frac{R_1}{R_1 + R_{off}}(V_{sig} - V_{com})(1 - e^{-t/\tau}) + e^{-t/\tau}(V_{fst} - V_{com}) \quad (12)$$

$$\tau = \frac{R_1 \cdot R_{off}}{R_1 + R_{off}}(C_1 + C_{stg} + C_{sd})$$

In this case, the equations Vlst=Vcom+Vlc (t=1/f) and ΔV(f)=|vfst−Vcom−Vlc (t=1/f)| hold true.

An optimum electric potential Vopt for sustaining the voltage Vfst appearing on the pixel electrode as it is in an off-state period is defined by Eq. (13) for the explanation given below as follows:

$$V_{opt} = V_{com} + \left(1 + \frac{R_{off}}{R_1}\right)(V_{fst} - V_{com}) \quad (13)$$

If driving is carried out so as to satisfy the following condition:

$$\Delta Vc(f) \geqq \Delta V(f) = |Vfst - Vcom - Vlc\ (t=1/f)|,$$

at a frame frequency f, flickers synchronous with frame periods are unnoticeable by the sense of sight.

For an electric potential Vsig appearing on the data line as an electric potential at least equal to the optimum electric potential Vopt, the range of the data-line electric potential Vsig for which flickers are unnoticeable by the sense of sight is expressed by Eq. (14) as follows:

$$V_{opt} \leq V_{sig} \leq V_{opt} + \left[1 + \frac{R_{off}}{R_1}\right]\frac{\Delta V_c(f)}{1 - e^{\frac{-f}{f \cdot \tau}}} \quad (14)$$

$$\tau = \frac{R_1 \cdot R_{off}}{R_1 + R_{off}}(C_1 + C_{stg} + C_{sd})$$

In the case of the electric potential Vsig appearing on the data line as an electric potential lower than the optimum electric potential Vopt, on the other hand, the range of the data-line electric potential Vsig for which flickers are unnoticeable by the sense of sight is expressed by Eq. (15) as follows:

$$V_{opt} - \left[1 + \frac{R_{off}}{R_1}\right]\frac{\Delta V_c(f)}{1 - e^{\frac{-f}{f \cdot \tau}}} \leq V_{sig} \leq V_{opt} \quad (15)$$

$$\tau = \frac{R_1 \cdot R_{off}}{R_1 + R_{off}}(C_1 + C_{stg} + C_{sd})$$

Consider both the ranges of the data-line electric potential Vsig. If the electric potential appearing on the pixel electrode of a pixel on a liquid-crystal panel driven at a frame frequency in an off-state period right after an on-state period of a frame period is Vfst, the range of the electric potential Vsig appearing on the data line in the off-state period right after the on-state period can be set in accordance with Eq. (16) below so that the changes in reflectance on a still-image display of the pixel represent a flicker intensity not exceeding a detection threshold and are thus unnoticeable by the sense of sight.

$$V_{opt} - \left[1 + \frac{R_{off}}{R_1}\right]\frac{\Delta V_c(f)}{1 - e^{\frac{-1}{f \cdot \tau}}} \leq V_{sig} \leq V_{opt} + \left[1 + \frac{R_{off}}{R_1}\right]\frac{\Delta V_c(f)}{1 - e^{\frac{-1}{f \cdot \tau}}} \quad (16)$$

$$\tau = \frac{R_1 \cdot R_{off}}{R_1 + R_{off}}(C_1 + C_{stg} + C_{sd})$$

In finding the range expressed by Eq. (16), it is assumed that the data line is almost not changed during a scanning period and, during an entire off-state period in a frame period, the electric potential appearing on the data line is fixed. In the scanning period, however, the electric potential appearing on the data line has an arbitrary value and, in order to accurately examine the range of values, which the electric potential appearing on the data line can have, it is necessary to carry out a simulation. If the scanning period is shorter than about 1/30 seconds, however, it is probable that there are no large changes in electric potential appearing on the pixel electrode in the scanning period. Thus, by setting the electric potential appearing on the data line during the hold period at a value in the range expressed by Eq. (16), reflection changes of a pixel holding image data, for which the electric potential appearing on the pixel electrode right after the on-state period is Vfst, exhibit a flicker intensity not exceeding the detection threshold.

The range of data-line electric potentials, for which changes in reflection exhibit a flicker intensity not exceeding the detection threshold, is dependent on the image data. If the non-linear characteristic of the reflectance with respect to the voltage appearing on the liquid crystal is taken into consideration, however, by taking the value of the electric potential Vfst and the value of the critical electric-potential change ΔVc (f) as values corresponding to a gray level in determination of the range of values and by using Eq. (16), the liquid-crystal display device can be made capable of outputting a good display free of flickers. As described before, the electric potential Vfst is an electric voltage appearing on the pixel electrode right after the on-state period and the critical electric-potential change ΔVc (f) is a change corresponding to the electric potential Vfst. The determined range of values includes values, which the electric potential appearing on the data line in the on-state period should have. Note that it is desirable to set the electric potential appearing on the data line in the hold period at the optimum electric potential Vsp or Vsm described earlier in dependence on whether the data line is a positive-polarity data line or a negative-polarity data line respectively.

In addition, in the liquid-crystal panel, it is difficult to directly measure and determine the pixel-electrode electric potential Vfst appearing right after the on-state period as an electric potential corresponding to the gray level. From a measurement provided by the method of measuring the dependence of the reflectance of the liquid-crystal panel on the voltage appearing on the liquid crystal, however, it is possible to determine the pixel-electrode electric potential Vfst appearing right after the on-state period. If the flicker intensity at a still-image display time of a liquid-crystal display device driven at a driving frequency lower than 60 Hz does not exceed the detection threshold, in a frame period, the electric potential appearing on the pixel electrode does not change as much as the tone varies. Thus, the method of measuring the dependence of the reflectance of the liquid-crystal panel on the voltage appearing on the liquid crystal can be executed to find dependence of the reflectance of the liquid-crystal panel on the voltage appearing on the liquid crystal. The dependence of the reflectance of the liquid-crystal panel on the voltage appearing on the liquid crystal can also be obtained from actual driving. The dependence obtained as a result of the measurement method is about the same as the dependence obtained from the actual driving. Thus, the value of the pixel-electrode electric potential Vfst appearing right after the on-state period as an electric potential corresponding to the gray level is Vcom+Vp for a pixel connected to a positive-polarity data line or Vcom−Vm for a pixel connected to a negative-polarity data line. In this case, symbol Vp denotes the absolute value of the positive-polarity liquid-crystal voltage at a reflectance equal to about 50% of the maximum reflectance of the liquid-crystal panel in the dependence characteristic obtained as a result of the measurement method as the dependence of the reflectance of the liquid-crystal panel on the voltage appearing on the liquid crystal. On the other hand, symbol Vm denotes the absolute value of the negative-polarity liquid-crystal voltage at a reflectance equal to about 50% of the maximum reflectance of the liquid-crystal panel in the dependence characteristic obtained as a result of the measurement method as the dependence of the reflectance of the liquid-crystal panel on the voltage appearing on the liquid crystal.

The following description explains typical concrete numbers for the range of values, which the electric potential appearing on a positive-polarity data line in a hold period should have. As shown in FIG. 14, the positive-polarity liquid-crystal voltage at a reflectance equal to 100% of the maximum reflectance is 3.2 V, V10 is about 1.4 V, V50 is about 1.9 V and V90 is about 2.4 V. Design parameters are given as follows: The electric potential appearing on the opposite electrode is 3.2 V. The off-state resistance of the thin-film transistor is $1\times10^{13}$ Ω. The liquid-crystal resistivity is $1\times10^{11}$ Ωm. The number of pixels per inch on the liquid-crystal panel is 200. The area of the pixel electrode is 4,636 $\mu m^2$. The thickness of the liquid-crystal layer is 5 μm. The total capacitance of a pixel is 0.38 pF for a liquid-crystal voltage of 1.4 V, 0.41 pF for a liquid-crystal voltage of 1.9 V and 0.42 pF for a liquid-crystal voltage of 2.4 V. In the case of these numerical values, a further explanation is given for a frame frequency of 15 Hz.

Symbol ΔVc(f=15) denotes ΔVc found from the curve shown in FIG. 14 to represent the dependence of the reflectance on the voltage appearing on the liquid crystal and from a flicker intensity for a frame frequency of 15 Hz. The value of ΔVc (f=15) is about 27 mV for a liquid-crystal voltage of 1.4 V, about 56 mV for a liquid-crystal voltage of 2.4 V and about 15 mV for a liquid-crystal voltage of 1.9 V. At that time, for a pixel connected to a positive-polarity data line, the value of the pixel-electrode electric potential Vfst appearing right after the on-state period is (Vcom+1.4) for a positive-polarity liquid-crystal voltage of 1.4 V, (Vcom+1.9) for a positive-polarity liquid-crystal voltage of 1.9 V or (Vcom+2.4) for a positive-polarity liquid-crystal voltage of 2.4 V. Table 2 shows ranges of values that the electric potential Vsig appearing on the positive-polarity data line in an off-state period right after an on-state period should have under such conditions. The unit of numbers shown in the table is the volt.

TABLE 2

| $V_{lc}$ | Range |
|---|---|
| 1.4 | $3.19 < V_{sig} < 6.27$ |
| 1.9 | $4.36 < V_{sig} < 6.20$ |
| 2.4 | $2.25 < V_{sig} < 9.40$ |

As is obvious from Table 2, the range of values that the electric potential Vsig appearing on the positive-polarity data line should have for a liquid-crystal voltage of 1.9 V is narrower than each of the ranges of values that the electric potential Vsig appearing on the positive-polarity data line should have for liquid-crystal voltages of 1.4 V and 2.4 V. As a matter of fact, the range of values that the electric potential Vsig appearing on the positive-polarity data line should have for a liquid-crystal voltage of 1.9 V is included in each of the ranges of values that the electric potential Vsig appearing on the positive-polarity data line should have for liquid-crystal voltages of 1.4 V and 2.4 V. This is because the values of ΔVc(f=15) for the liquid-crystal voltage V50 are smaller than those for other tones. The values of ΔVc (f=15) for the liquid-crystal voltage V50 are the changes in critical electric potential for a tone showing a transmittance equal to about 50% of the maximum transmittance or a remittance equal to about 50% of the maximum remittance.

While the above description has explained concrete numbers of the ranges of values that the electric potential Vsig appearing on the positive-polarity data line should have in a hold period, ranges of values that the electric potential Vsig appearing on the negative-polarity data line should have in a hold period can be found in the same way.

The off-state resistance Roff [Ω] used in Eqs. (10) and (11) as the off-state resistance of the thin-film transistor is dependent on the design of the thin-film transistor but can be set at a value in a range to a certain degree. The following description explains details of a method to determine the value of the off-state resistance Roff of a thin-film transistor. If driving a liquid-crystal display device at a low power consumption and proof pressure of a driver for generating an electric voltage on a data line is taken into consideration, it is desirable to generate an electric voltage not higher than an upper level of about 10 V on the data line. The upper limit is dependent on the material of the liquid crystal or varies from material to material. However, the following description applies to any material of the liquid crystal. That is to say, a setting method described below is applicable to any material of the liquid crystal or holds true as it is even if the material of the liquid crystal is changed.

Table 3 shows the absolute value of each optimum liquid-crystal voltage, which is defined as a difference between the electric voltage appearing on the opposite electrode and the optimum electric voltage appearing on the data line in a hold period as expressed by Eqs. (10) and (11) for Vp=Vm=1.9. The unit of the absolute value |Vsig−Vcom| of the optimum voltage appearing on the liquid crystal is the volt.

TABLE 3

| $R_{off}/R_l$ | 0.1 | 0.5 | 1 | 1.5 | 2 | 2.5 |
|---|---|---|---|---|---|---|
| $\lvert V_{sig} - V_{com} \rvert$ | 2.09 | 2.85 | 3.8 | 4.75 | 5.7 | 6.65 |

In this case, if the upper limit of the electric voltage appearing on the data line is set at 10 V, the positive-polarity maximum and negative-polarity minimum of the voltage appearing on the liquid crystal are +5 V and −5 V respectively. Thus, in a liquid-crystal display device for which the upper limit of the electric voltage appearing on the data line can be assumed to be 10 V, the absolute value |Vsig−Vcom| of the usable optimum liquid crystal voltage is 5 V or smaller.

If hold characteristics of voltages for tones other than the tone showing a transmittance equal to about half the maximum transmittance or a reflectance equal to about half the maximum reflectance are taken into consideration, the off-state resistance Roff of the thin-film transistor had better be set at a large value. Thus, if the upper limit of the electric voltage appearing on the data line is 10 V and the absolute value of the liquid-crystal voltage of the tone showing a transmittance equal to about half the maximum transmittance or a reflectance equal to about half the maximum reflectance is 1.9 V, it is desirable to set the off-state resistance Roff of the thin-film transistor at a value 0.1, 0.5, 1.0 or 1.5 times the liquid-crystal resistance Rl.

The following description explains a control method executed in carrying out the driving in the first embodiment. A vertical synchronization signal Vsyn is a pulse generated for every frame period. A gate-driving signal φg generates a pulse with a width equal to or shorter than a gate selection period and starts generation of pulses with a start point coinciding with the vertical synchronization signal Vsyn.

Figure 16:
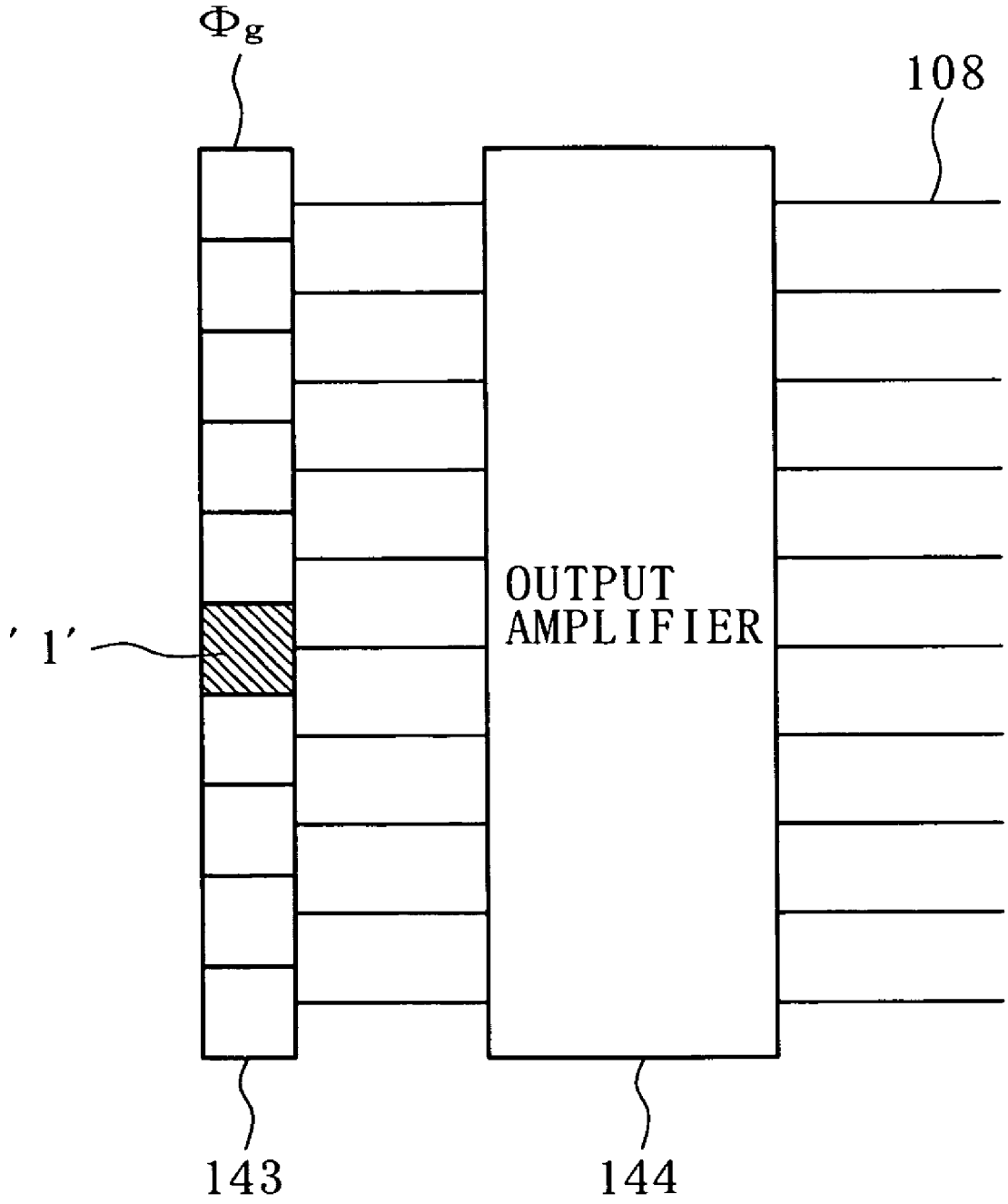
FIG. 16 is an explanatory diagram referred to in describing a method of controlling gate lines in the liquid-crystal display device implemented by the embodiment of the present invention.

FIG. 16 is an explanatory diagram used for describing a method of controlling gate lines in the liquid-crystal display device implemented by the embodiment of the present invention. To be more specific, FIG. 16 is a block diagram showing the configuration of a gate driver 126 shown in FIG. 1 as the gate-line-driving circuit. A shift register 143 shown in FIG. 16 is used for storing '0'or '1' information as a Boolean value or an electric potential corresponding to the '0' or '1' information. In a scanning period, the '1' information is stored in only one register of the shift register 143 and shifted to the next register every time a pulse of the gate-driving signal φg is supplied to the shift register 143. In the case of a liquid-crystal panel having N gate lines on N rows, the number of registers in the shift register 143 is also N. The N gate lines connect the registers in the shift register 143 to an output amplifier 144. The N gate lines connected to the output amplifier 144 are associated with the registers in the shift register 143 on a one-to-one basis. When the '1' information is stored in a register, the electric potential appearing on the gate line associated with the register is put in an on state. When '0' information is stored in a register, on the other hand, the electric potential appearing on the gate line associated with the register is put in an off state.

Figure 17:
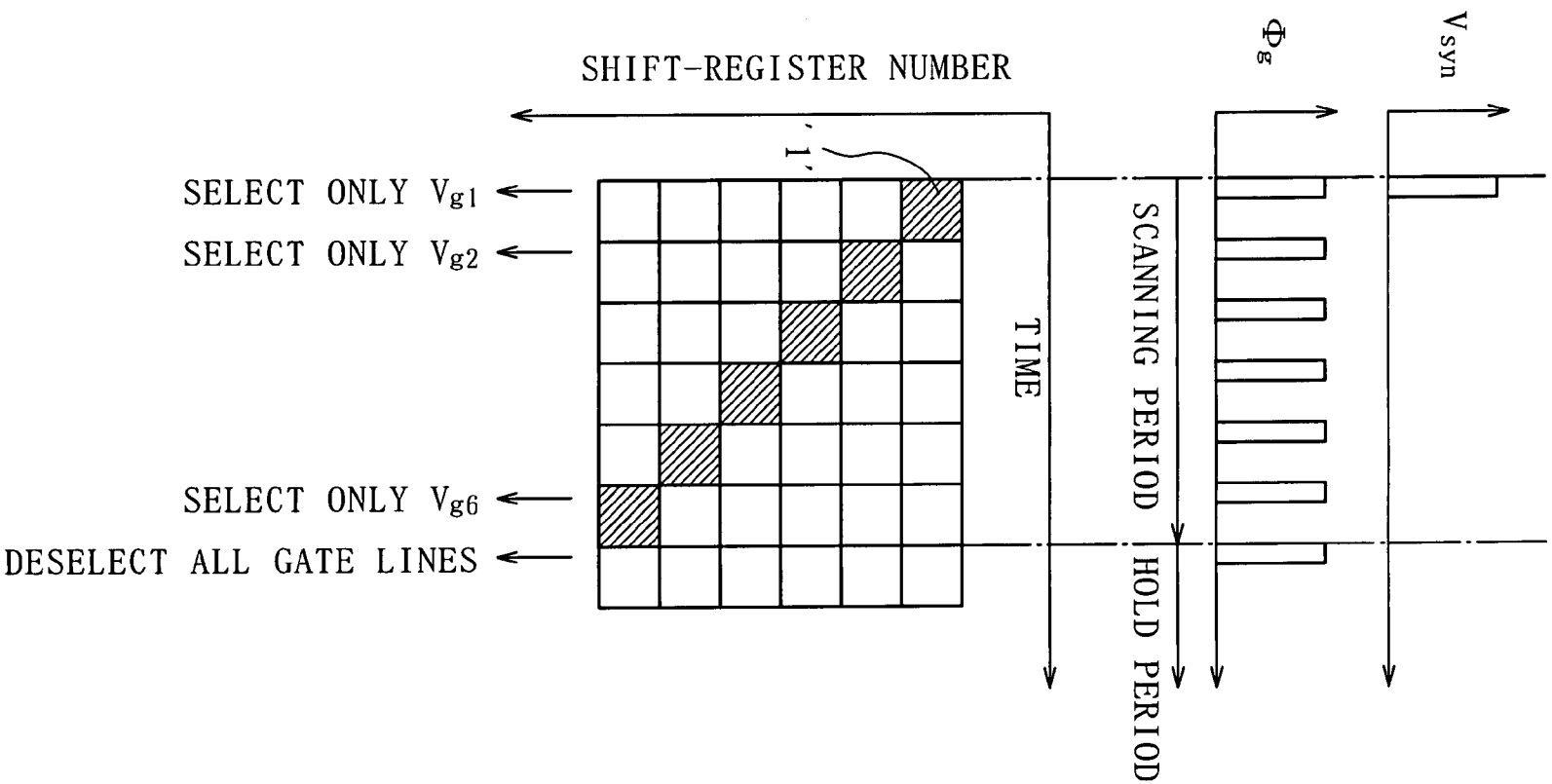
FIG. 17 is an explanatory diagram referred to in describing a control method of driving the liquid-crystal display device implemented by an embodiment of the present invention.

FIG. 17 is a diagram showing a relation between pulses of the gate-driving signal φg and the registers for storing '1' information in the shift register 143. FIG. 17 is an explanatory diagram used for describing a control method of driving a liquid-crystal display device implemented by the embodiment of the present invention. As an example, the figure shows a case in which the liquid-crystal panel has 6 gate lines. A pulse of the gate-driving signal φg is supplied in every on-state period. Every time a pulse of the gate-driving signal φg is supplied to the shift register 143, the '1' information is shifted to a register associated with a gate line, which is then put in an on state, in a scanning operation. The '1' information is shifted through the registers in the shift register 143 and, as the seventh pulse of the gate-driving signal φg counted from the beginning of a frame is supplied to the shift register 143, the '1' information is shifted out from the shift register 143. After the '1' information is shifted out from the shift register 143, all the gate lines are put in an off state and a hold period is started.

Generation of pulses of the gate-driving signal φg is started with a start point coinciding with the vertical synchronization signal Vsyn. The '1' information is stored in a register associated with the first gate line, a scanning operation is started and a hold period is ended. The typical configuration described above can be extended with ease to a configuration including N gate lines. As the N gate lines have been scanned, the (N+1)th pulse of the gate-driving signal φg counted from the beginning of a frame is supplied to the shift register 143, the '1' information is shifted out from the shift register 143, the '1' information disappears and a hold period is started. Then, generation of pulses of the gate-driving signal φg is started with the next vertical synchronization signal Vsyn used as a start point, '1' information is stored in a register associated with the first gate line and a scanning operation is started.

A source-driving signal φs starts generation of pulses with a start point coinciding with the vertical synchronization signal Vsyn. A pulse of the source-driving signal φs drives the timing controller 129 shown in FIG. 1 to start a transfer of image data of an amount corresponding to pixels on a line to the source driver 125. In this embodiment, the number of pixels on a line is M. In a scanning period, the source driver 125 outputs an electric potential corresponding to tone data. After the scanning period is completed, the following two typical operations are carried out as a method of applying a data-line electric potential to a data line in a hold period.

Figure 18:
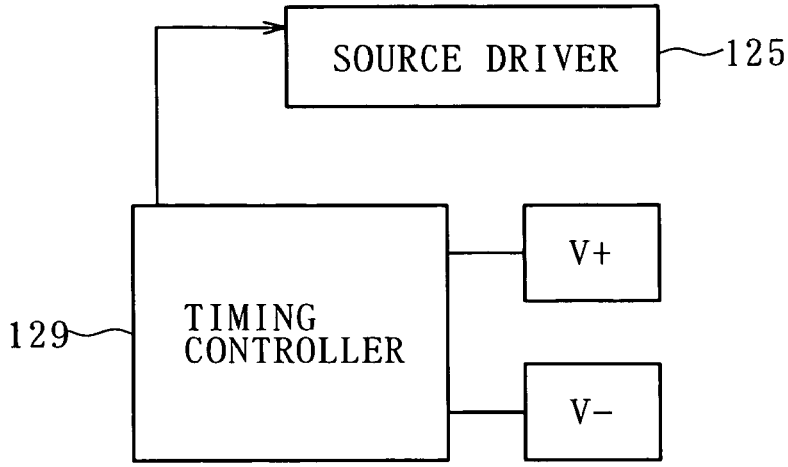
FIG. 18 is an explanatory diagram referred to in describing a control method of driving the liquid-crystal display device implemented by the embodiment of the present invention in a hold period.

First of all, a first operation is explained by referring to FIG. 18. FIG. 18 is an explanatory diagram used for describing a control method of driving of the liquid-crystal display device implemented by the embodiment of the present invention in a hold period. Symbols "V+" and "V−" shown in FIG. 18 denote memories each used for storing data corresponding to an electric potential in a hold period of the positive-polarity and negative-polarity data lines respectively. After the timing controller 129 transfers image data of a pixel connected to the last gate line to the source driver 125, the timing controller 129 references the memories "V+" and "V−" to create data corresponding to electric potentials of all data lines in a hold period so as to apply an electric potential representing the data stored in the memory "V+" to a positive-polarity data line and an electric potential representing the data stored in the memory "V−" to a negative-polarity data line. The electric potentials are applied to the data lines on the basis of the source-driving signal φs. Then, right after that, the source-driving signal φs is halted and the source driver 125 stops operations of circuits except an output amplifier applying the electric potentials to the data lines.

Figure 19:
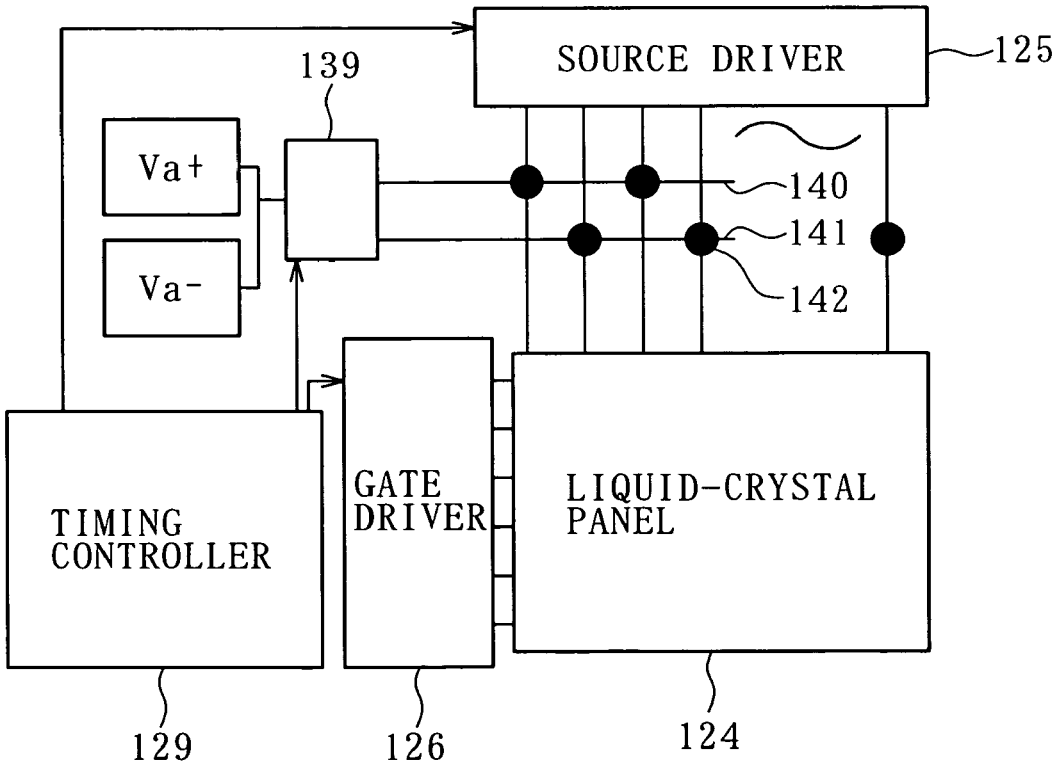
FIG. 19 is an explanatory diagram referred to in describing a control method of driving the liquid-crystal display device implemented by the embodiment of the present invention in a hold period.

FIG. 19 is an explanatory diagram used for describing a control method of driving the liquid-crystal display device implemented by the embodiment of the present invention in a hold period. Symbols "Va+" and "Va−" shown in FIG. 19 denote voltage sources for generating electric potentials on positive-polarity and negative-polarity data lines respectively in a hold period. A hold-period electric-potential control circuit 139 is connected to the voltage sources "Va+" and "Va−". Line A 140 and line B 141 are connected to data lines of respectively an odd-numbered column and an even-numbered column of the liquid-crystal panel 124 through a selection switch 142.

In a scanning period, the selection switch 142 disconnects the line A 140 and line B 141 from the data lines of the liquid-crystal panel 124. Right after the scanning of all gate lines has been finished, a signal informing a transition from a scanning period to a hold period is transmitted from the timing controller 129 or the gate driver 126 to the source driver 125, the selection switch 142 and the hold-period electric-potential control circuit 139. The signal causes the source driver 125 to stop the driving and the selection switch 142 to connect the line A 140 and line B 141 to the data line of the liquid-crystal panel 124 and the hold-period electric-potential control circuit 139 to start control. The hold-period electric-potential control circuit 139 uses the voltage sources "Va+" and "Va−" to generate an electric potential for a hold period of positive-polarity and negative-polarity data signals respectively. If a data line connected to the line A 140 is a positive-polarity data line, an electric potential for a hold period of a positive-polarity data signal is supplied to the line A 140 and an electric potential for a hold period of a negative-polarity data signal is supplied to the line B 141.

If a data line connected to the line A 140 is a negative-polarity data line, on the other hand, an electric potential for a hold period of a negative-polarity data signal is supplied to the line A 140 and an electric potential for a hold period of a positive-polarity data signal is supplied to the line B 141. When a signal reporting a transition from a hold period to a scanning period is received, the line A 140 and line B 141 are again disconnected from the data lines by the selection switch 142, stopping the operation carried out by the hold-period electric-potential control circuit 139.

(2) SECOND TYPICAL EXAMPLE

Figure 20:
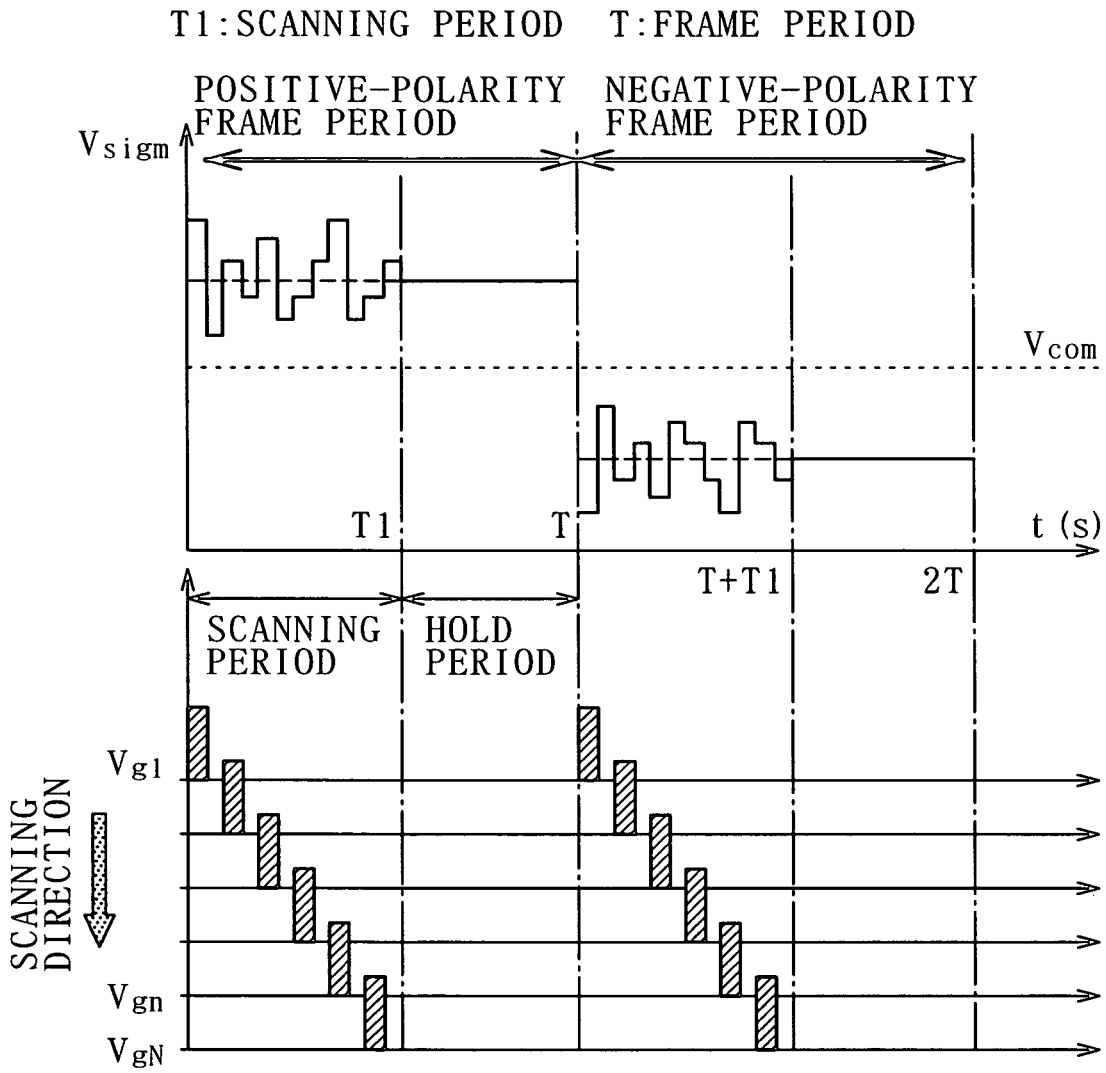
FIG. 20 shows timing charts referred to in explaining another concrete driving method of the liquid-crystal display device implemented by the embodiment of the present invention.

As a second example implementing the embodiment of the present invention, a driving method is explained by referring to FIG. 20. FIG. 20 shows timing charts used for explaining another concrete driving method of the liquid-crystal display device implemented by the embodiment of the present invention. To be more specific, the figure shows timings during consecutive positive-polarity and negative-polarity frame periods of an electric potential Vsigm appearing on a data line connected to a pixel located at the intersection of the nth row and the mth column. Moreover, the figure also shows timings of electric potentials Vgl, Vgn and VgN appearing on gate lines. As described before, the electric potential Vgl is an electric potential appearing on a first gate line, the electric potential Vgn is an electric potential appearing on an nth gate line and the electric potential VgN is an electric potential appearing on the Nth gate line serving as the last gate line. The electric potential Vcom appearing on the opposite electrode is fixed independently of time.

Like the first typical example described above, a frame period is divided into a scanning period and a hold period. Each data line is driven in such a way that the frame period is switched repeatedly in an alternating manner from a positive-polarity frame period to a negative-polarity frame period and vice versa. The data lines forming the columns of the matrix are arranged repeatedly in an alternating manner as positive-polarity and negative-polarity data lines. The driving method according to the second typical example during a hold period is exactly the same as the driving method according to the first typical example during a hold period. That is to say, positive-polarity and negative-polarity data lines are driven to electric potentials optimum for the positive-polarity and negative-polarity data lines during a hold period. The value of an electric potential applied to a data line during a hold period is determined in accordance with the first typical example. In accordance with the first typical example, the electric potentials applied to positive-polarity and negative-polarity data lines during a hold period are Vsp and Vsm respectively as described earlier.

For the driving method during a scanning period, pay attention to a pixel located at the intersection of the nth row and the mth column. In order to write an electric potential representing image data into the pixel electrode of the pixel located at the intersection of the nth row and the mth column, the nth gate line is selected and the data line connected to the pixel is set to an electric potential representing the image data. Right after that, all the gate lines are put in an off state. If the data line is a positive-polarity data line, the data line is set at an electric potential symmetrical with respect to an electric potential appearing on the data line during an on-state period immediately preceding a period in which all the gate lines are put in the off state. The electric potentials are symmetrical with an electric potential in the vicinity of Vsp taken as the center of symmetry. If the data line is a negative-polarity data line, on the other hand, the data line is set at an electric potential symmetrical with respect to an electric potential appearing on the data line during an on-state period immediately preceding the period in which all the gate lines are put in the off state. In this case, the electric potentials are symmetrical with an electric potential in the vicinity of Vsm taken as the center of symmetry.

While the on-state period and the period in which all the gate lines are put in the off state are being repeated as described above, pieces of desired image data are written into all pixels in a scanning period. At that time, while the length of the period in which all the gate lines are put in the off state is not prescribed in particular, it is desirable to set the length at a value equal to about the length of an on-state period. By carrying out such driving, effectively, an electric potential optimum for the hold period of a positive-polarity data line can be applied to a pixel connected to the positive-polarity data line as a pixel put in an off state. On the other hand, an electric potential optimum for the hold period of a negative-polarity data line can be effectively applied to a pixel connected to the negative-polarity data line as a pixel put in an off state.

The following description explains a typical control method adopted in carrying out driving in accordance with the second typical example. In a liquid-crystal panel comprising gate lines arranged to form N rows of a matrix of the panel, a gate-driving signal $\phi g$ generates pulses each having a duration equal to or shorter than a on-state period of a gate, starting generation of the pulses with the next vertical synchronization signal Vsyn used as a start point.

Figure 21A:
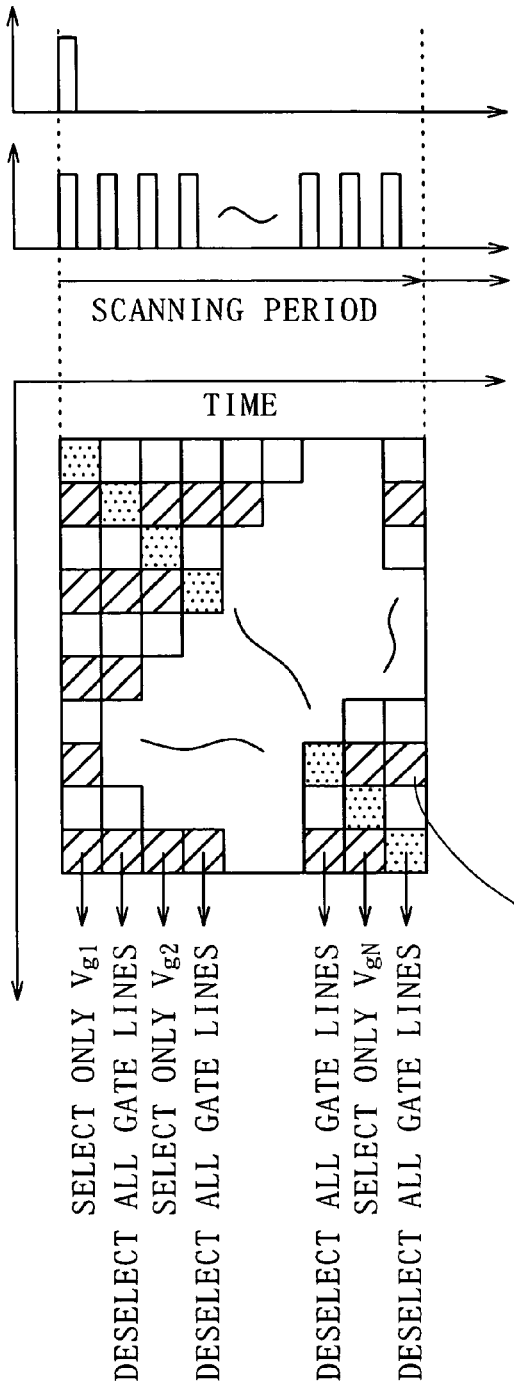
FIGS. 21A and 21B are explanatory diagrams referred to in describing a control method for driving the liquid-crystal display device provided by the present invention.
Figure 21B:
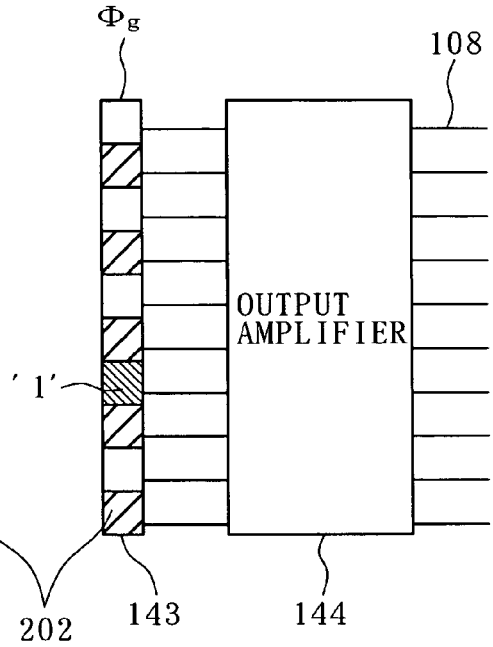

Typical control of a gate line is explained by referring to FIGS. 21A and 21B. FIGS. 21A and 21B are explanatory diagrams used in describing a control method for driving the liquid-crystal display device according to the present invention. FIG. 21A shows timing charts and FIG. 21B is a diagram showing the configuration of the gate driver 126. A spare register 202 in the shift register 143 is defined as a 'don't-care' register. That is to say, all gate lines are put in an off state without regard to whether the information stored in the spare register 202 is '0'or '1'. That is to say, a spare register 202 is not connected to the output amplifier 144 or, even if a spare register 202 is connected to the output amplifier 144, there is no gate line connected to the spare register 202 as a gate line, which is put in an on or off state in dependence on whether the information stored in the spare register 202 is '0'or '1'. A hatched block in the shift register 143 shown FIG. 21 indicates the position of a spare register.

Every time a pulse of the gate-driving signal $\phi g$ is supplied to the shift register 143 in an on-state period, the '1' information is shifted to the next register in the shift register 143. Assume that the number of registers included in the shift register 143 employed in the gate driver 126 is 2N. As shown in FIG. 21, a spare register 202 is placed between two adjacent registers in the shift register 143. In such a configuration of the shift register 143, an on-state period and a period in which all the gate lines are put in an off state are repeated alternately for every other register, making the driving according to the second typical example easy to carry out. At that time, as a method of making a transition from a scanning period to a hold period, it is possible to adopt a technique whereby '1' information disappears from the shift register 143 due to the arrival of the (2N+1)th pulse of the gate-driving signal $\phi g$ as is the case with the first typical example. Alternatively, it is also possible to adopt a method of using a spare register for storing '1' information at the end of the scanning period. By keeping '1' information in the spare register for storing '1' information at the end of the scanning period for any period of time, for example, it is possible to set the length of the hold period at any value. As the next vertical synchronization signal Vsyn is received and generation of pulses of the gate-driving signal ϕg is started, '1' information is stored in a register associated with the first gate line and a scanning operation is commenced.

As a conceivable technique of notifying a component such as the timing controller 129 or the source driver 125 of a transition from a scanning period to a hold period and a transition from a hold period to a scanning period, the spare register for storing '1' information at the end of the scanning period for any period of time is examined to determine whether or not '1' information has been stored in the spare register.

Figure 22:
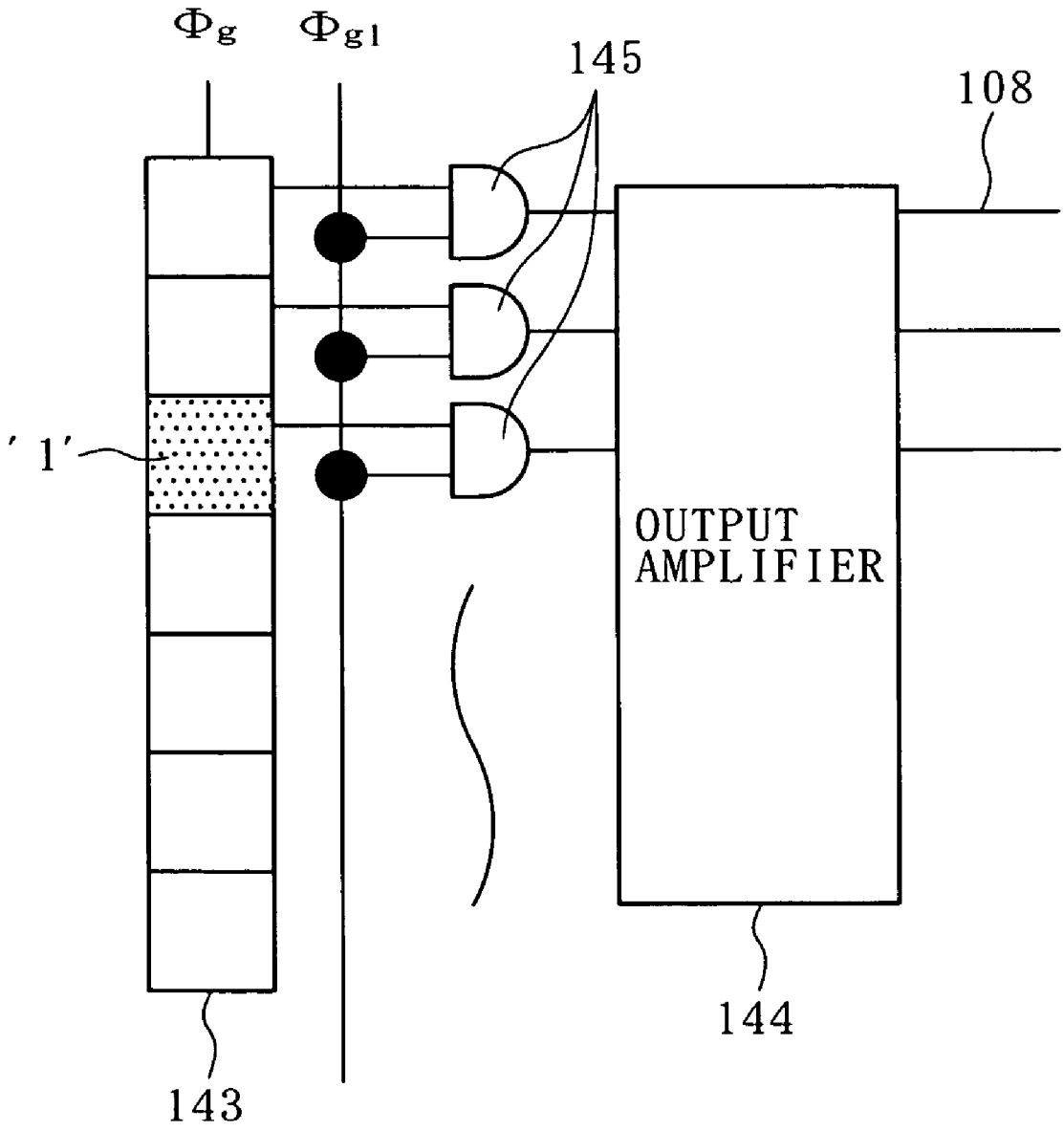
FIG. 22 is an explanatory diagram referred to in describing a control method for driving gate lines in the liquid-crystal display device according to the present invention.

Another typical configuration is explained by referring to FIG. 22. FIG. 22 is an explanatory diagram used in describing a control method for driving gate lines in the liquid-crystal display device according to the embodiment of the present invention. As shown in FIG. 22, the shift register 143 comprises N registers. The output of each of the registers and a signal ϕg1 generated by a source are supplied to one of N AND circuits 145. The outputs of the AND circuits 145 are supplied to the output amplifier 144. The outputs of the N AND circuits 145 are associated with N gate lines on a one-with-one basis. Thus, the output of an AND circuit 145 sets a gate line associated with the AND circuit 145 at an on-state or off-state electric potential.

The signal ϕg1 conveys '1' or '0' information and supplies the information to the AND circuits 145. In this typical configuration, when the signal ϕg1 conveys '1' information and '1' information is stored in a register of the shift register 143, the AND circuit 145 connected to the register outputs a signal putting a gate line associated with the AND circuit 145 in an on state to the output amplifier 144. That is to say, the nth gate line is put in an on state during a period in which the register associated with the nth gate line contains the '1' information and the signal ϕg1 conveys the '1' information. If the register associated with the nth gate line does not contain '1' information or the signal ϕg1 does not convey '1' information, on the other hand, the AND circuit 145 for the register outputs a signal putting the nth gate line associated with the AND circuit 145 in an off state to the output amplifier 144. That is to say, during a period in which the register associated with the nth gate line contains information other than the '1' information or the signal ϕg1 conveys information other than the '1' information, the nth gate line is put in an off state.

Figure 23:
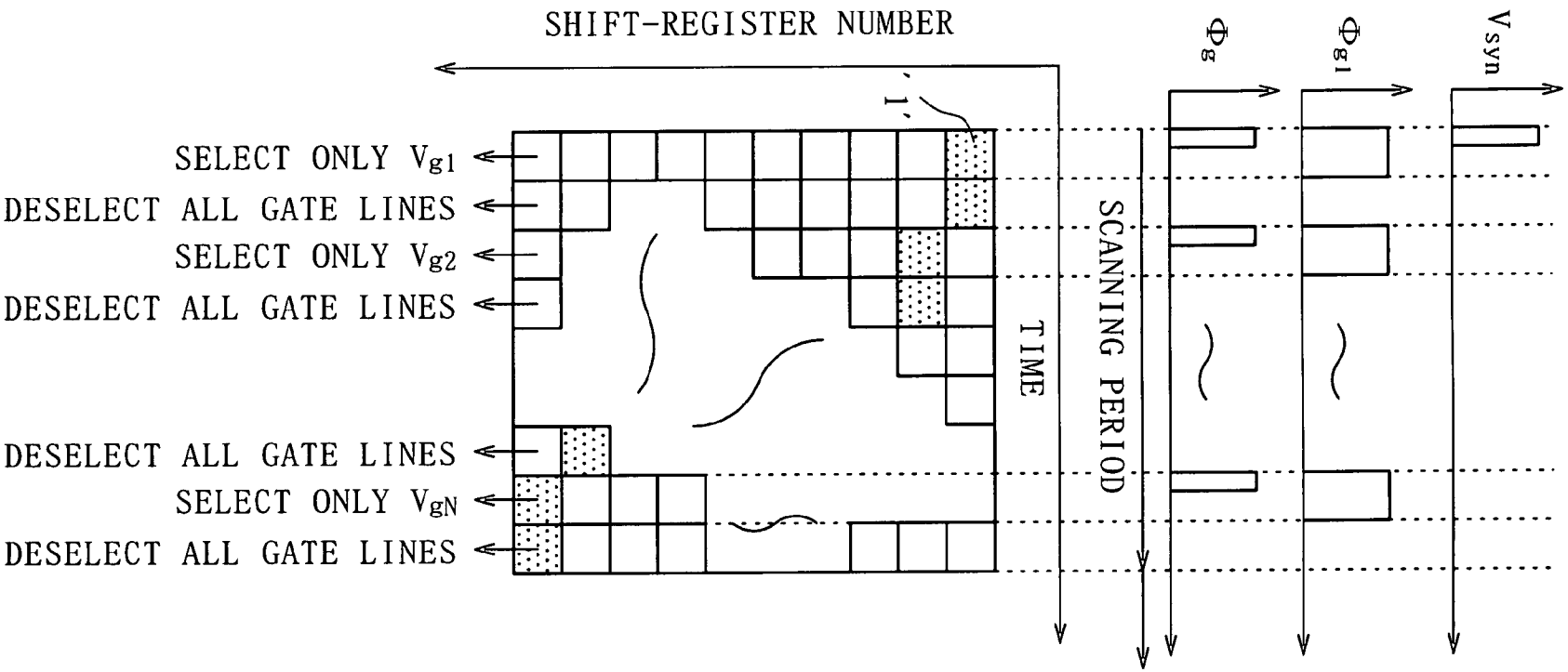
FIG. 23 is an explanatory diagram referred to in describing a control method for driving gate lines in the liquid-crystal display device according to the present invention.

The above driving method is explained concretely by referring to FIG. 23. FIG. 23 is an explanatory diagram used in describing a control method for driving gate lines in the liquid-crystal display device according to the embodiment of the present invention. By supplying the gate signal ϕg and the signal ϕg1 as shown in FIG. 23, for example, driving similar to that of the typical implementation described above can be implemented with ease. A high electric potential appearing on the signal ϕg1 indicates that the signal ϕg1 conveys the '1' information. On the other hand, a low electric potential appearing on the signal ϕg1 indicates that the signal ϕg1 conveys the '0' information.

Figure 24:
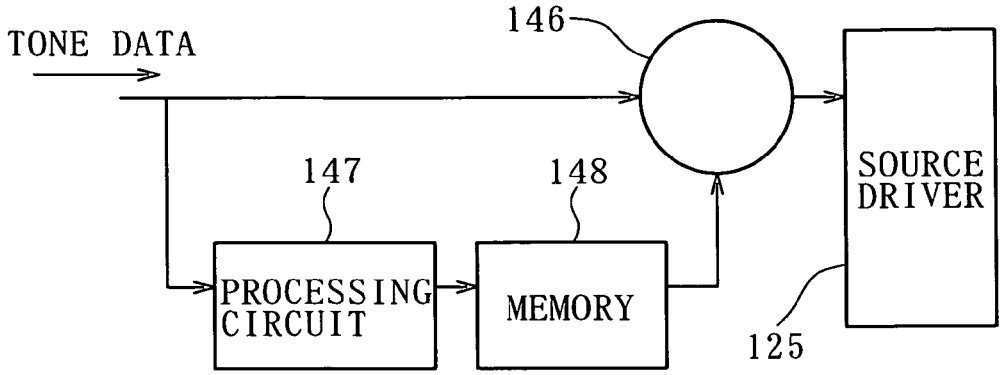
FIG. 24 is an explanatory diagram used in describing a control method for driving the liquid-crystal display device according to the present invention.

FIG. 24 is an explanatory diagram used in describing a control method for driving the liquid-crystal display device provided by the present invention. A transfer of data to the source driver 125 in a scanning period is explained by referring to FIG. 24. An operation circuit 147 shown in FIG. 24 processes input tone data and outputs data corresponding to an electric potential applied to a data line when all gate lines are put in an off state right after an on-state period. A memory 148 is used for storing data output by the operation circuit 147. A image-data transfer control means 146 alternately transfers incoming tone data and data stored in the memory 148 to the source driver 125. By carrying out the driving described above, it is possible to obtain a display characteristic having a high image quality free of flickers even for a frame period longer than 1/60 seconds.

(3) THIRD TYPICAL EXAMPLE

Figure 25:
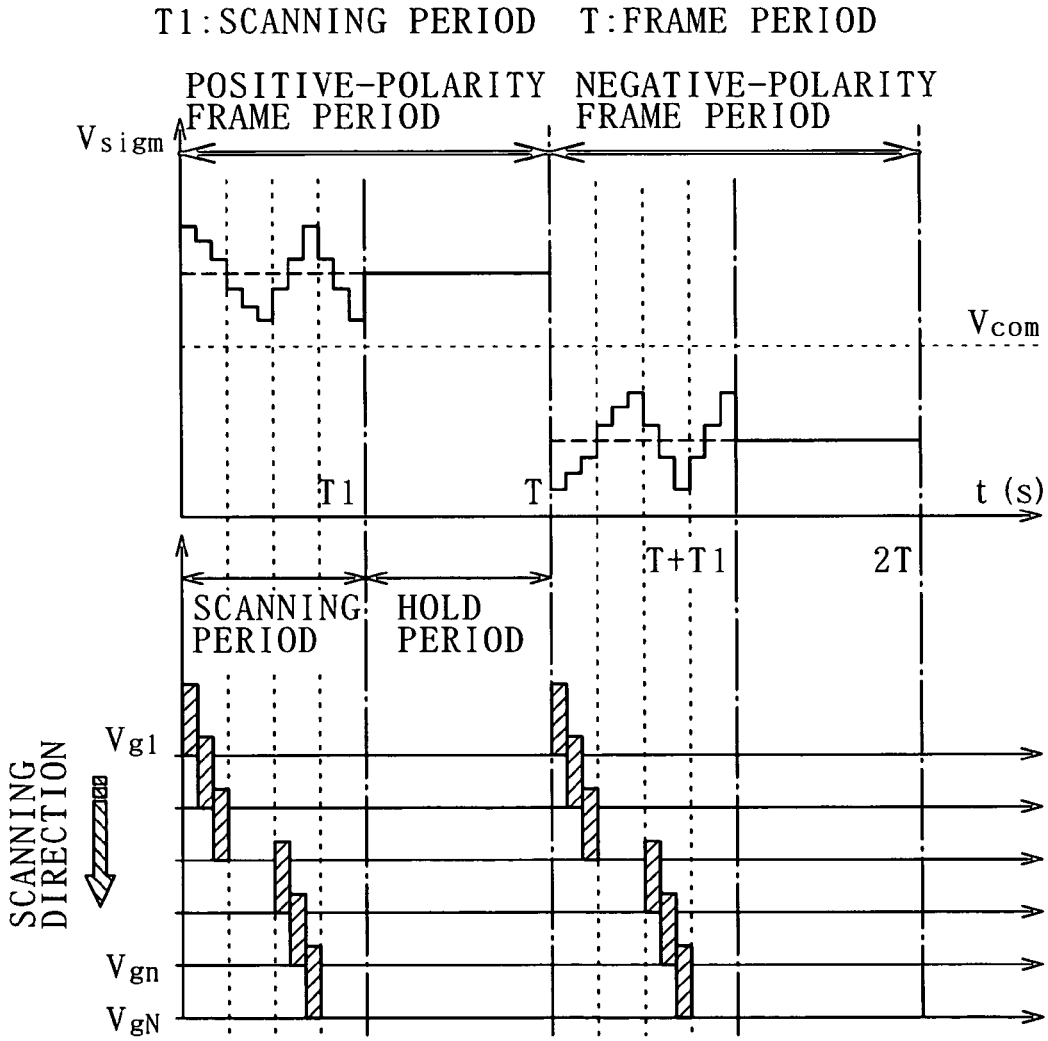
FIG. 25 shows timing charts referred to in explaining a driving method adopted by the liquid-crystal display device implemented by the embodiment of the present invention.
Figure 26:
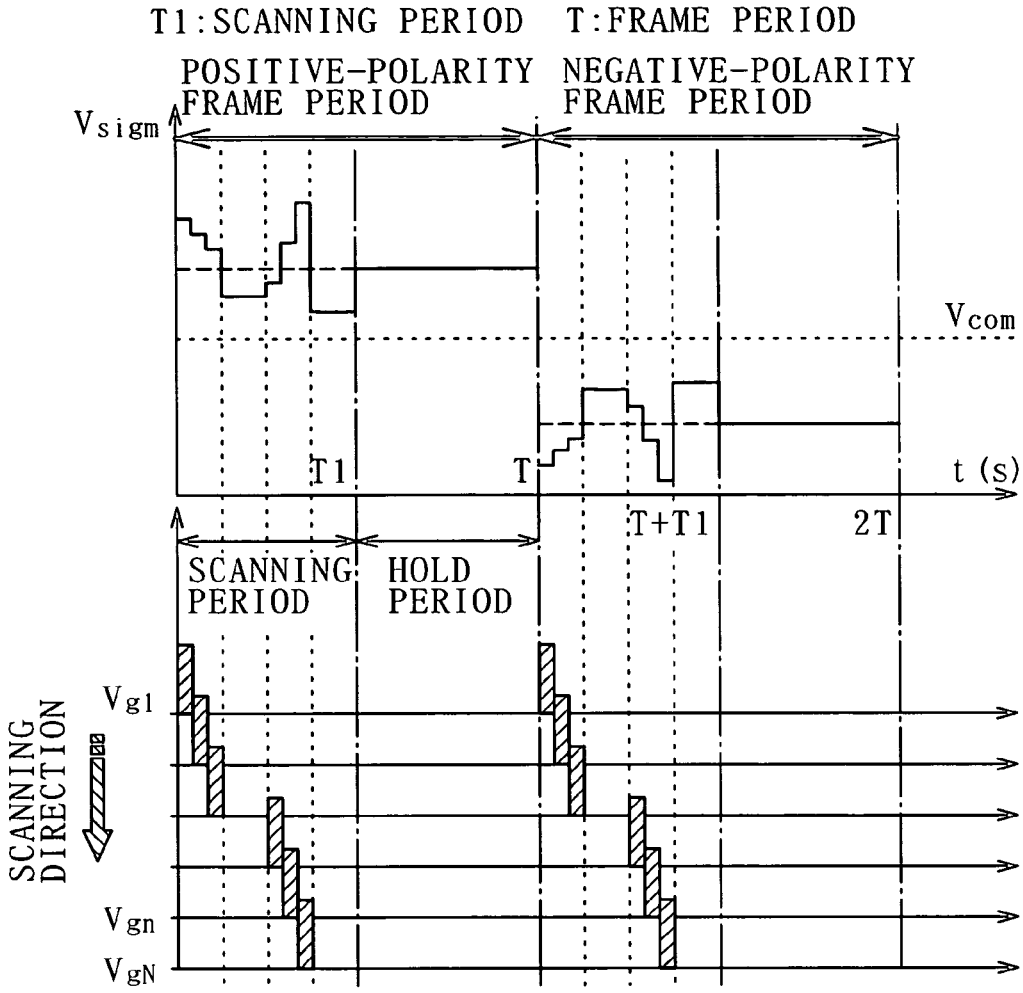
FIG. 26 shows timing charts referred to in explaining a driving method adopted by the liquid-crystal display device implemented by the embodiment of the present invention.

A third typical example of the driving method according to the embodiment of the present invention is explained by referring to FIGS. 25 and 26. FIG. 25 shows timing charts referred to in explaining the driving method adopted by the liquid-crystal display device implemented by the embodiment of the present invention. To be more specific, the figure shows timings of driving signals in positive-polarity and negative-polarity frame periods. FIG. 26 also shows timing charts referred to in explaining the driving method adopted by the liquid-crystal display device implemented by the embodiment of the present invention. To be more specific, the figure also shows timings of driving signals in positive-polarity and negative-polarity frame periods.

To put it in detail, FIGS. 25 and 26 show timings during consecutive positive-polarity and negative-polarity frame periods of an electric potential Vsigm appearing on a data line connected to a pixel located at the intersection of the nth row and the mth column. Moreover, the figures also show timings of electric potentials Vgl, Vgn and VgN appearing on gate lines. As described before, the electric potential Vgl is an electric potential appearing on a first gate line, the electric potential Vgn is an electric potential appearing on an nth gate line and the electric potential VgN is an electric potential appearing on the Nth gate line serving as the last gate line. The electric potential Vcom appearing on the opposite electrode is fixed independently of time.

Like the typical examples described before, a frame period is divided into a scanning period and a hold period. Each data line is driven in such a way that the frame period is switched repeatedly in an alternating manner from a positive-polarity frame period to a negative-polarity frame period and vice versa. The data lines forming the columns of the matrix are arranged repeatedly in an alternating manner as positive-polarity and negative-polarity data lines. The driving method according to the third typical example during a hold period is exactly the same as the driving method according to the first and second typical examples during a hold period. That is to say, positive-polarity and negative-polarity data lines are driven to electric potentials optimum for the positive-polarity and negative-polarity data lines during a hold period. The value of an electric potential applied to a data line during a hold period is determined in accordance with the first typical example.

A driving method executed during a scanning period is explained by referring to timing charts shown in FIGS. 25 and 26 below. k gate lines are driven by putting the gate lines in an on state, setting the electric potential appearing on the data line at a level for writing desired image data into the pixels and writing the desired picture data into the pixels. In this case, k is an integer in the range 2 to N. Right after that, all the gate lines are put in an off state. With all the gate lines put in an off state, if the data line is a positive-polarity data line, the data line is set at an electric potential symmetrical with respect to each of k electric potentials appearing on the k respective data lines as electric potentials representing k pieces of image data during a period of scanning the k data lines as shown in the timing charts of FIG. 25 for the length of each on-state period. In this case, an electric potential in the vicinity of Vsp is taken as the center of symmetry. If the data line is a negative-polarity data line, on the other hand, an electric potential in the vicinity of Vsm is taken as the center of symmetry. Alternatively, as shown in the timing charts of FIG. 26, while carrying out driving to apply an electric potential symmetrical with respect to the average value of k electric potentials appearing on the k respective data lines as electric potentials representing k pieces of picture data to the data line for each of the k gate lines repeatedly, desired image data is written into all pixels in the scanning period. The length of a period in which all gate lines are put in an off state is not prescribed in particular. However, it is desirable to set the length of a period in which all gate lines are put in an off state at the same value as the period to scan the k gate lines. When the k electric potentials are applied to their respective data lines as shown in FIG. 25, the length of a period in which each of the electric potentials is applied to its data line is not prescribed in particular. However, it is desirable to apply one of the k electric potentials to its data line for each time duration equal to an on-state period.

By carrying out such driving, effectively, an electric potential optimum for the hold period of a positive-polarity data line can be applied to a pixel connected to the positive-polarity data line as a pixel put in an off state. On the other hand, an electric potential optimum for the hold period of a negative-polarity data line can be effectively applied to a pixel connected to the negative-polarity data line as a pixel put in an off state.

As a technique of controlling gate lines, a method according to the second typical example has been explained. To be more specific, in order to execute the control of gate lines, spare registers are properly included as registers composing the shift register 143 as shown in FIG. 21, or the gate signal ϕg and the signal ϕg1 are supplied to the configuration of the gate driver 126 as shown in FIG. 22.

Data is transferred to the source driver 125 during a scanning period in such a manner described below. That is to say, in the block diagram of FIG. 24, the operation circuit 147 processes data for an off state of all gate lines and stores a result of processing in the memory 148. Then, the image-data transfer control means 146 transfers incoming tone data to the source driver 125 with a timing adjusted to an on-state period. A desired result of processing is transferred from the memory 148 to the source driver 125 with a timing adjusted to an off-state period of all the gate lines.

The following description explains further details of the methods to determine data-line electric potentials Vsp and Vsm in accordance with the first to third typical explanations. The data-line electric potential Vsp is taken as an electric potential at which a change in reflectance at a gray level in a positive-polarity frame period of a pixel connected to the last gate line or a gate line in the vicinity of the last gate line reaches a minimum. On the other hand, the data-line electric potential Vsm is taken as an electric potential at which a change in reflectance at a gray level in a negative-polarity frame period of a pixel connected to the last gate line or a gate line in the vicinity of the last gate line reaches a minimum.

Figure 32A:
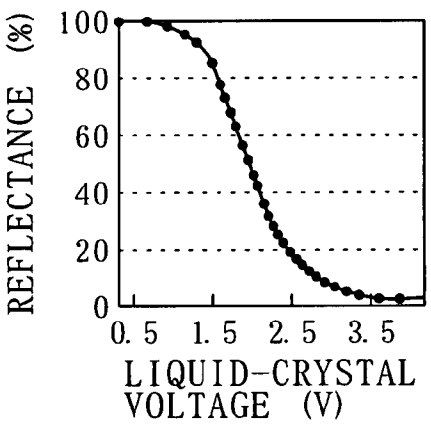
FIGS. 32A, 32B and 32C are explanatory diagrams referred to in describing a method of evaluating a flicker quantity in a hold period of the liquid-crystal display device implemented by the embodiment of the present invention.
Figure 32B:
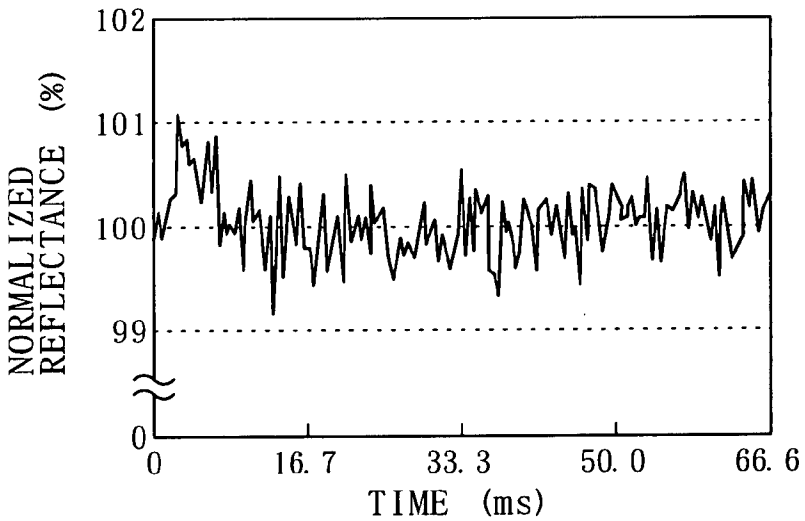
Figure 32C:
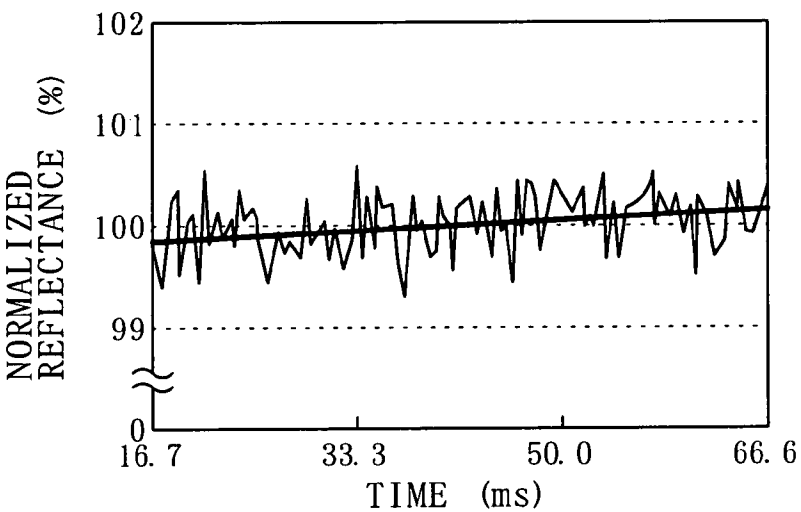
Figure 33:
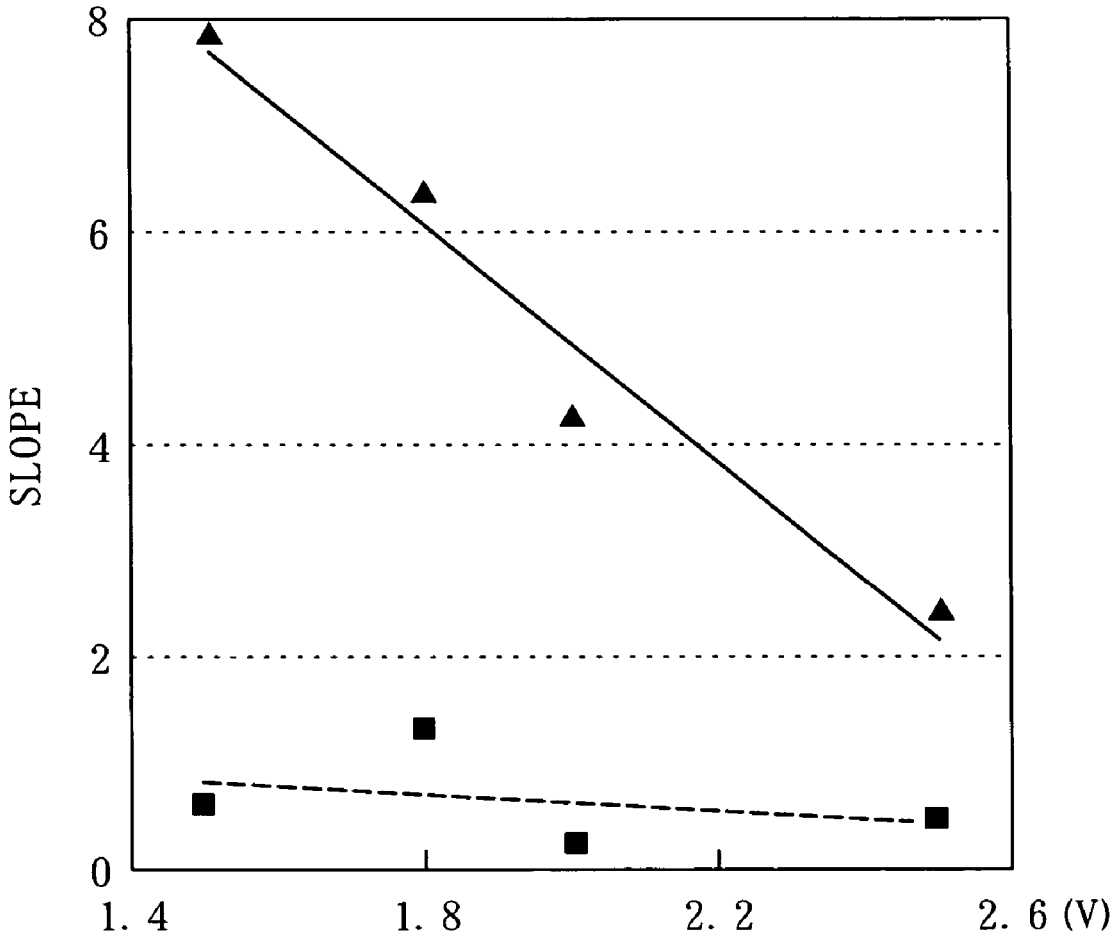
FIG. 33 is a diagram showing a graph representing dependence of flickers described above on the electric potential appearing on the data line in a hold period of the liquid-crystal display device implemented by the embodiment of the present invention.

In addition, as is obvious from Eq. (10), the difference (Vsp−Vcom) between the proper electric potential Vsp in a hold period of a positive-polarity data line and the electric potential Vcom appearing on the opposite electrode is greater than the absolute value Vp of the liquid-crystal voltage. The absolute value Vp of the liquid-crystal voltage is a liquid-crystal voltage having a positive polarity. A leakage current of a pixel holding the liquid-crystal voltage having a positive polarity causes changes in liquid-crystal voltage. The changes in liquid-crystal voltage can be suppressed by setting the electric potential appearing on the positive-polarity data line in a hold period at a value greater than the sum (Vcom+Vp). This is because the electric potential appearing on the data line changes to a level close to the proper electric potential Vsp. Also in a case of considering suppression of changes in liquid-crystal voltage, which are caused by the leakage current, for a display of another reflection, the electric potential appearing on the positive-polarity data line in a hold period had rather be set at a value greater than the sum (Vcom+Vp). The following description explains a method of evaluating the quantity of flickers generated in a hold period by referring to FIGS. 32A to 32C. FIG. 32A is a diagram showing a curve representing dependence of the reflectance of a liquid-crystal panel on the voltage appearing on the liquid crystal. In this case, the liquid-crystal panel is a reflection-type liquid-crystal panel adopting a normally white display method. The liquid-crystal panel is a panel used in the measurement. FIG. 32B is a diagram showing a frame response measured at a reflectance of 25%. As shown in FIG. 32A, the reflectance of 25% corresponds to a liquid-crystal voltage 2.32 V. In the measurement, the frame period was set at about 66.6 ms and the scanning period was set at about 16.6 ms. The horizontal axis of FIG. 32B represents the lapse of time expressed in terms of ms. The 0-ms time corresponds to the start or the frame period and the 66.6-ms time corresponds to the end or the frame period. The vertical axis represents the normalized reflectance observed at each time over the frame period. The normalized reflectance is the reflectance normalized with respect to the average of values of the reflectance. In order to evaluate the quantity of flickers generated in a hold period, a portion of the hold period between a 16.6-ms time and a 66.6-ms time is extracted from the data shown in FIG. 32B. The extracted portion is shown in FIG. 32C. In FIG. 32C, a thin line represents measured data and a thick line is an approximation straight line found by linear expression of the measured data. As a quantity representing the magnitude of flickers observed during the hold period, the slope of this approximation straight line is used. This is because the slope is a quantity representing how much the normalized reflectance changes in each unit time. That is to say, the greater the slope, the larger the flickers. FIG. 33 is a diagram showing a graph representing dependence of the slope described above on the electric potential appearing on the data line in a hold period. At the measurement time, driving was carried out to make the absolute value of the difference between the electric potential appearing on the opposite electrode and the electric potential appearing on the positive-polarity data line in a hold period equal to the absolute value of the difference between the electric potential appearing on the opposite electrode and the electric potential appearing on the negative-polarity data line in the hold period. The vertical axis of FIG. 33 represents the slope. On the other hand, the horizontal axis represents the absolute value of the difference between the electric potential appearing on the opposite electrode and the electric potential appearing on the data line in a hold period. The absolute value is expressed in terms of volts (V). Triangular marks each represent data measured for a reflectance of 25%, which corresponds to a liquid-crystal voltage of 2.32 V. A solid straight line passing through the vicinities of the triangular marks is an approximation straight line. On the other hand, rectangular marks each represent data measured for a reflectance of 74%, which corresponds to a liquid-crystal voltage of 1.69 V. Similarly, a broken straight line passing through the vicinities of the rectangular marks is an approximation straight line.

As is obvious from FIG. 33, the quantity of flickers of the frame response for the reflectance of 25% in a hold period is greater than the quantity of flickers of the frame response for the reflectance of 74% in the hold period. In addition, the dependence of the flickers on the electric voltage of the data line in a hold period for the reflectance of 25% is more striking than that for the reflectance of 74%. That is to say, in a range of positive-polarity liquid-crystal voltages used in a display, a case of exhibiting a reflectance corresponding to voltage range 2 has more flickers in a hold period and more dependence of the flickers on the electric voltage of the data line in the hold period than a case of exhibiting a reflectance corresponding to voltage range 1. In this case, voltage range 2 is a voltage range starting from a positive-polarity liquid-crystal voltage having an absolute value of Vp and ending at a positive-polarity liquid-crystal voltage having an absolute value equal to about the maximum. On the other hand, voltage range 1 is a voltage range starting from a positive-polarity liquid-crystal voltage having an absolute value equal to about the minimum and ending at a positive-polarity liquid-crystal voltage having an absolute value of Vp. Thus, since the case of exhibiting a reflectance corresponding to voltage range 1 has few flickers in a hold period and little dependence of the flickers on the electric voltage appearing on the data line in the hold period, an electric potential appearing on the data line had rather be set so as to control the case of exhibiting a reflectance corresponding to voltage range 2. By setting an electric potential appearing on the data line in this way, the flicker intensity can be made equal to or smaller than a detection threshold with ease for the reflectance of all the ranges. By setting the electric potential appearing on the positive-polarity data line in a hold period at a value greater than the sum (Vcom+Vp) rather than a value smaller than the sum, it is possible to further control changes in liquid-crystal voltage for the case of exhibiting a reflectance corresponding to voltage range 2.

Thus, by setting the electric potential appearing on the positive-polarity data line in a hold period at a value greater than the sum (Vcom+Vp), an effect of controlling changes in liquid-crystal voltage, which are caused by a leakage current, works for a pixel holding a positive-polarity liquid-crystal voltage having an absolute value of Vp. In addition, changes of the voltage appearing on the liquid crystal of a pixel exhibiting a reflectance corresponding to voltage range 2 can be better controlled. Thus, the flicker intensity can be made equal to or smaller than a detection threshold for all reflectance values.

In addition, for a positive-polarity frame, Vop is the absolute value of a positive-polarity liquid-crystal voltage for which the transmittance or reflectance change observed on the liquid-crystal display panel as a change caused by a change in liquid-crystal voltage is largest among voltages appearing on the liquid crystal in a range for use in a display. In the case of a liquid-crystal display device of an ordinary active matrix type, the absolute value Vop is a value in the vicinity of the absolute value Vp of the voltage appearing on the liquid crystal. To put it concretely, the absolute value Vop is a value in a range of approximately Vp±0.3 [V]. Thus, since the liquid-crystal voltage corresponding to image data to be most subjected to flicker control is in the range Vp±0.3 [V], the electric potential appearing on the positive-polarity data line in a hold period may be set at a value greater than an electric potential of (Vcom+Vp−0.3) [V] in some cases.

From Eq. (11) and the experiment, the same thing can be said also with regard to the electric potential appearing on a negative-polarity data line in a hold period. That is to say, by setting the electric potential appearing on a negative-polarity data line in a hold period at a value smaller than the difference (Vcom−Vm), an effect of controlling changes in liquid-crystal voltage, which are caused by a leakage current, works for a pixel holding a negative-polarity liquid-crystal voltage having an absolute value of Vm. In addition, changes of the voltage appearing on the liquid crystal of a pixel exhibiting a reflectance corresponding to voltage range 2 can be better controlled. Thus, the flicker intensity can be made equal to or smaller than a detection threshold for all reflectance values. Furthermore, the electric potential appearing on the negative-polarity data line in a hold period may be set at a value greater than an electric potential of (Vcom−Vm+0.3) [V] in some cases. In this case, voltage range 2 is a voltage range starting from a negative-polarity liquid-crystal voltage having an absolute value of Vm and ending at a negative-polarity liquid-crystal voltage having an absolute value equal to about the maximum as described earlier.

Let symbol K50 denote a tone exhibiting a transmittance and/or a reflectance equal to about half the maximum transmittance and/or the maximum reflectance respectively in a range of liquid-crystal voltages used in a display. Let symbol Vsp50 denote an electric potential appearing on a positive-polarity data line as an electric potential corresponding to the tone K50. Similarly, let symbol Vsm50 denote an electric potential appearing on a negative-polarity data line as an electric potential corresponding to the tone K50. In addition, let symbol ΔVft denote a difference in electric potential as follows:

$$\Delta Vft = (Vsp50 + Vsm50)/2 - Vcom$$

In this case, by setting the electric potential appearing on the positive-polarity data line in a hold period at a value greater than (Vsp50−ΔVft) and by setting the electric potential appearing on the negative-polarity data line in a hold period at a value smaller than (Vsm50−ΔVft), an effect of controlling changes in negative-polarity data-line electric potential, which are caused by a leakage current, is made powerful in reduction of the operating flicker intensity to a value not exceeding the detection threshold. In addition, in order to make the problem even simpler, the value of ΔVft is generally assumed to be equal to or smaller than 0.5 V. Thus, the value of ΔVft can be assumed to be close to 0 (that is, ΔVft~0). In this case, the electric potential appearing on the positive-polarity data line in a hold period can be set at a value greater than Vsp50 and the electric potential appearing on the negative-polarity data line in a hold period can be set at a value smaller than Vsm50.

Figure 31:
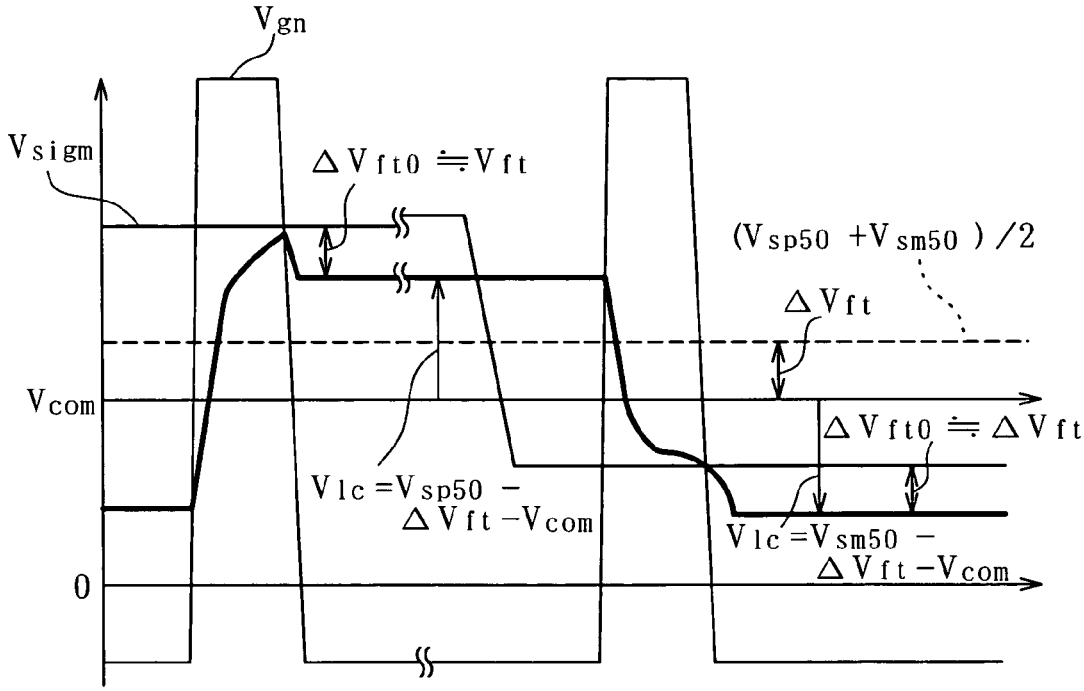
FIG. 31 shows timing charts referred to in explaining a driving method adopted by the liquid-crystal display device implemented by the embodiment of the present invention.

A further explanation with reference to FIG. 31 is given as follows. FIG. 31 shows timing charts of an electric potential appearing on a data line provided as the mth column, an electric potential appearing on a gate line provided as the nth row and an electric potential appearing on a pixel located on the nth row as a pixel connected to the data line provided as the mth column with the pixel displaying the tone K50. The timing charts are drawn by particularly paying attention to an on-state period of the pixel in a positive-polarity frame period and a negative-polarity frame period. A thick line shown in the figure represents the timing chart of the electric potential appearing on the pixel. As is obvious from FIG. 31, the electric potential appearing on the pixel electrode of the pixel in the on-state period is almost equal to the electric potential appearing on the data line. Right after the on-state period, however, the electric potential appearing on the pixel electrode of the pixel drops from the electric potential in the on-state period by a difference Δvfto due to a variety of effects. The principal effect causing the drop in electric potential is capacitive coupling of the parasitic capacitor Cgs 201 between the pixel electrode and the gate line. This capacitive coupling causes the drop on the trailing edge of the electric potential appearing on the gate line provided as the nth column. The other effects include an effect of impurity ions or the like. The electric-potential drop Δvfto causes non-symmetry with regard to the absolute value of the electric potential appearing on the pixel electrode right after the on-state period between the positive-polarity and negative-polarity frame periods. In order to compensate the electric potential appearing on the pixel electrode for the non-symmetry, in general, the electric potential appearing on the opposite electrode is made different from a middle electric potential (Vsp50+Vsm50)/2, where symbol Vsp50 denotes an electric potential appearing on the positive-polarity data line and symbol Vsm50 denotes an electric potential appearing on the negative-polarity data line. By making the electric potential appearing on the opposite electrode different from a middle electric potential, the degree of non-symmetry can be lowered. When the relation Δvft≈Δvfto is reached, the degree of non-symmetry approximately attains its lowest level. In addition, for Δvft>0, the electric-potential drop Δvfto is corrected even if electric potentials are not set to establish the relation Δvft=Δvfto in a strict manner. Thus, it is possible to think that the relation Δvft≈Δvfto holds true in the liquid-crystal display device. Accordingly, the voltage absolute value |Vsp50−Δvft−Vcom| becomes approximately equal to the voltage value Vp and the voltage absolute value |Vsm50−Δvft−Vcom| becomes approximately equal to the voltage value Vm. Thus, by setting the electric potential appearing on the positive-polarity data line in a hold period at a level higher than the electric-potential difference (Vsp50−ΔVft) and setting the electric potential appearing on the negative-polarity data line in a hold period at a level lower than the electric-potential difference (Vsm50−ΔVft), the effect of suppressing changes in liquid-crystal voltage, which are caused by a leakage current, is made powerful in reduction of the operating flicker intensity to a value not exceeding the detection threshold. In addition, in order to make the problem even simpler, the value of ΔVft can be assumed to be close to 0 (that is, ΔVft~0). In this case, the electric potential appearing on the positive-polarity data line in a hold period can be set at a value greater than the electric potential Vsp50 and the electric potential appearing on the negative-polarity data line in a hold period can be set at a value smaller than the electric potential Vsm50.

In addition, a pixel holding the liquid-crystal voltage Vp is driven by vibrating the electric potential appearing on the positive-polarity data line at a center of vibration coinciding with a value greater than a sum (Vcom+Vp) where symbol Vcom denotes the electric potential appearing on the opposite electrode and symbol Vp denotes the voltage appearing on the liquid crystal. Similarly, a pixel holding the liquid-crystal voltage Vm is driven by vibrating the electric potential appearing on the negative-polarity data line vibrate at a center of vibration coinciding with a value smaller than a difference (Vcom−Vm) where symbol Vm denotes the voltage appearing on the liquid crystal. Even if the pixels are driven in this way, the effect of suppressing the leakage current works.

In addition, the electric potential appearing on the positive-polarity data line in a hold period can be driven to vibrate at a center of vibration coinciding with a value greater than an electric-potential difference (Vsp50−ΔVft). Similarly, the electric potential appearing on the negative-polarity data line in a hold period can be driven to vibrate at a center of vibration coinciding with a value smaller than an electric-potential difference (Vsm50−ΔVft). Even by driving the electric potentials in this way, the effect of suppressing changes in liquid-crystal voltage, which are caused by the leakage current, works. In addition, in order to make the problem even simpler, the value of ΔVft can be assumed to be close to 0 (that is, ΔVft−0). In this case, the electric potential appearing on the positive-polarity data line in a hold period can be driven to vibrate at a center of vibration coinciding with a value greater than the electric potential Vsp50. Similarly, the electric potential appearing on the negative-polarity data line in a hold period can be driven to vibrate at a center of vibration coinciding with a value smaller than the electric potential Vsm50.

At that time, an electric potential appearing on a data line is determined as an electric potential minimizing the reflectance change of a gray level in positive-polarity and negative-polarity frame periods by rule of thumb. To put it in detail, Eqs. (1), (10) and (11) explained in the first typical example are used to determine an approximate electric potential appearing on a data line as an electric potential minimizing the reflectance change of the gray level showing a reflectance equal to about half the maximum reflectance or a transmittance equal to about half the maximum transmittance in the positive-polarity and negative-polarity frame periods. By carrying out the driving described above, it is possible to obtain a display characteristic having a high image quality free of flickers even for a frame period longer than 1/60 seconds.

(4) FOURTH TYPICAL EXAMPLE

Figure 27:
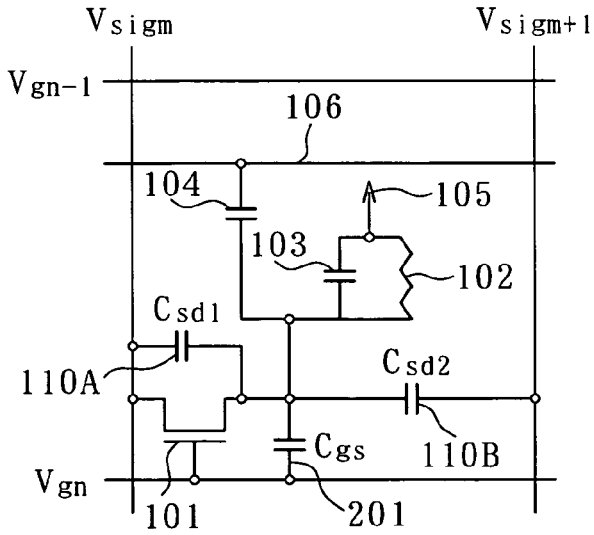
FIG. 27 is a diagram showing an equivalent circuit of a pixel in the liquid-crystal display device implemented by the embodiment of the present invention.

A fourth typical example of the driving method according to the embodiment of the present invention is explained. FIG. 27 is a circuit diagram showing a pixel located at the intersection of the nth row and the mth column with parasitic capacitors shown in detail. Changes in data-line electric potentials Vsigm and Vsigm+1 cause changes in electric potential appearing on the pixel electrode through parasitic capacitors Csd1 and Csd2, which are denoted by reference numerals 110A and 110B respectively. Let symbols ΔVsigm and Δvsigm+1 denote changes in data-line electric potential for the mth and (m+1)th columns respectively whereas symbol Ctot denote the total capacitance of all capacitors connected to the pixel electrode. In the case of the circuit shown in FIG. 27, the total capacitance is expressed by the following relation: Ctot=C1+Cstg+Csd1+Csd2+Cgs. In addition, let symbol α1 denote the ratio Csd1/Ctot and α2 denote the ratio Csd2/Ctot. In this case, a liquid-crystal-voltage change ΔV1c of the pixel is expressed by Eq. (17) as follows:

$$?V_{1c}=a_1?V_{sigm}+a_2?V_{sigm+1} \tag{17}$$

At a frame transition time, the electric potential appearing on the positive-polarity data line changes from a fixed electric potential Vsp1 appearing on a hold period to an electric potential for applying a negative-polarity liquid-crystal voltage in a scanning period of the next frame whereas the electric potential appearing on the negative-polarity data line changes from a fixed electric potential Vsm1 appearing on a hold period to an electric potential for applying a positive-polarity liquid-crystal voltage in a scanning period of the next frame. If the value of α1 is different from the value of α2, at the frame transition time, the voltage appearing on the liquid crystal of the pixel causes a change in liquid-crystal voltage in a scanning period. The magnitude of the change in liquid-crystal voltage is several times the magnitude of a data-line originated change in liquid-crystal voltage. The data-line originated change in liquid-crystal voltage is a change in liquid-crystal voltage originated from the data line as a change experienced by the pixel. For this reason, the effective value of the liquid-crystal voltage appearing on the pixel prior to the transition from a frame to another inevitably differs from the effective value of the liquid-crystal voltage appearing on the pixel in a scanning period right after the frame transition, generating flickers.

Figure 28:
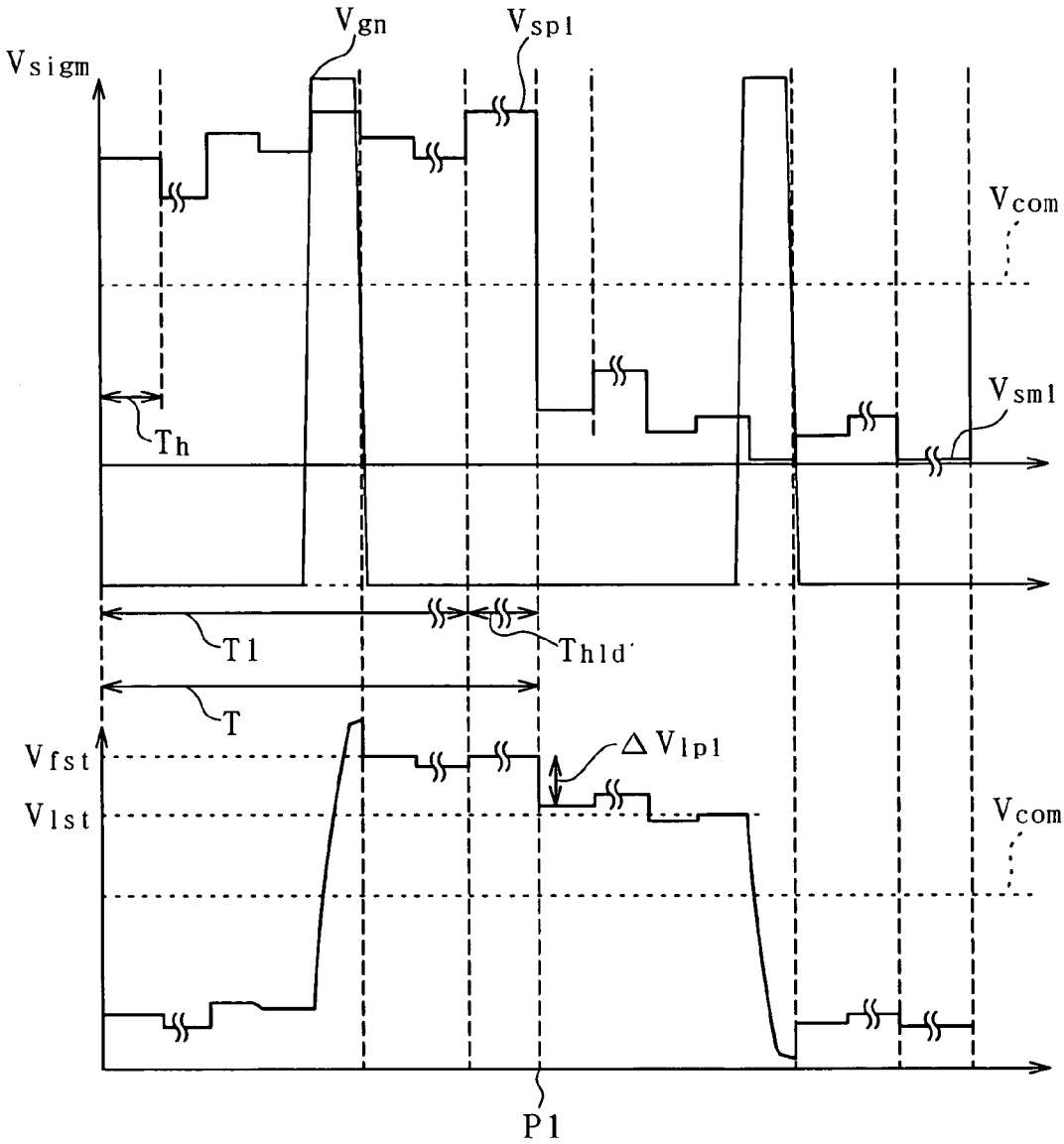
FIG. 28 shows timing charts referred to in explaining a driving method adopted by the liquid-crystal display device implemented by the embodiment of the present invention.

Pay attention to an effect of changes in data-line electric potentials Vsigm and Vsigm+1 on the electric potential appearing on the pixel electrode through the parasitic capacitors Csd1 and Csd2, which are denoted by reference numerals 110A and 110B respectively. FIG. 28 shows a timing chart of the electric potential Vsigm appearing on the data line provided on the mth column as a data line connected to a pixel located at the intersection of the nth row and the mth column. The figure also shows a timing chart of changes in pixel electrode, which accompany changes in electric potential Vsigm in the pixel. In addition, the figure also shows a timing chart of the electric potential Vgn appearing on a gate line provided on the nth row. A frame period T is divided into a scanning period T1 and a hold period Th1*d*. A horizontal period is a period denoted by symbol Th. The first frame period shown in the figure is a positive-polarity frame period followed by a negative-polarity frame period. A pixel adjacent to the observed pixel has frame periods with polarities opposite to the polarities of the frame periods of the observed pixel.

A pixel on the nth row is selected and image data is stored in the selected pixel. After the pixel is selected, on a falling edge of the electric potential appearing on the gate line, the parasitic capacitor Cgs 201 between the pixel electrode and the gate line causes the electric potential appearing on the pixel electrode to drop. As an electric-potential change caused by the falling edge of the electric potential appearing on the gate line, the change in electric potential appearing on the pixel electrode is uniform for all gate lines. Thus, by adjusting the electric potential Vcom appearing on the opposite electrode, it is possible to eliminate the effect of the falling edge of the electric potential appearing on the gate line. The electric potential appearing on the pixel electrode as an electric potential contributing to an actual display is the electric potential Vfst appearing on the pixel electrode after completion of the on-state period. With a still image displayed, a large difference between the electric potential Vfst and an electric potential Vlst generates flickers with an intensity at least equal to the detection threshold due to the fact that there is a difference in effective value between the liquid-crystal voltages appearing on the pixel before and after the on-state period. In this case, the electric potential Vlst is an electric potential appearing on the pixel electrode immediately before the next on-state period following the present on-state period of the pixel.

In this typical implementation, in a hold period, electric potentials Vsp1 and Vsm1 for suppressing electric-potential changes resulting from a leak current in the pixel electrode are applied to the positive-polarity and negative-polarity data lines respectively. It is thus possible to think that almost no changes in electric potential appearing on the pixel electrode exist in the hold period. Accordingly, this typical implementation raises a problem of how to control changes in pixel-electrode electric potential, which occur at a frame transition time due to capacitive coupling. The magnitude of the change in pixel-electrode electric potential is expressed by Eq. (17). In actuality, Eq. (17) expresses the change in liquid-crystal voltage. Since the electric potential appearing on the opposite electrode is fixed in this typical implementation, however, the change in liquid-crystal voltage is equal to the change in pixel-electrode electric potential. If the dependence of the reflectance on the voltage appearing on the liquid crystal in a positive-polarity frame period is the same as the dependence of the reflectance on the voltage appearing on the liquid crystal in a negative-polarity frame period, the amplitude of changes in data-line electric potential in a scanning period is 2.2 V at the most for a range of approximately 1 V to 3.2 V shown in FIG. 14 as a range of the effective value of the liquid-crystal voltage used in a display. As a matter of fact, the dependence of the reflectance on the voltage appearing on the liquid crystal in a positive-polarity frame period is generally the same as the dependence of the reflectance on the voltage appearing on the liquid crystal in a negative-polarity frame period. At a frame-transition time P1 between a positive-polarity frame period and a negative-polarity frame period, however, the electric potential appearing on the data line changes by a maximum of about 6.2 V in dependence also on the image data for |Vsp1−Vcom|=|Vsm1−Vcom|=about 3 V. Thus, the electric potential appearing on the data line changes more at a frame-transition time P1 between a positive-polarity frame period and a negative-polarity frame period than the electric potential appearing on the data line does in a scanning period. In dependence also on the design of $\alpha 1$ and $\alpha 2$, nevertheless, in most cases, the effective value of the voltage appearing on the liquid crystal prior to a frame transition time is different from the effective value of the voltage appearing on the liquid crystal after the frame transition time due to the fact that the electric potential appearing on the pixel electrode changes at the frame transition time. For this reason, flickers with an intensity exceeding the detection threshold may be generated in the scanning period in some cases. In addition, the change in data-line electric potential at the frame transition time P1 is greater, generating more flickers for a case of displaying an image corresponding to a liquid-crystal voltage of 3.2 V than for a case of displaying an image corresponding to a liquid-crystal voltage of 1 V. That is to say, the higher the liquid-crystal voltage corresponding to a display, that is, the whiter the normally black display or the blacker the normally white display, the greater the flicker intensity. Symbol ΔVlp1 is used for denoting the change in electric potential appearing on the pixel electrode at a frame transition time.

One of the methods of solving the problem is that Vsp1 and Vsm1 are set at values satisfying the equation |Vsp1−Vcom|=|Vsm1−Vcom|. Eqs. (10) and (11) express data-line electric potentials optimum for control of a leakage current in a hold period for the positive and negative polarities respectively. In general, the values of Vp and Vm used in Eqs. (10) and (11) respectively are all but equal to each other. Thus, the leakage current is suppressed adequately even if Vsp1 and Vsm1 are set at values satisfying the equation |Vsp1−Vcom|=|Vsm1−Vcom|.

In most cases, at a frame transition time, the electric potentials appearing on the positive-polarity and negative-polarity data lines intersect the electric potential appearing on the opposite electrode, becoming an electric potential corresponding to image data of the next frame. In the case of a low-tone display adopting a normally-black display method and in the case a high-tone display adopting a normally-white display method, however, the electric potentials appearing on the positive-polarity and negative-polarity data lines may not intersect the electric potential appearing on the opposite electrode. If Vsp1 and Vsm1 are set at values satisfying the equation |Vsp1−Vcom|=|Vsm1−Vcom|, it is possible to suppress an effect on the voltage appearing on the liquid crystal due to the fact that the electric potential appearing on the positive-polarity data line changes from Vsp1 to Vcom and the electric potential appearing on the negative-polarity data line changes from Vsm1 to Vcom at a frame transition time. If Vsp1 and Vsm1 are set at such values that both the equations |Vsp1−Vcom|=Ep and |Vsm1−Vcom|=Em hold true, it is possible to obtain a display satisfying both the equations Vsp1=Vcom+Ep and Vsm1=Vcom−Em. From Eq. (17), the change of the voltage appearing on the liquid crystal in the pixel holding a positive-polarity liquid-crystal voltage for a case in which the electric potential appearing on the positive-polarity data line changes from Vsp1 to Vcom and the electric potential appearing on the negative-polarity data line changes from Vsm1 to Vcom at a frame transition time is found to be:

$$\alpha 1(Vcom-Vsp1)+\alpha 2(Vcom-Vsm1)=-\alpha 1Ep+\alpha 2Em$$

Similarly, from Eq. (17), the change of the voltage appearing on the liquid crystal in the pixel holding a negative-polarity liquid-crystal voltage for a case in which the electric potential appearing on the positive-polarity data line changes from Vsp1 to Vcom and the electric potential appearing on the negative-polarity data line changes from Vsm1 to Vcom at a frame transition time is found to be:

$$\alpha 1(Vcom-Vsm1)+\alpha 2(Vcom-Vsp1)=\alpha 1Em-\alpha 2Ep$$

In order to suppress the changes of the voltage appearing on the liquid crystal in both the pixels holding positive-polarity and negative-polarity liquid-crystal voltages, it is desirable to set Ep=Em. Furthermore, since the equation α1(Vcom−Vsp1)+α2(Vcom−Vsm1)=(α2−α1)Ep holds true in this case, by setting the capacitance of the capacitor Csd1 at a value equal to the capacitance of the capacitor Csd2 (or Csd1=Csd2), the changes in liquid-crystal voltage can be eliminated completely.

In most cases, at a frame transition time, the electric potentials appearing on the positive-polarity and negative-polarity data lines intersect a center electric potential Vcen of the data lines, becoming an electric potential corresponding to image data of the next frame. Thus, by setting the fixed electric potential appearing on the positive-polarity data line in the hold period and the fixed electric potential appearing on the negative-polarity data line in the hold period at such levels that the absolute value of a difference between the electric potential appearing on the positive-polarity data line and the center electric potential Vcen of the data lines becomes approximately equal to the absolute value of a difference between the electric potential appearing on the negative-polarity data line and the center electric potential Vcen of the data lines, it is possible to suppress an effect on the voltage appearing on the liquid crystal due to the fact that the electric potential appearing on the positive-polarity data line changes from Vsp1 to Vcen and the electric potential appearing on the negative-polarity data line changes from Vsm1 to Vcen at a frame transition time. Furthermore, by setting the capacitance of the capacitor Csd1 at a value equal to the capacitance of the capacitor Csd2 (or Csd1=Csd2), the changes in liquid-crystal voltage can be eliminated completely.

Let symbol Varb denote any arbitrary electric potential between the center electric potential Vcen of the data lines and the electric potential Vcom appearing on the opposite electrode. By setting the fixed electric potential appearing on the positive-polarity data line in a hold period and the fixed electric potential appearing on the negative-polarity data line in the hold period at such values that the absolute value of a difference between the electric potential appearing on the positive-polarity data line and the electric potential Varb is approximately equal to the absolute value of a difference between the electric potential appearing on the negative-polarity data line and the electric potential Varb, it is possible to suppress an effect on the voltage appearing on the liquid crystal at a frame transition time. Furthermore, by setting the capacitance of the capacitor Csd1 at a value equal to the capacitance of the capacitor Csd2 (or Csd1=Csd2), the changes in liquid-crystal voltage can be eliminated completely.

In addition, in accordance with another method of solving the problem raised by this typical embodiment, driving is carried out to make the effective value of the voltage appearing on the liquid crystal in a specific scanning period equal to the effective value of the voltage appearing on the liquid crystal in a hold period of a frame period preceding the specific scanning period. Thus, in a certain horizontal period of the scanning period of a frame, it is conceivable to provide a period Te in addition to a period Twt. The period Twt is a period during which the electric potential appearing on the data line is set at an electric potential corresponding to desired image data. On the other hand, the period Te is a period in which the electric potential appearing on the data line is set at any electric potential. In this case, the effective value of the voltage appearing on the liquid crystal in the horizontal period is expressed by a sum of the effective value of the voltage appearing on the liquid crystal in the period Twt and the effective value of the voltage appearing on the liquid crystal in the period Te. Thus, by controlling the effective value in the period Te so as to get rid of the change ΔVlp1 of the electric potential appearing on the pixel electrode at a frame transition time, flickers can be suppressed. In particular, in a display with a high voltage appearing on the liquid crystal, flickers seen as a problem of this typical example increase. In order to make the explanation simple, let symbol Vsmax denote the maximum value of the electric potential appearing on the data line and symbol Vsmin denote the minimum value of the electric potential appearing on the data line. Then, consider a case in which the change in data-line electric potential at a frame transition time reaches a maximum. Also consider a case in which the entire liquid-crystal panel displays picture data with the electric potentials appearing on the positive-polarity data lines at a level equal to Vsmax and the electric potentials appearing on the negative-polarity data lines at a level equal to Vsmin. In this case, by setting the electric potential appearing on a data line at a level lower than the electric potential Vsmax in the period Te if the data line is a positive-polarity data line and by setting the electric potential appearing on a data line at a level higher than the electric potential Vsmin in the period Te if the data line is a negative-polarity data line, it is possible to obtain an effect of suppressing flickers. That is to say, by setting the electric potentials appearing on the data lines at any arbitrary levels in a range used in a display in the period Te, an effect of reducing flickers can be obtained.

In this typical example, it is assumed that the relation α1>α2 holds true. In this case, the difference in effective value between the voltages appearing on the liquid crystal before and after the frame transition time for driving with no period Te provided as shown in FIG. 28 is equal to the change ΔVlp1 of the electric potential appearing on the pixel electrode at the frame transition time. The effective value of the voltage appearing on the liquid crystal after the frame transition time is represented by the following expression:

$$Vp1+\alpha 1(Vsmin-Vsp1)+\alpha 2(Vsmax-Vsm1)$$

where symbol Vp1 denotes a voltage appearing on the liquid crystal of the pixel prior to the frame transition time. Since the liquid-crystal voltage Vp1 is a voltage appearing on the liquid crystal in a frame period, the value of Vp1 is equal to the effective value of the voltage appearing on the liquid crystal of the pixel immediately before the frame transition time. For the sake of convenience, let Vpb be defined as follows:

$$Vpb = Vp1 + \alpha 1(Vsmin - Vsp1) + \alpha 2(Vsmax - Vsm1)$$

In addition, since the maximum value Vsmax and the minimum value Vsmin are electric potentials appearing on the data line as electric potentials for displaying the same tone in this typical example, on the assumption that the relations |Vsmax−vcom|≈|Vsmin−Vcom| and |Vsp1−Vcom|≈|Vsm1−Vcom| hold true, the relation Vpb<Vp1 also holds true due to the fact that the relation α1>α2 holds true.

Figure 29:
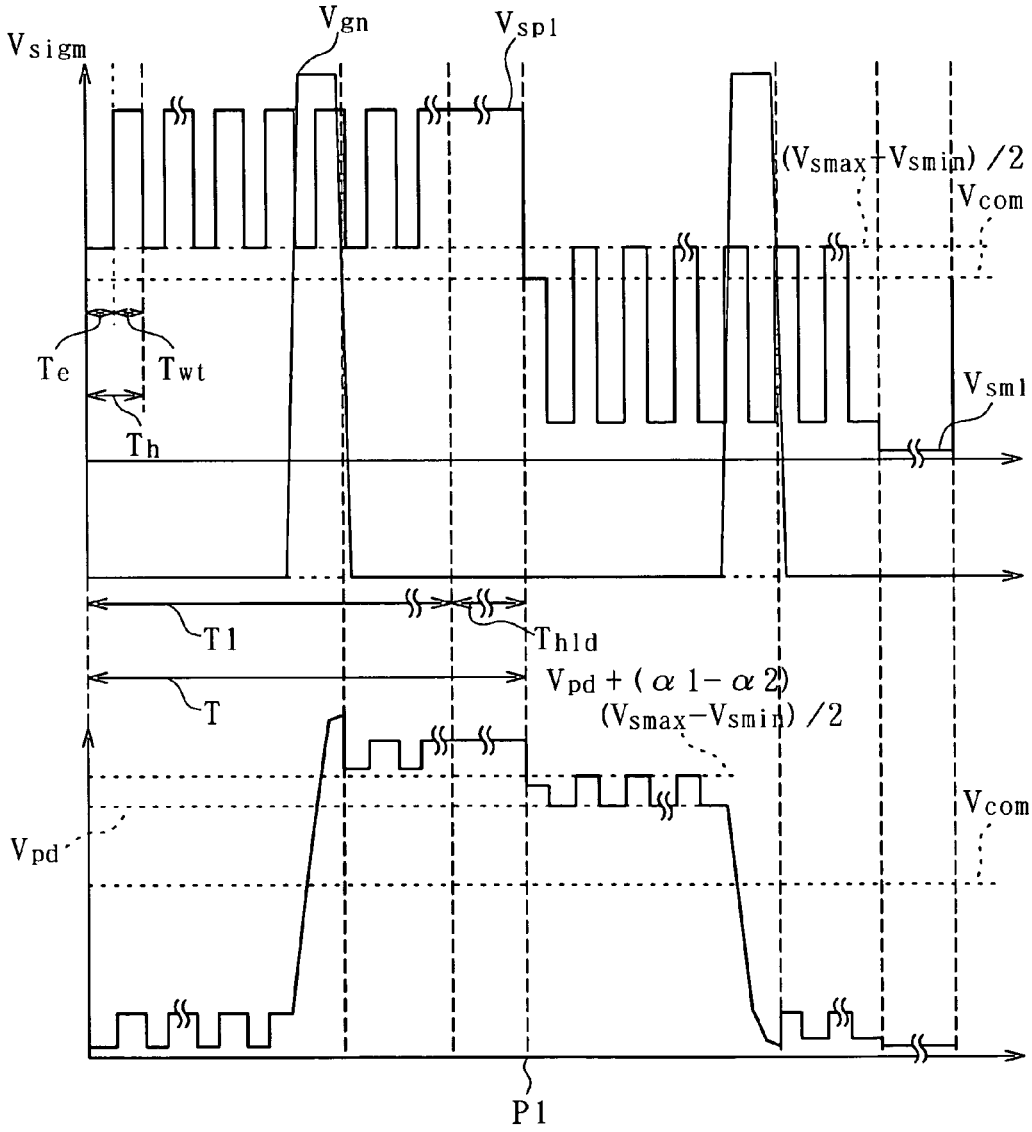
FIG. 29 shows timing charts referred to in explaining a driving method adopted by the liquid-crystal display device implemented by the embodiment of the present invention.

It is conceivable to get rid of the difference in effective value by short-circuiting the positive-polarity data line and the negative-polarity data line in the period Te. This technique is explained by referring to FIG. 29. In the timing charts shown in FIG. 29, the horizontal period is divided into the period Te and the period Twt. By short-circuiting the positive-polarity data line and the negative-polarity data line at a frame transition time P1, the electric potential appearing on the data lines becomes equal to the average of the electric potentials appearing on all the short-circuited data lines. In particular, FIG. 29 is a diagram showing a conceivable specific case in which two adjacent data lines are short-circuited. In this case, the electric potential appearing on the data lines is (Vsp1+Vsm1)/2. The voltage appearing on the liquid crystal in the period Te right after the frame transition time P1 is Vp1+(α2−α1)(Vsp1−Vsm1)/2. The voltage appearing on the liquid crystal in the period Twt right after the period Te is Vpb. After the period Twt, the voltage appearing on the liquid crystal is Vpb+(α1−α2)(Vsmax−Vsmin)/2 in the period Te and Vpb in the period Twt. Taking the above assumption into consideration, the relation Vpb<Vpb+(α1−α2)(Vsmax−Vsmin)/2<Vp1 holds true. If the positive-polarity data line and the negative-polarity data line are short-circuited in the period Te as described above, the effective value of the voltage appearing on the liquid crystal in the scanning period is closer to Vp1 than the effective value Vpb for a case with no period Te provided. Thus, the difference in effective value between the voltage applied to the liquid crystal before the frame transition time and the voltage applied to liquid crystal after the frame transition time is reduced. In addition, since the positive-polarity data line and the negative-polarity data line are short-circuited in the period Te as described above, no electric power is required for generating an electric potential. As a result, flickers can be decreased at a low power consumption.

In addition, by short-circuiting the positive-polarity data line, the negative-polarity data line, the opposite electrode and the storage line in the period Te, the difference in effective value between the voltage applied to the liquid crystal before the frame transition time and the voltage applied to liquid crystal after the frame transition time can also be reduced. If the positive-polarity data line, the negative-polarity data line, the opposite electrode and the storage line are short-circuited, in the period Te, the electric potential appearing on the data lines is always equal to the electric potential appearing on the opposite electrode. During a period Te in a horizontal period corresponding to an on-state period of the second gate line and every subsequent horizontal period, the voltage appearing on the liquid crystal is represented by the following expression:

$$Vpb + \alpha 1(Vcom - Vsmin) + \alpha 2(Vcom - Vsmax).$$

In the period Twt, the voltage appearing on the liquid crystal is Vpb. On the assumption that the relations |Vsmax−Vcom|≈|Vsmin−Vcom| and α1>α2 hold true, the relation Vpb<Vpb+α1(Vcom−Vsmin)+α2(Vcom−Vsmax)<Vp1 also holds true as well. Since the effective value of the voltage appearing on the liquid crystal in the scanning period is closer to Vp1 than the effective value Vpb for a case with no period Te provided, the difference in effective value between the voltage applied to the liquid crystal before the frame transition time and the voltage applied to liquid crystal after the frame transition time is reduced. In addition, since the positive-polarity data line and the negative-polarity data line are short-circuited in the period Te as described above, no electric power is required for generating an electric potential. As a result, flickers can be decreased at a low power consumption. Furthermore, even if the positive-polarity data line, the negative-polarity data line and the opposite electrode only are short-circuited or even if the positive-polarity data line, the negative-polarity data line and the storage line only are short-circuited, the same effect can be obtained.

Moreover, in the period Te, if the data line is a positive-polarity data line, the electric potential appearing on the data line is set at a level not exceeding the electric potential appearing on the opposite electrode. If the data line is a negative-polarity data line, on the other hand, the electric potential appearing on the data line is set at a level at least equal to the electric potential appearing on the opposite electrode. If the data line is a positive-polarity data line in the period Te, the data line was a negative-polarity data line prior to the frame transition. Thus, at the frame transition time, the electric potential appearing on the data line changes from the electric potential Vsm1 to an electric potential corresponding to positive-polarity image data. If the data line is a negative-polarity data line in the period Te, on the other hand, the data line was a positive-polarity data line prior to the frame transition. Thus, at the frame transition time, the electric potential appearing on the data line changes from the electric potential Vsp1 to an electric potential corresponding to negative-polarity image data. Accordingly, since the electric potentials appearing on the data lines are changed in directions opposite to the directions, in which the electric potentials change at the frame transition time, in the scanning period as described above, it is possible to compensate for an effect caused by changes in liquid-crystal voltage. The changes in liquid-crystal voltage are changes, which result at the frame transition time.

If the absolute value of a difference between an electric potential appearing on the positive-polarity data line and an electric potential appearing on the opposite electrode is much different from a difference between an electric potential appearing on the negative-polarity data line and an electric potential appearing on the opposite electrode during the period Te, from Eq. (17), for a specific pixel, the compensation for the effect caused by changes in liquid-crystal voltage at the frame transition time gives an effective result. This is because the positive-polarity and negative-polarity data lines are each arranged on alternate columns. For another pixel adjacent to the specific pixel, on the other hand, the compensation does not give an effective result in some cases. It is thus desirable to have about the same absolute value of a difference between an electric potential appearing on the positive-polarity data line and an electric potential appearing on the opposite electrode as the absolute value of a difference between an electric potential appearing on the negative-polarity data line and an electric potential appearing on the opposite electrode during the period Te. Let symbol Varb denote any arbitrary electric potential between the center electric potential Vcen of the data lines and the electric potential Vcom appearing on the opposite electrode. In this case, the absolute value of a difference between the electric potential appearing on the positive-polarity data line and the electric potential Varb can also be made approximately equal to the absolute value of a difference between the electric potential appearing on the negative-polarity data line and the electric potential Varb during the period Te.

In addition, in the period Te, the electric potential appearing on the data line is set at the electric potential appearing on the negative-polarity data line in the hold period in a case where the data line is a positive-polarity data line and the electric potential appearing on the data line is set at the electric potential appearing on the positive-polarity data line in the hold period in a case where the data line is a negative-polarity data line in order to compensate for an effect caused by a change occurring at a frame transition time as a change in liquid-crystal voltage and in order to suppress changes of the electric potential appearing on the pixel electrode, which are caused by leakage currents of the TFT (thin-film transistor) and the liquid crystal during a scanning period of a pixel in the vicinity of the last gate line. In addition, by using an electric potential appearing on a hold period, the liquid-crystal display device can function without a circuit for generating an electric potential to be applied to a data line in the period Te. Thus, the circuit scale can be prevented from increasing.

In addition, in the period Te, the electric potential appearing on the data line is set at the minimum of data-line electric potentials used in a display in a case where the data line is a positive-polarity data line, and the electric potential appearing on the data line is set at the maximum of the data-line electric potentials used in a display in a case where the data line is a negative-polarity data line in order to shorten the period Te while compensating for an effect caused by a change occurring at a frame transition time as a change in liquid-crystal voltage. Thus, it is possible to lengthen time it takes to write image data into a pixel and reduce demands for high performances of the TFT and the source drain.

(5) FIFTH TYPICAL EXAMPLE

A fifth typical example of the driving method according to the embodiment of the present invention is explained. This typical example also raises a problem of how to control changes in pixel-electrode electric potential, which occur at a frame transition time due to capacitive coupling. A pixel connected to a gate line in the vicinity of the last gate line is most affected by the changes in liquid-crystal voltage, which occur at a frame transition time. In accordance with a method provided for such a pixel to reduce the effect of the changes in liquid-crystal voltage, which occur at a frame transition time, there are provided a period Tea in addition to a period Twa in a scanning period. The periods Tea and Twa are provided before desired image data is written into the pixel connected to a gate line in the vicinity of the last gate line. The period Twa is a period in which driving is carried out to set the electric potential appearing on a gate line at an on-state electric potential, set the electric potential appearing on a data line at an electric potential for writing the desired image data and apply an electric potential corresponding to the desired image data into the pixel electrode. On the other hand, the period Tea is a period in which all gate lines are put in an off state and the electric potential appearing on the data line is set at any arbitrary fixed level. By providing the periods Tea and Twa in this way, the effective value of the liquid-crystal voltage applied to the liquid-crystal layer of the pixel is the sum of the effective values of the voltages appearing on the liquid crystal in the periods Tea and Twa. Thus, by controlling the effective value in the period Tea to compensate for the effect of the changes in liquid-crystal voltage, which occur at a frame transition time, flickers can be suppressed.

In particular, in a display with a high voltage appearing on the liquid crystal, flickers seen as a problem of this typical example increase. In order to make the explanation simple, let symbol Vsmax denote the maximum value of the electric potential appearing on the data line and symbol Vsmin denote the minimum value of the electric potential appearing on the data line. Consider a case in which the change in data-line electric potential at a frame transition time reaches a maximum. Also consider a case in which the entire liquid-crystal panel displays picture data with the electric potentials appearing on the positive-polarity data lines at a level equal to Vsmax and the electric potentials appearing on the negative-polarity data lines at a level equal to Vsmin. In this case, in the period Tea, by setting the electric potential appearing on a data line at a level lower than the electric potential Vsmax if the data line is a positive-polarity data line and by setting the electric potential appearing on a data line at a level higher than the electric potential Vsmin if the data line is a negative-polarity data line, it is possible to obtain an effect of suppressing flickers. That is to say, by setting the electric potentials appearing on the data lines at any arbitrary levels in a range used in a display in the period Tea, an effect of reducing flickers can be obtained.

In addition, if the electric potential appearing on the data line is set at a level not exceeding the electric potential appearing on the opposite electrode in a case where the data line is a positive-polarity data line or a level at least equal to the electric potential appearing on the opposite electrode in a case where the data line is a negative-polarity data line in the period Tea, in which all gate lines are put in an off state, the flickers can be suppressed.

Figure 30:
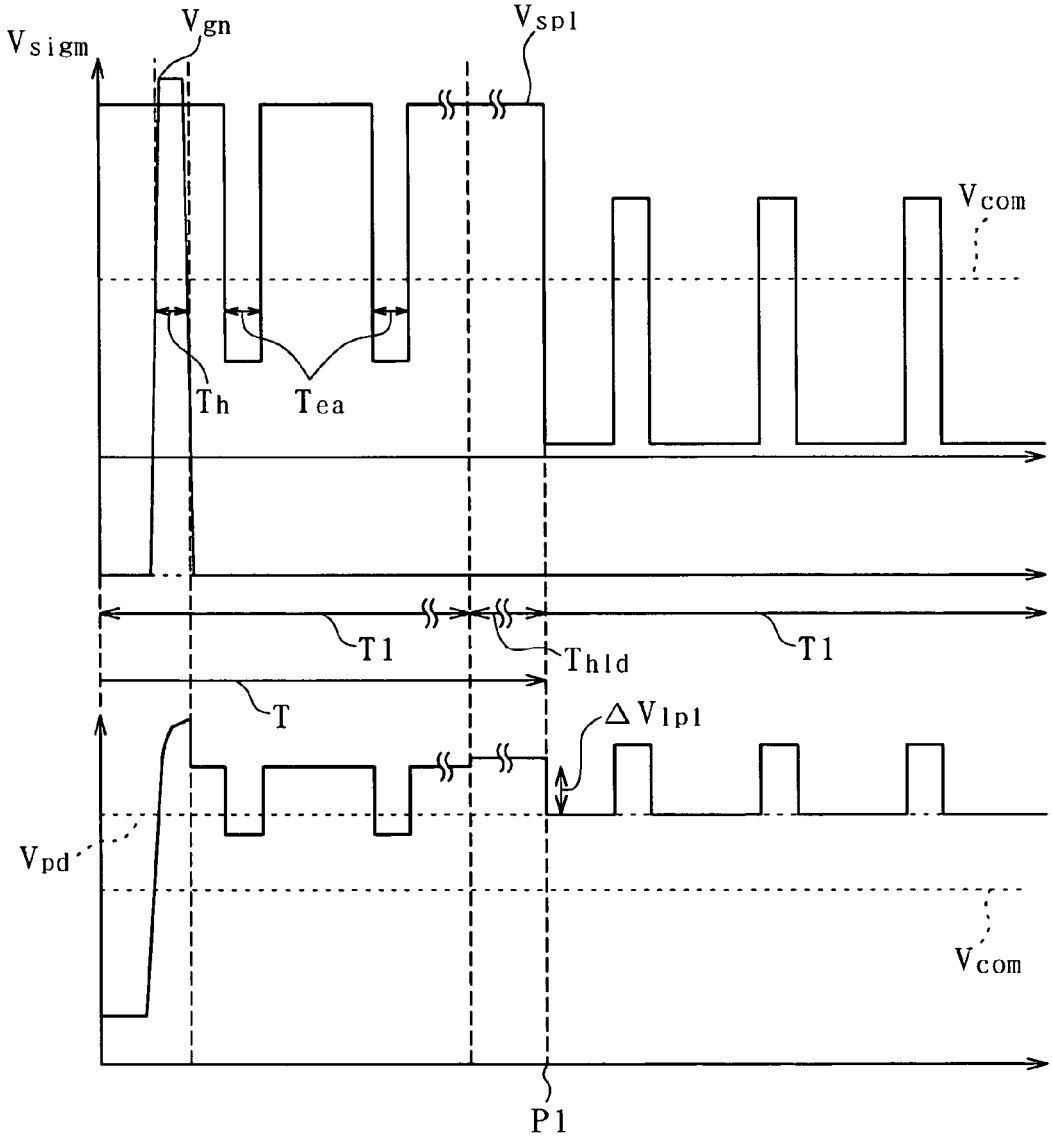
FIG. 30 shows timing charts referred to in explaining a driving method adopted by the liquid-crystal display device implemented by the embodiment of the present invention.

A further explanation with reference to FIG. 30 is given below. Much like the assumption explained earlier by referring to FIG. 29, assume that the relations $|Vsmax-Vcom|\approx|Vsmin-Vcom|$, $|Vsp1-Vcom|\approx|Vsm1-Vcom$ and $\alpha1>\alpha2$ hold true. FIG. 30 shows a timing chart of the electric potential Vsigm appearing on the data line provided on the mth column as a data line connected to a pixel located at the intersection of the nth row and the mth column. The figure also shows a timing chart of changes in pixel electrode, which accompany changes in electric potential Vsigm in the pixel. In addition, the figure also shows a timing chart of the electric potential Vgn occurring on a gate line provided on the nth row. The first frame period shown in the figure is a positive-polarity frame period followed by a negative-polarity frame period. A pixel adjacent to the observed pixel has frame periods with polarities opposite to the polarities of the frame periods of the observed pixel.

At a frame transition time P1, the electric potential appearing on a pixel electrode varies by a change $\Delta Vlp1$, becoming equal to the liquid-crystal voltage Vpb. In the period Tea described above, all the gate lines are put in an off state and, if the data line is a positive-polarity data line, the electric potential appearing on the data line is set at a level not exceeding the electric potential appearing on the opposite electrode but, if the data line is a negative-polarity data line, on the other hand, the electric potential appearing on the data line is set at a level at least equal to the electric potential appearing on the opposite electrode. By setting the electric potentials at such levels, in the period Tea, the voltage appearing on the liquid crystal increases to a level higher than Vpb and the difference in effective value between the voltages applied to the liquid crystal before and after the frame transition is reduced. In addition, in accordance with this driving method, by merely providing 1 to about 4 periods Tea per scanning period, flickers can be reduced adequately. Thus, the amounts of electric power charged and discharged due to changes in data-line electric potential increase by only several tens of microwatts over the amounts of electric power for a case with no period Tea provided. As a result, flickers can be suppressed at a low power consumption.

In addition, if the absolute value of a difference between an electric potential appearing on the positive-polarity data line and an electric potential appearing on the opposite electrode is much different from a difference between an electric potential appearing on the negative-polarity data line and an electric potential appearing on the opposite electrode during the period Tea, from Eq. (17), for a specific pixel, the compensation for the effect caused by changes in liquid-crystal voltage at the frame transition time gives an effective result. This is because the positive-polarity and negative-polarity data lines are each arranged on alternate columns. For another pixel adjacent to the specific pixel, on the other hand, the compensation does not give an effective result in some cases. It is thus desirable to have about the same absolute value of a difference between an electric potential appearing on the positive-polarity data line and an electric potential appearing on the opposite electrode as the absolute value of a difference between an electric potential appearing on the negative-polarity data line and an electric potential appearing on the opposite electrode during the period Tea. Let symbol Varb denote any arbitrary electric potential between the center electric potential Vcen of the data lines and the electric potential Vcom appearing on the opposite electrode. In this case, the absolute value of a difference between the electric potential appearing on the positive-polarity data line and the electric potential Varb can also be made approximately equal to the absolute value of a difference between the electric potential appearing on the negative-polarity data line and the electric potential Varb during the period Tea.

In addition, in the period Tea, the electric potential appearing on the data line is set at the electric potential appearing on the negative-polarity data line in the hold period in case the data line is a positive-polarity data line and the electric potential appearing on the data line is set at the electric potential appearing on the positive-polarity data line in the hold period in case the data line is a negative-polarity data line in order to increase the voltage appearing on the liquid crystal to a level higher than Vpb. Thus, the difference in effective value between the voltages applied to the liquid crystal before and after the frame transition can be reduced. In addition, it is possible to suppress changes of the electric potential appearing on the pixel electrode, which are caused by leakage currents of the TFT and the liquid crystal during a scanning period of a pixel in the vicinity of the last gate line. In addition, by using an electric potential appearing on a hold period, the liquid-crystal display device is capable of functioning without a circuit for generating an electric potential to be applied to a data line in the period Tea. Thus, an increase in circuit scale can be avoided.

In addition, by short-circuiting the positive-polarity data line and the negative-polarity data line in the period Tea where all the gate lines are put in an off state, the voltage appearing on the liquid crystal in this period can be raised to a level higher than Vpb. Thus, the difference in effective value between the voltages applied to the liquid crystal before and after the frame transition can be reduced. In addition, the driving can be carried out at a low power consumption.

Furthermore, also by short-circuiting the positive-polarity data line, the negative-polarity data line, the opposite electrode and the storage line in the period Tea where all the gate lines are put in an off state, the voltage appearing on the liquid crystal in this period can be raised to a level higher than Vpb. Thus, the difference in effective value between the voltages applied to the liquid crystal before and after the frame transition can be reduced. In addition, the driving can be carried out at a low power consumption. Moreover, by short-circuiting the positive-polarity data line, the negative-polarity data line and the opposite electrode only, it is possible to obtain the same effect as that obtained by short-circuiting the positive-polarity data line, the negative-polarity data line and the storage line.

In accordance with the above descriptions, the embodiment implements a reflection-type liquid-crystal display device. It is to be noted, however, that the present invention can of course be applied to transmission-type and transflective-type liquid-crystal display devices as well.

What is claimed is:

1. A method of driving an active-matrix liquid-crystal display device including a liquid-crystal panel comprising:

a pair of substrates, at least one of which is a transparent substrate;

a plurality of data lines, which are each extended in a row direction on a specific one of said substrates and are arranged in a column direction perpendicularly intersecting said row direction;

a plurality of gate lines, which are each extended in said column direction and are arranged in said row direction;

an active device connected at an intersection of each of said data lines and each of said gate lines;

a pixel electrode driven by said active device;

an opposite electrode provided on said specific substrate or the other one of said substrates as an electrode sandwiching a liquid-crystal layer between said opposite electrode and said pixel electrode; and a storage capacitor connected in parallel to said liquid-crystal layer;

wherein:

a frame period of an image displayed on said liquid-crystal panel is divided into a scanning period and a hold period longer than said scanning period;

in said scanning period, image data of an amount corresponding to a frame is written into said liquid-crystal panel;

in said hold period following said scanning period, an off state is sustained;

an electric potential appearing on a positive-polarity data line in said hold period is increased to a level higher than an electric potential appearing on said opposite electrode where said positive-polarity data line is defined as said data line, on which an electric potential appears at a level higher than an electric potential appearing on said opposite electrode when an electric potential appearing on said gate line changes from an on-state level to an off-state level in said scanning period; and an electric potential appearing on a negative-polarity data line in said hold period is decreased to a level lower than said electric potential appearing on said opposite electrode where said negative-polarity data line is defined as said data line provided on a row adjacent to said positive-polarity data line as said data line, on which an electric potential appears at a level lower than an electric potential appearing on said opposite electrode when an electric potential appearing on said gate line changes from an on-state level to an off-state level in said scanning period, wherein said electric potential Vsig appearing on said positive-polarity data line in said hold period has a value in a range expressed in an MKSA unit system by relation (1) as follow:

$$V_{opt} - \left[1 + \frac{R_{off}}{R_1}\right]\frac{\Delta V_c(f)}{1 - e^{\frac{-1}{f\tau}}} \le V_{sig} \le V_{opt} + \left[1 + \frac{R_{off}}{R_1}\right]\frac{\Delta Vc(f)}{1 - e^{\frac{-1}{f\tau}}} \quad (1)$$

where symbol τ denotes a quantity expressed by the following equation:

$$\tau = \frac{R_1 \cdot R_{off}}{R_1 + R_{off}}(C_1 + C_{stg} + C_{sd}),$$

symbol Vopt denotes an electric potential expressed by Eq. (2) as follows:

$$V_{opt} = V_{com} + \left(1 + \frac{R_{off}}{R_1}\right)(V_{fst} - V_{com}) \quad (2)$$

symbol Roff denotes a resistance [Ω] exhibited by said active device when said active device is put in an off state;

symbol R1 denotes a resistance [Ω] exhibited by said liquid-crystal layer sandwiched by said pixel electrodes and said opposite electrode as a resistance expessed by the following equation:

$$R_1 = \frac{d}{S}\rho lc$$

symbol S denotes the area [$m^2$] of said pixel electrode;

symbol d denotes the thickness [m] of said liquid-crystal layer;

symbol ρlc denotes the resistivity [Ωm] of a liquid crystal composing said liquid-crystal layer;

symbol Vcom denotes said electric potential [V] appearing on said opposite electrode;

symbol f denotes a frame frequency [Hz];

symbol Cl denotes the capacitance [F] of said liquid crystal of said liquid-crystal layer;

symbol Cstg denotes the capacitance [F] of said storage capacitor;

symbol Csd denotes the capacitance [F] of a parasitic capacitor existing between said pixel electrode and said data line for said pixel electrode;

symbol Vfst denotes an electric potential [V] appearing on said pixel electrode right after an on-state period in said frame period of said pixel;

symbol ΔVc(f) denotes a change [V] in critical electric potential for said frame frequency f and said electric potential Vfst appearing on said pixel electrode right after said on-state period;

symbol Vopt denotes an optimum electric potential [V] with said electric potential Vfst of said pixel electrode held as it is; and symbol Vsig denotes an electric potential Vsig [V] appearing on said positive-polarity data line in said hold period.

2. A method of driving an active-matrix liquid-crystal display device according to claim 1 wherein said electric potential appearing on said positive-polarity data line in said hold period is set at a fixed level higher than said electric potential appearing on said opposite electrode and said electric potential appearing on said negative-polarity data line in said hold period is set at a fixed level lower than said electric potential appearing on said opposite electrode.

3. A method of driving an active-matrix liquid-crystal display device in accordance with claim 1 wherein a value of Vfst used in said Eq. (2) is set at (Vcom+Vop) in determining a range of possible values for said electric potential appearing on said positive-polarity data line or (Vcom−Vom) in determining a range of possible values for said electric potential appearing on said negative-polarity data line where:

symbol Vop denotes an absolute value of an electric potential, which appears on said positive-polarity data line when a change of a transmittance or a reflectance of said liquid-crystal panel reaches a maximum accompanying a change of said voltage appearing on said liquid crystal in a range of voltages appearing on said liquid crystal as voltages used in a display; and symbol Vom denotes an absolute value of an electric potential, which appears on said negative-polarity data line when a change of said transmittance or said reflectance of said liquid-crystal panel reaches a maximum accompanying a change of said voltage appearing on said liquid crystal in said range of voltages appearing on said liquid crystal as voltages used in a display.

4. A method of driving an active-matrix liquid-crystal display device in accordance with claim 1 wherein:

in determining a range of possible values for said electric potential appearing on said positive-polarity data line, the value of Vfst used in Eq. (2) is set at said electric potential appearing on said pixel electrode right after said on-state period as an electric potential corresponding to image data of a tone adjacent to a tone showing a transmittance or a reflectance equal to about half a maximum transmittance or a maximum reflectance respectively in a positive-polarity frame period comprising a specific one of said scanning periods and said hold period following said specific scanning period where said specific scanning period is a period in which said electric potential appearing on said data line is set at a level higher than said electric potential appearing on said opposite electrode when an electric potential appearing on said gate line changes from an on-state level to an off-state level in said scanning period; and in determining a range of possible values for said electric potential appearing on said negative-polarity data line, the value of Vfst used in Eq. (2) is set at said electric potential appearing on said pixel electrode right after said on-state period as an electric potential corresponding to image data of a tone adjacent to a tone showing a transmittance or a reflectance equal to about half a maximum transmittance or a maximum reflectance respectively in a negative-polarity frame period comprising a specific one of said scanning periods and said hold period following said specific scanning period where said specific scanning period is a period in which said electric potential appearing on said data line is set at a level lower than said electric potential appearing on said opposite electrode when an electric potential appearing on said gate line changes from an on-state level to an off-state level in said scanning period.

5. A method of driving an active-matrix liquid-crystal display device including a liquid-crystal panel comprising:

a pair of substrates, at least one of which is a transparent substrate;

a plurality of data lines, which are each extended in a row direction on a specific one of said substrates and are arranged in a column direction perpendicularly intersecting said row direction;

an active device connected at an intersection of each of said data lines and each of said gate lines;

a pixel electrode driven by said active device;

an opposite electrode provided on said specific substrate or the other one of said substrates as an electrode sandwiching a liquid-crystal layer between said opposite electrode and said pixel electrode; and a storage capacitor connected in parallel to said liquid-crystal layer;

wherein:

a frame period of an image displayed on said liquid-crystal panel is divided into a scanning period and a hold period longer than said scanning period;

in said scanning period, image data of an amount corresponding to a frame is written into said liquid-crystal panel;

in said hold period following said scanning period, an off state is sustained;

an electric potential appearing on a positive-polarity data line in said hold period is increased to a level higher than an electric potential appearing on said opposite electrode where said positive-polarity data line is defined as said data line, on which an electric potential appears at a level higher than an electric potential appearing on said opposite electrode when an electric potential appearing on said gate line changes from an on-state level to an off-state level in said scanning period; and an electric potential appearing on a negative-polarity data line in said hold period is decreased to a level lower than said electric potential appearing on said opposite electrode where said negative-polarity data line is defined as said data line provided on a row adjacent to said positive-polarity data line as said data line, on which an electric potential appears at a level lower than an electric potential appearing on said opposite electrode when an electric potential appearing on said gate line changes from an on-state level to an off-state level in said scanning period, wherein said electric potential Vsig [V] appearing on said positive-polarity data line in said hold period is set at approximately a value expressed in an MKSA unit system by Eq. (3) as follows:

$$V_{sig} = V_{com} + \left[1 + \frac{R_{off}}{\rho 1 c \frac{d}{s}}\right] \times V_0 \tag{3}$$

and said electric potential Vsig [V] appearing on said negative-polarity data line in said hold period is set at approximately a value expressed in an MKSA unit system by Eq. (4) as follows:

$$V_{sig} = V_{com} - \left[1 + \frac{R_{off}}{\rho 1 c \frac{d}{s}}\right] \times V_0 \tag{4}$$

where symbol Vo denotes an absolute value [V] of a voltage appearing on said liquid crystal as a voltage corresponding to any arbitrary image data.

6. A method of driving an active-matrix liquid-crystal display device in accordance with claim 5 wherein, when an electric potential appearing on a gate line in a scanning period of a frame period has been set at an on-state level, said electric potential appearing on said data line has been set at a level for writing desired image data and, right after that, all said gate lines have been put in an off state, desired image data is written into all said pixels by carrying out driving repeatedly on each of said gate lines to:

set said electric potential appearing on said data line, which serves as said positive-polarity data line, at a level symmetrical with respect to an electric potential appearing on said positive-polarity data line in said on-state period with its center of symmetry coinciding with a data-line electric potential approximately equal to a quantity expressed by said Eq. (3); and set said electric potential appearing on said data line, which serves as said negative-polarity data line, at a level symmetrical with respect to an electric potential appearing on said negative-polarity data line in said on-state period with its center of symmetry coinciding with a data-line electric potential approximately equal to a quantity expressed by said Eq. (4).

7. A method of driving an active-matrix liquid-crystal display device in accordance with claim 5 wherein:

driving is carried out on k gate lines of said gate lines to set said electric potentials appearing on said k gate lines in said scanning period of said frame period at an on-state level, set said electric potential appearing on said data line at levels for writing pieces of desired picture data and write said electric potentials corresponding to said pieces of desired image data into said pixel electrodes;

right after that, all said gate lines are put in an off state; and desired picture data is written into all said pixels by carrying out driving repeatedly on each of said k gate lines to:

set each of k electric potentials appearing on said data line, which serves as said positive-polarity data line, at a level approximately symmetrical with respect to an electric potential appearing on said positive-polarity data line in a period of scanning said k gate lines as one of k electric potentials each corresponding to one of said k pieces of desired image data for an arbitrary period length with its center of symmetry coinciding with a data-line electric potential equal to a quantity expressed by said Eq. (3); and set each of k electric potentials appearing on said data line, which serves as said negative-polarity data line, at a level approximately symmetrical with respect to an electric potential appearing on said negative-polarity data line in a period of scanning said k gate lines as one of k electric potentials each corresponding to one of said k pieces of desired image data for an arbitrary period length with its center of symmetry coinciding with a data-line electric potential equal to a quantity expressed by said Eq. (4).

8. A method of driving an active-matrix liquid-crystal display device in accordance with claim 5 wherein:

driving is carried out on k gate lines of said gate lines to set said electric potentials appearing on said k gate lines in said scanning period of said frame period at an on-state level, set said electric potential appearing on said data line at levels for writing pieces of desired image data and write said electric potentials corresponding to said pieces of desired data into said pixel electrodes;

right after that, all said gate lines are put in an off state; and desired image data is written into all said pixels by carrying out driving repeatedly on each of said k gate lines to:

set said electric potential appearing on said data line, which serves as said positive-polarity data line, at a level approximately symmetrical with respect to an average of electric potentials appearing on said positive-polarity data line in a period of scanning said k gate lines as k electric potentials each corresponding to one of said k pieces of desired data with its center of symmetry coinciding with a data-line electric potential equal to a quantity expressed by said Eq. (3); and set said electric potential appearing on said data line, which serves as said negative-polarity data line, at a level approximately symmetrical with respect to an average of electric potentials appearing on said negative-polarity data line in a period of scanning said k gate lines as k electric potentials each corresponding to one of said k pieces of desired image data with its center of symmetry coinciding with a data-line electric potential equal to a quantity expressed by said Eq. (4).

9. A method of driving an active-matrix liquid-crystal display device in accordance with claim 5 wherein a quantity represented by symbol Vo in Eqs. (3) and (4) as the absolute value of said voltage appearing on said liquid crystal is set at a magnitude equal to about an effective value of said liquid-crystal voltage for which a change in transmittance or reflectance reaches a maximum accompanying a change of said voltage appearing on said liquid crystal as a voltage used in a display.

10. A method of driving an active-matrix liquid-crystal display device in accordance with claim 5 wherein:

a quantity represented by symbol Vo in Eq. (3) as the absolute value of said voltage appearing on said liquid crystal is set at the absolute value of said voltage appearing on said liquid crystal for a positive polarity for which a transmittance or a reflectance of said liquid-crystal display device is equal to about half a maximum transmittance or a maximum reflectance respectively in a positive-polarity frame period; and a quantity represented by symbol Vo in Eq. (4) as the absolute value of said voltage appearing on said liquid crystal is set at the absolute value of said voltage appearing on said liquid crystal for a negative polarity for which said transmittance or said reflectance of said liquid-crystal display device is equal to about half said maximum transmittance or said maximum reflectance respectively in a negative-polarity frame period.

11. A method of driving an active-matrix liquid-crystal display device according to claim 1 wherein, as said electric potential appearing on said data line in said hold period:

said electric potential appearing on said positive-polarity data line in said hold period is set at a level minimizing a change of a transmittance or a reflectance of a tone showing a transmittance or a reflectance equal to about half a maximum transmittance or a maximum reflectance respectively in a positive-polarity frame period of said pixel connected to a specific one of said scanning lines, which is close to the last one of said gate lines; and said electric potential appearing on said negative-polarity data line in said hold period is set at a level minimizing a change of a transmittance or a reflectance of a tone showing a transmittance or a reflectance equal to about half a maximum transmittance or a maximum reflectance respectively in a negative-polarity frame period of said pixel connected to a specific one of said scanning lines, which is close to the last one of said gate lines.

12. A method of driving an active-matrix liquid-crystal display device in accordance with claim 2 wherein:

said fixed electric potential appearing on said positive-polarity data line in said hold period is set at a level higher than a sum (Vcom+Vp) of an electric potential Vcom appearing on said opposite electrode and an absolute value Vp of a voltage appearing on said liquid crystal for a positive polarity defined as a polarity for which an electric potential appearing on said pixel electrode is higher than an electric potential appearing on said opposite electrode facing said pixel electrode to provide a gap for sandwiching said liquid-crystal layer with a tone showing a transmittance or a reflectance equal to about half a maximum transmittance or a maximum reflectance respectively among transmittance or reflectance values in a range of voltages appearing on said liquid crystal as voltages used in a display; and said fixed electric potential appearing on said negative-polarity data line in said hold period is set at a level lower than a sum (Vcom−Vm) of said electric potential Vcom and an absolute value Vm of a voltage appearing on said crystal liquid for a negative polarity defined as a polarity for which an electric potential appearing on said pixel electrode is lower than an electric potential appearing on said opposite electrode facing said pixel electrode to provide a gap for sandwiching said liquid-crystal layer with a tone showing a transmittance or a reflectance equal to about half a maximum transmittance or a maximum reflectance respectively among transmittance or reflectance values in said range of voltages appearing on said liquid crystal as voltages used in a display.

13. A method of driving an active-matrix liquid-crystal display device in accordance with claim 2 wherein:

said fixed electric potential appearing on said positive-polarity data line in said hold period is set at a level higher than (Vsp50−ΔVft) and said fixed electric potential appearing on said negative-polarity data line in said hold period is set at a level lower than (Vsm50−ΔVft), where:

symbol Vsp50 denotes an electric potential appearing on said positive-polarity data line as an electric potential corresponding to a tone showing a transmittance or a reflectance equal to about half a maximum transmittance or a maximum reflectance respectively among transmittance or reflectance values in a range of voltages appearing on said liquid crystal as voltages used in a display;

symbol Vsm50 denotes an electric potential appearing on said negative-polarity data line as an electric potential corresponding to a tone showing a transmittance or a reflectance equal to about half a maximum transmittance or a maximum reflectance respectively among transmittance or reflectance values in said range of voltages appearing on said liquid crystal as voltages used in a display; and symbol ΔVft denotes a quantity expressed by Eq. (5) as follows:

$$\Delta V_{ft} = \left[\frac{Vsp50 + Vsm50)}{2}\right] - V_{com}. \tag{5}$$

14. A method of driving an active-matrix liquid-crystal display device in accordance with claim 2 wherein:

said fixed electric potential appearing on said positive-polarity data line in said hold period is set at a level higher than Vsp50 and said fixed electric potential appearing on said negative-polarity data line in said hold period is set at a level lower than Vsm50, where:

symbol Vsp50 denotes an electric potential appearing on said positive-polarity data line as an electric potential corresponding to a tone showing a transmittance or a reflectance equal to about half a maximum transmittance or a maximum reflectance respectively among transmittance or reflectance values in a range of voltages appearing on said liquid crystal as voltages used in a display; and symbol Vsm50 denotes an electric potential appearing on said negative-polarity data line as an electric potential corresponding to a tone showing a transmittance or a reflectance equal to about half a maximum transmittance or a maximum reflectance respectively among transmittance or reflectance values in said range of voltages appearing on said liquid crystal as voltages used in a display.

15. A method of driving an active-matrix liquid-crystal display device according to claim 1 wherein:

said electric potential appearing on said positive-polarity data line in said hold period is driven to a level higher than a sum (Vcom+Vp) of an electric potential Vcom appearing on said opposite electrode and an absolute value Vp of a voltage appearing on said crystal liquid for a positive polarity defined as a polarity for which an electric potential appearing on said pixel electrode is higher than an electric potential appearing on said opposite electrode facing said pixel electrode to provide a gap for sandwiching said liquid-crystal layer with a tone showing a transmittance or a reflectance equal to about half a maximum transmittance or a maximum reflectance respectively among transmittance or reflectance values in a range of voltages appearing on said liquid crystal as voltages used in a display; and said electric potential appearing on said negative-polarity data line in said hold period is driven to a level lower than a sum (Vcom−Vm) of said electric potential Vcom and an absolute value Vm of a voltage appearing on said crystal liquid for a negative polarity defined as a polarity for which an electric potential appearing on said pixel electrode is lower than an electric potential appearing on said opposite electrode facing said pixel electrode to provide a gap for sandwiching said liquid-crystal layer with a tone showing a transmittance or a reflectance equal to about half a maximum transmittance or a maximum reflectance respectively among transmittance or reflectance values in said range of voltages appearing on said liquid crystal as voltages used in a display.

16. A method of driving an active-matrix liquid-crystal display device including a liquid-crystal panel comprising:

a pair of substrates, at least one of which is a transparent substrate;

a plurality of data lines, which are each extended in a row direction on a specific one of said substrates and are arranged in a column direction perpendicularly intersecting said row direction;

a plurality of gate lines, which are each extended in said column direction and are arranged in said row direction;

an active device connected at an intersection of each of said data lines and each of said gate lines;

a pixel electrode driven by said active device;

an opposite electrode provided on said specific substrate or the other one of said substrates as an electrode sandwiching a liquid-crystal layer between said opposite electrode and said pixel electrode; and a storage capacitor connected in parallel to said liquid-crystal layer;

wherein:

a frame period of an image displayed on said liquid-crystal panel is divided into a scanning period and a hold period longer than said scanning period;

in said scanning period, image data of an amount corresponding to a frame is written into said liquid-crystal panel;

in said hold period following said scanning period, an off state is sustained;

an electric potential appearing on a positive-polarity data line in said hold period is increased to a level higher than an electric potential appearing on said opposite electrode where said positive-polarity data line is defined as said data line, on which an electric potential appears at a level higher than an electric potential appearing on said opposite electrode when an electric potential appearing on said gate line changes from an on-state level to an off-state level in said scanning period; and an electric potential appearing on a negative-polarity data line in said hold period is decreased to a level lower than said electric potential appearing on said opposite electrode where said negative-polarity data line is defined as said data line provided on a row adjacent to said positive-polarity data line as said data line, on which an electric potential appears at a level lower than an electric potential appearing on said opposite electrode when an electric potential appearing on said gate line changes from an on-state level to an off-state level in said scanning period, wherein:

said electric potential appearing on said positive-polarity data line in said hold period is driven to a level higher than (Vsp50−ΔVft) and said electric potential appearing on said negative-polarity data line in said hold period is driven to a level lower than (Vsm50−ΔVft), where:

symbol Vsp50 denotes an electric potential appearing on said positive-polarity data line as an electric potential corresponding to a tone showing a transmittance or a reflectance equal to about half a maximum transmittance or a maximum reflectance respectively among transmittance or reflectance values in a range of voltages appearing on said liquid crystal as voltages used in a display;

symbol Vsm50 denotes an electric potential appearing on said negative-polarity data line as an electric potential corresponding to a tone showing a transmittance or a reflectance equal to about half a maximum transmittance or a maximum reflectance respectively among transmittance or reflectance values in said range of voltages appearing on said liquid crystal as voltages used in a display; and symbol ΔVft denotes a quantity expressed by Eq. (5) as follows:

$$\Delta V_{ft} = \left[\frac{Vsp50 + Vsm50)}{2}\right] - V_{com}. \tag{5}$$

17. A method of driving an active-matrix liquid-crystal display device according to claim 1 wherein:

said electric potential appearing on said positive-polarity data line in said hold period is driven to a level higher than Vsp50 and said electric potential appearing on said negative-polarity data line in said hold period is driven to a level lower than Vsm50, where:

symbol Vsp50 denotes an electric potential appearing on said positive-polarity data line as an electric potential corresponding to a tone showing a transmittance or a reflectance equal to about half a maximum transmittance or a maximum reflectance respectively among transmittance or reflectance values in a range of voltages appearing on said liquid crystal as voltages used in a display; and symbol Vsm50 denotes an electric potential appearing on said negative-polarity data line as an electric potential corresponding to a tone showing a transmittance or a reflectance equal to about half a maximum transmittance or a maximum reflectance respectively among transmittance or reflectance values in said range of voltages appearing on said liquid crystal as voltages used in a display.

18. A method of driving an active-matrix liquid-crystal display device in accordance with claim 2 wherein said fixed electric potential appearing on said positive-polarity data line in said hold period and said fixed electric potential appearing on said negative-polarity data line in said hold period are set at such values that an absolute value of a difference between said fixed electric potential appearing on said positive-polarity data line and an electric potential appearing on said opposite electrode is approximately equal to an absolute value of a difference between said fixed electric potential appearing on said negative-polarity data line and said electric potential appearing on said opposite electrode.

19. A method of driving an active-matrix liquid-crystal display device in accordance with claim 2 wherein said fixed electric potential appearing on said positive-polarity data line in said hold period and said fixed electric potential appearing on said negative-polarity data line in said hold period are set at such values that an absolute value of a difference between said fixed electric potential appearing on said positive-polarity data line and a data-line center electric potential is approximately equal to an absolute value of a difference between said fixed electric potential appearing on said negative-polarity data line and said data-line center electric potential where said data-line center electric potential is defined as a center electric potential between maximum and minimum values of electric potentials each appearing on said data lines as an electric potential used in a display.

20. A method of driving an active-matrix liquid-crystal display device in accordance with claim 19 wherein a parasite capacitance between said pixel electrode and one of two data lines adjacent to said pixel electrode is approximately equal to a parasite capacitance between said pixel electrode and the other one of said data lines adjacent to said pixel electrode.

21. A method of driving an active-matrix liquid-crystal display device in accordance with claim 2 wherein a horizontal period of a scanning period of a frame includes a period for setting said electric potential appearing on said data line at any arbitrary level in addition to a period for setting said electric potential appearing on said data line at a level corresponding to desired image data.

22. A method of driving an active-matrix liquid-crystal display device in accordance with claim 21 wherein said period for setting said electric potential appearing on said data line at any arbitrary level is a period during which said positive-polarity data line is short-circuited to said negative-polarity data line.

23. A method of driving an active-matrix liquid-crystal display device in accordance with claim 21 wherein said period for setting said electric potential appearing on said data line at any arbitrary level is a period during which said positive-polarity data line, said negative-polarity data line, said opposite electrode and said storage line are short-circuited to each other.

24. A method of driving an active-matrix liquid-crystal display device in accordance with claim 21 wherein said period for setting said electric potential appearing on said data line at any arbitrary level is a period during which said electric potential appearing on said data line is set at a level equal to or lower than said electric potential appearing on said opposite electrode in a case where said data line is said positive-polarity data line or a level equal to or higher than said electric potential appearing on said opposite electrode in a case where said data line is said negative-polarity data line.

25. A method of driving an active-matrix liquid-crystal display device in accordance with claim 21 wherein said period for setting said electric potential appearing on said data line at any arbitrary level is a period during which said electric potential appearing on said data line is set at said electric potential appearing on said negative-polarity data line in said hold period in a case where said data line is said positive-polarity data line or at said electric potential appearing on said positive-polarity data line in said hold period in a case where said data line is said negative-polarity data line.

26. A method of driving an active-matrix liquid-crystal display device in accordance with claim 21 wherein said period for setting said electric potential appearing on said data line at any arbitrary level is a period during which said electric potential appearing on said data line is set at a minimum value of said electric potentials each appearing on said data line as an electric potential used in a display in a case where said data line is said positive-polarity data line or at a maximum value of said electric potentials each appearing on said data line as an electric potential used in a display in a case where said data line is said negative-polarity data line.

27. A method of driving an active-matrix liquid-crystal display device in accordance with claim 2 wherein:

a horizontal period of a scanning period of a frame includes a specific period for setting all said gate lines in an off state and setting said electric potential appearing on said data line at any arbitrary level in addition to a period for setting said electric potential appearing on said gate line at an on-state level, setting said electric potential appearing on said data line at a level for writing desired image data and applying an electric potential for writing said desired image data to said pixel electrode; and one or more said specific periods are provided in said scanning period before said image data is written into a pixel connected to a last gate line.

28. A method of driving an active-matrix liquid-crystal display device in accordance with claim 27 wherein said specific period for setting said electric potential appearing on said data line at any arbitrary level is a period during which said electric potential appearing on said data line is set at a level equal to or lower than said electric potential appearing on said opposite electrode in a case where said data line is said positive-polarity data line or a level equal to or higher than said electric potential appearing on said opposite electrode in a case where said data line is said negative-polarity data line.

29. A method of driving an active-matrix liquid-crystal display device in accordance with claim 27 wherein said specific period for setting said electric potential appearing on said data line at any arbitrary level is a period during which an absolute value of a difference between said fixed electric potential appearing on said positive-polarity data line and an electric potential appearing on said opposite electrode is approximately equal to an absolute value of a difference between said fixed electric potential appearing on said negative-polarity data line and said electric potential appearing on said opposite electrode.

30. A method of driving an active-matrix liquid-crystal display device in accordance with claim 27 wherein said specific period for setting said electric potential appearing on said data line at any arbitrary level is a period during which said electric potential appearing on said data line is set at said electric potential appearing on said negative-polarity data line in said hold period in a case where said data line is said positive-polarity data line or at said electric potential appearing on said positive-polarity data line in said hold period in a case where said data line is said negative-polarity data line.

31. A method of driving an active-matrix liquid-crystal display device in accordance with claim 27 wherein said specific period for setting said electric potential appearing on said data line at any arbitrary level is a period during which said positive-polarity data line is short-circuited to said negative-polarity data line.

32. A method of driving an active-matrix liquid-crystal display device in accordance with claim 27 wherein said specific period for setting said electric potential appearing on said data line at any arbitrary level is a period during which said positive-polarity data line, said negative-polarity data line, said opposite electrode and said storage line are short-circuited to each other.

* * * * *